US007505728B2

(12) United States Patent
Yamaguchi et al.

(10) Patent No.: US 7,505,728 B2
(45) Date of Patent: Mar. 17, 2009

(54) LUBRICANT APPLYING UNIT, PROCESS CARTRIDGE, IMAGE FORMING APPARATUS, AND IMAGE FORMING METHOD

(75) Inventors: Daichi Yamaguchi, Tokyo (JP); Kenji Sugiura, Kanagawa (JP); Takahiko Tokumasu, Tokyo (JP); Takuya Seshita, Kanagawa (JP); Katsuhiko Tani, Tokyo (JP); Yumiko Yagi, Shizuoka (JP)

(73) Assignee: Ricoh Company, Limited, Tokyo (JP)

( * ) Notice: Subject to any disclaimer, the term of this patent is extended or adjusted under 35 U.S.C. 154(b) by 160 days.

(21) Appl. No.: 11/692,498

(22) Filed: Mar. 28, 2007

(65) Prior Publication Data

US 2007/0166087 A1 Jul. 19, 2007

Related U.S. Application Data

(62) Division of application No. 11/058,463, filed on Feb. 16, 2005, now Pat. No. 7,209,699.

(30) Foreign Application Priority Data

| | | |
|---|---|---|
| Feb. 16, 2004 | (JP) | 2004-038172 |
| Apr. 16, 2004 | (JP) | 2004-122260 |
| Sep. 17, 2004 | (JP) | 2004-272288 |
| Oct. 21, 2004 | (JP) | 2004-306708 |

(51) Int. Cl.
*G03G 21/00* (2006.01)

(52) U.S. Cl. ..... 399/346; 399/347

(58) Field of Classification Search ..... 399/107, 399/111, 343, 345, 346, 347; 15/256.5, 256.51, 15/256.52

See application file for complete search history.

(56) References Cited

U.S. PATENT DOCUMENTS

| | | | | |
|---|---|---|---|---|
| 5,463,456 | A | 10/1995 | Yashiki et al. | |
| 6,160,977 | A | 12/2000 | Takeichi et al. | |
| 6,330,420 | B1 | 12/2001 | Honda | |
| 6,549,742 | B1 * | 4/2003 | Chigono et al. | 399/174 |
| 6,842,602 | B2 * | 1/2005 | Kudo | 399/303 |
| 6,904,253 | B2 * | 6/2005 | Hosokawa et al. | 399/176 |
| 7,103,301 | B2 * | 9/2006 | Watanabe et al. | 399/159 |

(Continued)

FOREIGN PATENT DOCUMENTS

| | | |
|---|---|---|
| JP | 5-150564 | 6/1993 |

(Continued)

OTHER PUBLICATIONS

U.S. Appl. No. 12/031,333, filed Feb. 14, 2008, Sugimoto, et al.

(Continued)

*Primary Examiner*—Hoan H Tran
(74) *Attorney, Agent, or Firm*—Oblon, Spivak, McClelland, Maier & Neustadt, P.C.

(57) ABSTRACT

A lubricant applying unit includes a lubricant composed of metal salt of fatty acid; an applying member that applies the lubricant on a subject under lubricant application; and a spreading member that forms a thin layer of the lubricant applied on the subject. The spreading member spreads the lubricant in such a manner that a thickness of the thin layer is in a range of 8 nanometers to 12 nanometers.

16 Claims, 34 Drawing Sheets

U.S. PATENT DOCUMENTS

| | | | | |
|---|---|---|---|---|
| 7,302,197 | B2 * | 11/2007 | Kosuge | 399/27 |
| 2006/0133872 | A1 | 6/2006 | Sugiura et al. | |
| 2006/0210334 | A1 | 9/2006 | Tokumasu et al. | |
| 2007/0166087 | A1 | 7/2007 | Yamaguchi et al. | |

FOREIGN PATENT DOCUMENTS

| | | |
|---|---|---|
| JP | 9-62163 | 3/1997 |
| JP | 10-142897 | 5/1998 |
| JP | 2859646 | 12/1998 |
| JP | 11-38855 | 2/1999 |
| JP | 2000-75752 | 3/2000 |
| JP | 2000-162881 | 6/2000 |
| JP | 2000-338733 | 12/2000 |
| JP | 2001-343861 | 12/2001 |
| JP | 2002-55580 | 2/2002 |
| JP | 2002-156877 | 5/2002 |
| JP | 2002-229227 | 8/2002 |
| JP | 2002-244485 | 8/2002 |
| JP | 2002-244487 | 8/2002 |
| JP | 2002-244516 | 8/2002 |
| JP | 2003-36011 | 2/2003 |
| JP | 2003-330320 | 11/2003 |
| JP | 3507277 | 12/2003 |

OTHER PUBLICATIONS

U.S. Appl. No. 12/030,608, filed Feb. 13, 2008, Sugimoto, et al.
U.S. Appl. No. 11/692,498, filed Mar. 28, 2007, Yamaguchi, et al.
U.S. Appl. No. 12/137,158, filed Jun. 11, 2008, Naruse, et al.

* cited by examiner

FIG. 35

| CHARGING TIME (S) | C-H, C-C | C-O | COO | $\pi \rightarrow \pi^*$ |
|---|---|---|---|---|
| 0 | 93.1 | 4.0 | 3.0 | 0.0 |
| 10 | 86.0 | 9.4 | 4.6 | 0.0 |
| 30 | 77.4 | 14.1 | 6.5 | 2.0 |
| 60 | 74.3 | 16.3 | 6.6 | 2.9 |
| 120 | 74.1 | 16.3 | 3.8 | 5.8 |

FIG. 36

| CHARGING TIME (S) | AREA RATIO OF ZINC STEARATE ON PHOTOSENSITIVE DRUM |
|---|---|
| 0 | 100 |
| 10 | 100 |
| 30 | 65 |
| 60 | 50 |
| 120 | 0 |

LUBRICANT APPLYING UNIT, PROCESS CARTRIDGE, IMAGE FORMING APPARATUS, AND IMAGE FORMING METHOD

CROSS-REFERENCE TO RELATED APPLICATIONS

The present application is a Divisional of U.S. patent application Ser. No. 11/058,463, filed Feb. 16, 2005, and claims priority to Japanese Patent Applications No. 2004-038172, filed Feb. 16, 2004, No. 2004-122260, filed Apr. 16, 2004, No. 2004-272288, filed Sep. 17, 2004, and No. 2004-306708, filed Oct. 21, 2004, the entire contents of which are incorporated herein by reference in their entirety.

BACKGROUND OF THE INVENTION

1) Field of the Invention

The present invention relates to a lubricant applying unit that applies lubricant to form a thin layer of the lubricant, a process cartridge that performs image formation by electrostatic copying and an image forming apparatus employing the lubricant applying unit, and an image forming method.

2) Description of the Related Art

In an electrophotographic image formation, an image (electrostatic latent image) of electrostatic charge is formed on a photosensitive drum by using a photoconductive developing, and charged fine particles (toner) that are colored are adhered by electrostatic force on the electrostatic latent image to obtain a visualized image. In an electrophotographic image forming apparatus, a technology of applying a material such as a wax, a fluorine-contained resin (such as polytetrafluoroethylene and polyvinylidene fluoride), and a metal salt of high fatty acid (zinc stearate) as a lubricant on main components such as the photosensitive drum and an intermediate transfer belt, is available. This technology is used for eliminating trouble in a cleaning process in the electrophotography or in other words in scraping toner remained on the photosensitive drum or the intermediate transfer belt by a cleaning brush or a cleaning blade.

One of the problems is an increase in a life of the photosensitive drum and the intermediate transfer belt. It has been revealed that the life of the photosensitive drum and the intermediate transfer belt is determined mainly by wearing out due to mechanical rubbing of the cleaning brush and the cleaning blade. Therefore, by applying a lubricant on the photosensitive drum or the intermediate transfer belt, a coefficient of friction of the surface of the photosensitive drum or the intermediate transfer belt is allowed to be lowered, thereby reducing the wearing out.

Another problem relates to the cleaning. By applying the lubricant on the surface it is possible to reduce the coefficient of friction of the surface and to remove easily the deposits adhered to the surface. In other words, it is possible to remove easily the toner remained on the photosensitive drum and the intermediate transfer belt that has not been transferred fully to a final recording medium such as paper. In recent years, a use of a spherical toner that is prepared by a polymerization is started. In such a toner, since a particle-size distribution is uniform and the size of particles is controlled efficiently to a small size, there is an improvement in the image quality, however the cleaning of the toner remained on the photosensitive drum becomes difficult. In view of such a technological background, the improvement in cleaning by using the lubricant is supposed to become even more important as a technology.

A small of amount of the lubricant in the form of fine particles is supplied to the surface of the photosensitive drum and a concrete method of scraping the lubricant in the form of a solid block and applying by using an applying unit such as a brush, has been disclosed in Japanese Patent Application Laid-open Publication No. 2000-162881. A method of supplying the lubricant to the photosensitive drum by adding it externally to the toner has been disclosed in Japanese Patent No. 2859646. However, when the lubricant is added externally to the toner and supplied to the photosensitive drum, an amount of the lubricant supplied depends on an image area that is output and since it is not possible to supply the lubricant to the overall surface of the photosensitive drum, a method of scraping the solid lubricant by a brush and applying on the surface of the photosensitive drum is desirable to supply the lubricant stably to the overall surface of the photosensitive drum with a simple structure of a unit.

However, in a case of applying the lubricant on the photosensitive drum, an amount to be applied and a control of the application is very important for exerting the effects of the prevention of wearing out and the improvement in cleaning. If a lubricating ability is emphasized, a lubricant not less than a certain fixed amount may be supplied continuously. However, it has been revealed that if the lubricant is supplied excessively, the lubricant enters into a developer unit and an amount of charging of the toner cannot be controlled. Moreover, from a trend of reduction in a size of copying machines and printers in recent years, reducing the size of each component has become an important technique and it is not desirable to load in the unit the solid lubricant more than that is required.

Various methods of controlling the application of the lubricant have been proposed so far. According to Japanese Patent Application Laid-open Publication No. H9-62163, a welding pressure of the solid lubricant on the photosensitive drum or a rotational speed of an applicator-brush in contact with the solid lubricant is controlled according to a temperature environment. According to Japanese Patent Application Laid-open Publication No. 2000-75752, an amount of lubricant applied per unit number of revolutions of the photosensitive drum is regulated. According to Japanese Patent Application Laid-open Publication No. 2002-24485, parameters such as the number of revolutions of the applicator brush are controlled in accordance with image forming information.

To solve these problems, the lubricant is applied with object of preventing occurrence of toner filming (fusing), preventing improper cleaning, and improving efficiency of transferring by lowering the coefficient of friction. Inventions disclosed in Japanese Patent No. 2859646, Japanese Patent Application Laid-open Publication Nos. H9-62163, 2000-75752, and 2002-24485 have been known and the problems are solved by applying the lubricant on the photosensitive drum and lowering the coefficient of friction.

To increase the life of a charging member and the photosensitive drum, a technology in which a non-contact charging unit is used, inorganic fine particles are allowed to be dispersed on a photosensitive layer of the photosensitive drum, and a compound such as zinc stearate is applied as a lubricant to improve a wear resistance has been disclosed in Japanese Patent Application Laid-open Publication No. 2002-229227.

In addition to this, according to a technology disclosed in Japanese Patent Application Laid-open Publication No. H10-142897, an example of an image forming apparatus in which the lubricant that is applied on the surface of the photosensitive drum is allowed to be deposited uniformly as a thin layer between the charging member and a developing section and has an auxiliary member in the form of a blade to hold back the lubricant having a large diameter, has been mentioned.

Still another problem is that the lubricant cannot be applied sufficiently and uniformly on the surface of the image carrier and a part of the surface of the image carrier goes on wearing out. To solve this problem, various methods of controlling the application of the lubricant have been proposed so far.

According to Japanese Patent Application Laid-open Publication No. H11-38855, a method of applying the lubricant evenly on the surface of the image carrier, in which, upon completion of the image forming operation, the photosensitive drum is rotated in a reverse direction and a thin film of the lubricant is applied by dragging the lubricant stored on the cleaning blade along the surface of the photosensitive drum, has been disclosed.

According to Japanese Patent Application Laid-open Publication No. 2001-343861, for providing an image forming apparatus that enables to prevent a temporary decrease in an amount of consumption of the lubricant initially when a process cartridge is replaced by a new one and to obtain a good image right from the beginning of the output, the image carrier, a lubricant applying unit, and a toner holding-back member are integrated to form a process cartridge that is detachable from a main body of the apparatus, and a substance supplying unit that supplies to the surface of the image carrier a substance that can exert an adsorptive power on the lubricant is provided. When the process cartridge is replaced by a new one, the lubricant is applied on the surface of the image carrier till the image forming operation is started and the lubricant applying unit and the substance supplying unit are controlled such that the substance is supplied to the surface of the image carrier.

However, according to the above method, the lubricant is attracted to the substance that exerts the adsorptive force and cannot be supplied appropriately to the image carrier.

According to Japanese Patent Application Laid-open Publication No. 2002-244487, in an image forming apparatus in which a small particle size toner or a fine particulate toner by polymerization is used, even if the developing cartridge is replaced, a proper amount of the solid lubricant is applied on the surface of the photosensitive drum to provide a highly reliable image forming apparatus in which improper cleaning and fusion do not occur during a durable life. According to this method, in an image forming apparatus that includes a lubricant-film forming unit that forms a film of the lubricant on the surface of the image carrier by bringing in contact the solid lubricant with the rotating brush and applying the lubricant that is adhered to the brush on the image carrier and a developing unit that develops by toner the electrostatic latent image formed on the image carrier, the developing unit is included in the cartridge that is detachable from the apparatus and the amount of the lubricant to be applied on the surface of the image carrier is controlled based on information of condition in which the cartridge is used.

According to Japanese Patent Application Laid-open Publication No. 2003-36011, a cleaning unit in which the rotational speed of the cleaning brush in contact with the photosensitive drum is adjusted appropriately to prevent the occurrence of improper cleaning has been proposed. According to this method, the cleaning unit in which the toner remained on the photosensitive drum after an image is formed by transferring a toner image formed on a rotatable photosensitive drum by at least two circumferential velocities viz. a first circumferential velocity and a second circumferential velocity that is faster than the first circumferential velocity, is structured such that during the image forming, when the photosensitive drum rotates at a first circumferential velocity VA the cleaning brush is allowed to rotate at a first circumferential velocity VB and when the photosensitive drum rotates at a second circumferential velocity VA', the cleaning brush is allowed to rotate at a second circumferential velocity VB' and the relationship of VA, VB, VA', VB, and VB' is $VA<VA'$ and $(VB/VA)>(VB'/VA')$.

Regarding the amount of the lubricant to be applied on the photosensitive drum, a technology disclosed in Japanese Patent Application Laid-open Publication No. 2000-338733 according to which the amount of the lubricant to be applied and a charging potential are controlled based on a result of detection of density of a pattern image formed on the photosensitive drum and a technology disclosed in Japanese Patent Application Laid-open Publication No. 2003-330320 according to which the amount of the lubricant to be applied is controlled according to conditions such as degree of wearing out of the cleaning blade, number of images formed, a distance covered by the photosensitive drum, and a temperature of the blade, have been proposed.

However, according to Japanese Patent No. 2859646, and Japanese Patent Application Laid-open Publication Nos. 2000-162881, H9-62163, 2000-75752, and 2002-24485, the application of the lubricant has been controlled indirectly and not controlled by observing directly the application on the photosensitive drum or the intermediate transfer belt. According to Japanese Patent Application Laid-open Publication Nos. H9-62163 and 2002-24485, the number of revolutions of the brush and the welding pressure of the solid lubricant are controlled and it is not clear as to how the lubricant is applied practically on the photosensitive drum and the intermediate transfer belt. Moreover, according to Japanese Patent Application Laid-open Publication No. 2000-75752, although the amount of the lubricant to be applied is regulated, this amount of the lubricant, to be more precise, is the amount of the solid lubricant consumed and not the amount of the lubricant on the photosensitive drum. This is because, in the method of applying the lubricant by the brush, the lubricant in the form of a powder is always adhered to the brush and when the lubricant is transferred from the brush to the photosensitive drum, a part of it is shaken off.

So far, powdered particles scattered as the lubricant on the photosensitive drum have been observed but no attention has been paid to observation and periodic evaluation of a lubricant other than that in the powder form applied on the photosensitive drum.

According to the technology disclosed in Japanese Patent Application Laid-open Publication No. H11-38855, the lubricant cannot be applied sufficiently and uniformly, and the object has not been achieved. Moreover, according to the invention disclosed in Japanese Patent Application Laid-open Publication No. 2002-244487, although the amount of the lubricant to be supplied to the image carrier can be increased and decreased, it is difficult to apply the lubricant uniformly on the image carrier.

According to the technology disclosed in Japanese Patent Application Laid-open Publication No. 2003-36011, although the amount of lubricant to be supplied to the image carrier can be increased and decreased, it is difficult to apply the lubricant uniformly on the image carrier.

The photosensitive drum is subjected to various hazards during the process of image formation and so is the lubricant that is applied on the photosensitive drum. A process of charging the surface of the photosensitive drum, which precedes the formation of the electrostatic latent image on the surface of the photosensitive drum, is one of the factors that cause such hazard. Such a hazard depends a lot on a method of charging that is used in the image forming apparatus. For the lubricant to perform fully its function, the amount of the lubricant to be applied is to be determined upon having taken into consideration the method of charging, which is not known to have been done so far.

The methods of charging in the electrophotographic image forming apparatus include methods such as corona charging and contact charging or proximity charging. Normally, in the contact charging and the proximity charging, an amount of a product material discharged is less and the charging can be performed at low electric power as compared to that in the corona charging. However, on the other hand, in the contact charging and the proximity charging, it has been revealed that since the photosensitive drum is in contact with a charging member or a distance between the photosensitive drum and the charging member becomes shorter than that between the photosensitive drum and a charging wire, the hazard caused to the photosensitive drum is more than that in the corona charging. Particularly, when AC voltage is superimposed, a corona discharge is repeated according to a frequency of the AC voltage, thereby letting the hazard to be greater. As a result, the surface of the photosensitive drum is deteriorated chemically and in a due course of time a film on the photosensitive drum is scraped. If the lubricant is applied on the surface of the photosensitive drum, there is a change in a surface energy and a molecular structure of the lubricant, thereby resulting in loss of the lubricant. The lubricant is scraped gradually and finally vanishes.

Therefore, initially, even if an appropriate amount of the lubricant is applied on the photosensitive drum, for the lubricant to be stabilized upon elapsing of time and to perform its function, the lubricant is to be continued to be applied considering the chemical deterioration of the lubricant during charging.

SUMMARY OF THE INVENTION

It is an object of the present invention to solve at least the above problems in the conventional technology.

A lubricant applying unit according to one aspect of the present invention includes a lubricant composed of metal salt of fatty acid; an applying member that applies the lubricant on a subject under lubricant application; and a spreading member that forms a thin layer of the lubricant applied on the subject. The spreading member spreads the lubricant in such a manner that a thickness of the thin layer is in a range of 8 nanometers to 12 nanometers.

A process cartridge according to another aspect of the present invention, which supports integrally an image carrier on which an electrostatic latent image is formed by an electrostatic charge, and a processing unit that includes at least one of a charging unit, a developing unit, and a cleaning unit, and which is detachable from the image forming apparatus, includes a lubricant applying unit that includes a lubricant composed of metal salt of fatty acid; an applying member that applies the lubricant on a subject under lubricant application; and a spreading member that forms a thin layer of the lubricant applied on the subject in such a manner that a thickness of the thin layer is in a range of 8 nanometers to 12 nanometers.

An image forming apparatus according to still another aspect of the present invention includes an image carrier on which an electrostatic latent image is formed; a charging unit that charges the image carrier; a latent-image forming unit that forms a latent image on the image carrier by exposing the image carrier; a developing unit that supplies toner to the latent image on the image carrier to form a toner image that is visible; a transferring unit that transfers the toner image to a recording medium directly or via an intermediate transfer body that moves on a surface of the image carrier while being in contact with the image carrier; a cleaning unit that includes a cleaning blade that gathers the toner remained on the surface of the image carrier after transferring the toner image to the recording medium; and a lubricant applying unit that includes a lubricant composed of metal salt of fatty acid; an applying member that applies the lubricant on a subject under lubricant application; and a spreading member that forms a thin layer of the lubricant applied on the subject in such a manner that a thickness of the thin layer is in a range of 8 nanometers to 12 nanometers.

An image forming method according to still another aspect of the present invention, which is for an image forming apparatus including an image carrier on which an electrostatic latent image is formed, a charging unit having a charging member, a lubricant applying unit that applies a lubricant on the image carrier, and is disposed on a downstream side of a transferring unit in a direction of rotation of the image carrier and on an upstream side of the charging unit, and a lubricant spreading unit that forms a thin layer of the lubricant on the image carrier, includes detecting a replacement of the image carrier by a detecting unit; and passing, when the replacement of the image carrier is detected, at least one of the lubricant applying unit and the lubricant spreading unit more than two times.

An image forming method according to still another aspect of the present invention, which is for an image forming apparatus including an image carrier on which an electrostatic latent image is formed, a charging unit including a charging member that is in proximity with or in contact with the image carrier, a lubricant applying unit that applies a lubricant on the image carrier, and is disposed on a downstream side of a transferring unit in a direction of rotation of the image carrier and on an upstream side of the charging unit, and a lubricant spreading unit that forms a thin film of the lubricant on the image carrier, includes counting time or number of prints by a counter; and passing, every time a predetermined time is elapsed or a predetermined number of prints is output, at least one of the lubricant applying unit and the lubricant spreading unit more than two times.

An image forming apparatus according to still another aspect of the present invention includes an image carrier on which an electrostatic latent image is formed; a charging unit including a charging member that is in proximity with or in contact with the image carrier; a lubricant applying unit that applies a lubricant on the image carrier, and is disposed on a downstream side of a transferring unit in a direction of rotation of the image carrier and on an upstream side of the charging unit; a lubricant spreading unit that forms a thin film of the lubricant on the image carrier; a detecting unit that detects a replacement of the image carrier; and a controlling unit passes, when the replacement of the image carrier is detected, at least one of the lubricant applying unit and the lubricant spreading unit more than two times.

An image forming apparatus according to still another aspect of the present invention includes an image carrier on which an electrostatic latent image is formed; a charging unit including a charging member that is in proximity with or in contact with the image carrier; a lubricant applying unit that applies a lubricant on the image carrier, and is disposed on a downstream side of a transferring unit in a direction of rotation of the image carrier and on an upstream side of the charging unit; a lubricant spreading unit that forms a thin film of the lubricant on the image carrier; a counter that counts time collapsed or number of prints; and a controlling unit that passes, every time a predetermined time is elapsed or a predetermined number of prints is output, at least one of the lubricant applying unit and the lubricant spreading unit more than two times.

A lubricant applying unit according to still another aspect of the present invention includes a lubricant that is disposed at a position at which the lubricant is applicable on a surface of an image carrier on which a toner image is formed; a detecting unit that detects a strength of a discharge that is generated between the image carrier and a charging member that is disposed close to or in contact with the surface of the image carrier; and an amount adjusting unit that adjusts an amount of the lubricant to be applied on the surface of the image carrier based on a result of detection by the detecting unit.

An image forming apparatus according to still another aspect of the present invention includes an image carrier on which a toner image is formed; a lubricant applying unit including a lubricant that is disposed at a position at which the lubricant is applicable on a surface of an image carrier on which a toner image is formed, a detecting unit that detects a strength of a discharge that is generated between the image carrier and a charging member that is disposed close to or in contact with the surface of the image carrier, and an amount adjusting unit that adjusts an amount of the lubricant applied on the surface of the image carrier based on a result of detection by the detecting unit; a charging member that is disposed closed to or in contact with the surface of the image carrier and charges the surface of the image carrier by generating a discharge between the image carrier and the charging member; an optical writing unit that forms an electrostatic latent image by exposing the surface of the image carrier; a developing unit that develops the electrostatic latent image as a toner image by supplying a toner; and a transferring unit that transfers the toner image to a recording medium.

A process cartridge according to still another aspect of the present invention includes an image carrier on which a toner image is formed; a cartridge case that rotatably holds the image carrier; and a lubricant that is held in a position at which the lubricant is applicable on the surface of the image carrier. An amount of the lubricant to be applied on the surface of the image carrier is adjusted based on a result of detection by a detecting unit that detects a strength of a discharge generated between the image carrier and a charging member that is disposed in proximity with or in contact with the surface of the image carrier.

The other objects, features, and advantages of the present invention are specifically set forth in or will become apparent from the following detailed description of the invention when read in conjunction with the accompanying drawings.

BRIEF DESCRIPTION OF THE DRAWINGS

FIG. 35 is a table of results obtained by investigating by using X-ray photoelectron spectroscopy (XPS), a change in an amount of zinc stearate on a surface of the photosensitive drum due to charging after applying zinc stearate;

FIG. 36 is a table of results upon calculating the amount of zinc stearate on the surface of the photosensitive drum based on the results shown in FIG. 35;

DETAILED DESCRIPTION

Exemplary embodiments according to the present invention are described below in detail with reference to accompanying diagrams. The appended claims are not to be limited but are to be construed as embodying all modifications and alternative constructions that may occur to one skilled in the art which fairly fall within the basic teaching herein set forth.

Figure 1:
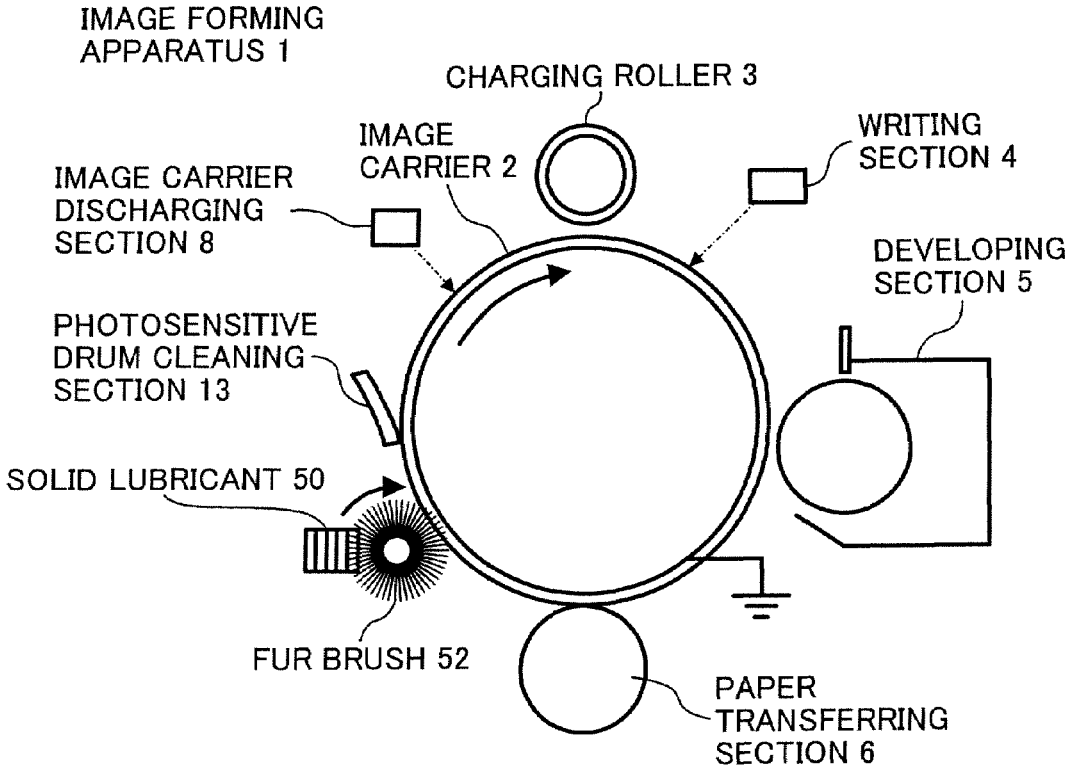
FIG. 1 is a diagram of an example of an image forming apparatus 1 according to the present invention.

FIG. 1 is a diagram of an example of an image forming apparatus according to the present invention. An image forming apparatus 1 includes an image carrier 2 that is driven and rotates in a clockwise direction. The image forming apparatus 1 further includes a charging roller 3, a writing section 4, a developing section 5, a transferring section 6, a paper-separating section, a cleaning section 13, an image-carrier decharging section 8, a voltage applying section 16, a solid lubricant 50, and a fur brush 52, which are disposed around the image carrier 2.

The image forming apparatus 1 is equipped with a paper feeding cassette that accommodates a plurality of recording papers, which is not shown in the diagram. The recording papers in the paper feeding cassette are fed one by one by a paper feeding roller that is not shown in the diagram, between the paper transferring section 6 and the image carrier 2 upon adjustment of timing by a pair of registering rollers that is not shown in the diagram.

The image carrier 2 is charged uniformly by the charging roller 3 and an electrostatic latent image is formed on the image carrier 2 by irradiating a laser beam that is modulated according to image data, by the writing section 4. The electrostatic latent image formed on the image carrier 2 is developed by adhering toner in the developing section 5. A toner image formed on the image carrier 2 is transferred to a recording paper that is carried between the image carrier 2 and the paper transferring section 7, by the paper transferring section 7. The recording paper with the toner image transferred on it is carried to a fixing section.

The fixing section includes a fixing roller and a pressurizing roller. The fixing roller is heated to a predetermined fixing temperature by a built-in heater and the pressurizing roller is pressed against the fixing roller with a predetermined pressure. The recording paper carried from the paper transferring section 7 is heated and pressurized by the fixing roller and the pressurizing roller respectively, and after the toner image on the recording paper is fixed, the recording paper is discharged to a paper discharging tray that is not shown in the diagram.

On the other hand, the image carrier 2 after the toner image is transferred to the recording paper in the paper transferring section 7, is rotated further and toner remained on a surface of the image carrier 2 is scraped by a blade in the cleaning section 13. The image carrier 2 is then decharged by the image carrier decharging section 8. After the image carrier 2 that is decharged is charged uniformly by the charging roller 3, the image forming apparatus 1 performs the next image formation in a similar manner. The cleaning unit 13 is not restricted to the one that scrapes the toner remained on the image carrier 2 by the blade and may be a one that scrapes the toner remained on the image carrier 2 by a fur brush.

Figure 2A:
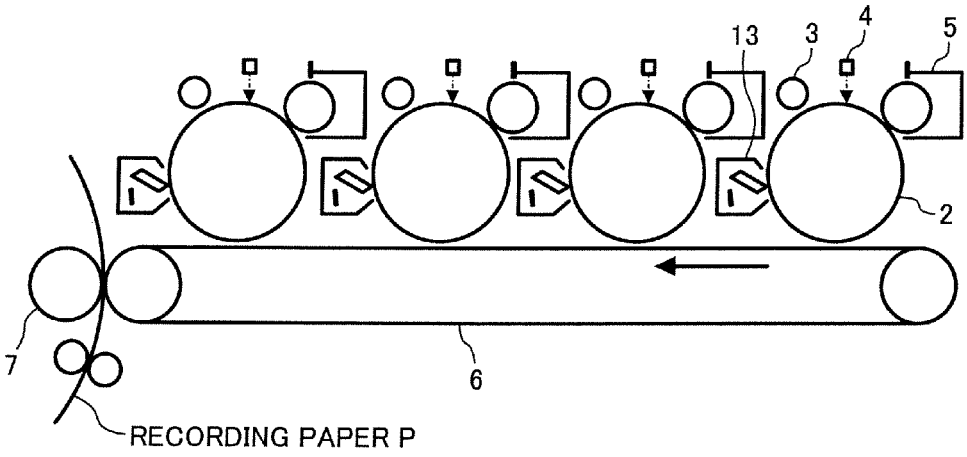
FIG. 2A is a diagram of another example of the image forming apparatus 1 according to the present invention.
Figure 2B:
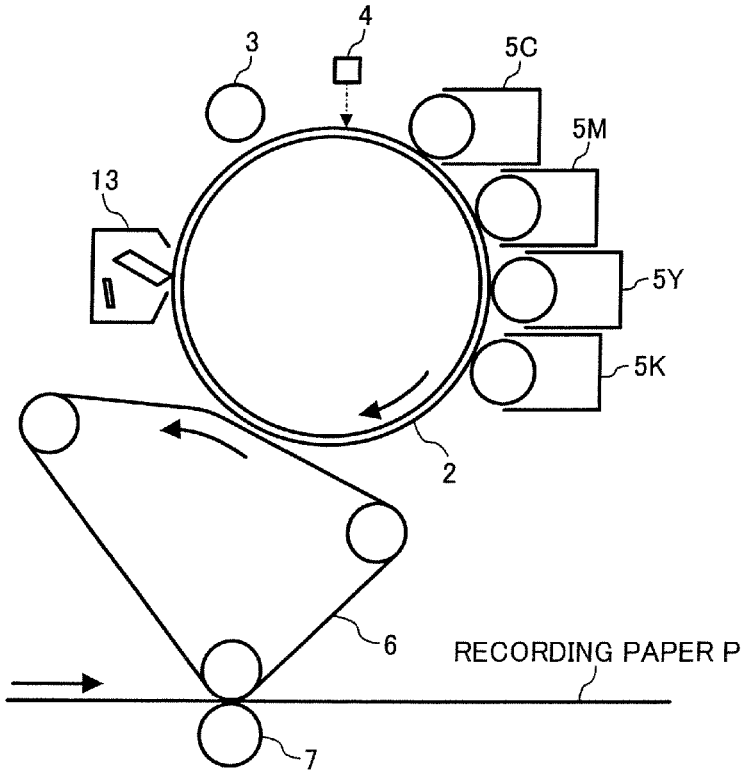
FIG. 2B is a diagram of still another example of the image forming apparatus 1 according to the present invention.

FIGS. 2A and 2B are diagrams of another example of the image forming apparatus 1 according to the present invention. FIG. 2A is a diagram of a tandem full-color image forming apparatus and FIG. 2B is diagram of a revolving-type full-color image forming apparatus.

As shown in FIG. 2A, the image forming apparatus 1 includes in a main body casing that is not shown in the diagram, the image carrier 2, which is driven and rotates in the clockwise direction in the diagram. The image forming apparatus 1 further includes the charging roller 3, the writing section 5, an intermediate transfer section 6, and the paper transferring section 7, disposed around the image carrier 2.

The image forming apparatus 1 is equipped with the paper feeding cassette that accommodates a plurality of papers, which is not shown in the diagram. The recording papers in the paper feeding cassette are fed one by one by a paper feeding roller that is not shown in the diagram, between the paper transferring section 6 and the image carrier 2 upon adjustment of timing by the pair of registering rollers that is not shown in the diagram.

The image carrier 2 is charged uniformly by the charging roller 3 and an electrostatic latent image is formed on the image carrier 2 by irradiating a laser beam that is modulated according to image data, by the writing section 4. The electrostatic latent image formed on the image carrier 2 is developed by adhering toner in the developing section 5. A toner image formed on the image carrier 2 is transferred by the intermediate transfer section 6 from the image carrier 2 to an intermediate transfer body. These steps are performed for images of four colors viz. C (cyan), M (magenta), Y (yellow), and K (black), and a color toner-image is formed.

In the revolving-type full-color image forming apparatus, by repeating the operation of the developing unit, toners of plurality of colors are developed one after another on one image carrier. The color toner-image on the intermediate transfer body is transferred to a recording paper P in the paper transferring section 7. The recording paper P with the toner image transferred is carried to the fixing section and a fixed image is achieved.

On the other hand, the image carrier 2 after the toner image is transferred to the recording paper P in the intermediate transfer section 6, is rotated further and toner remained on the surface of the image carrier 2 is scraped by the blade in the cleaning section 13. The image carrier 2 is then decharged by the image-carrier decharging section 8. After the image carrier 2 decharged is charged uniformly by the charging roller 3, the image forming apparatus 1 performs the next image formation in the similar manner. The cleaning unit 13 is not restricted to the one that scrapes the toner remained on the image carrier by the blade and may be the one that scrapes the toner remained on the image carrier 2 by the fur brush.

The charging roller 3 is a hard electroconductive roller that is disposed in a position such that there is a minute gap between the image carrier 2 and the charging roller 3.

Figure 3:
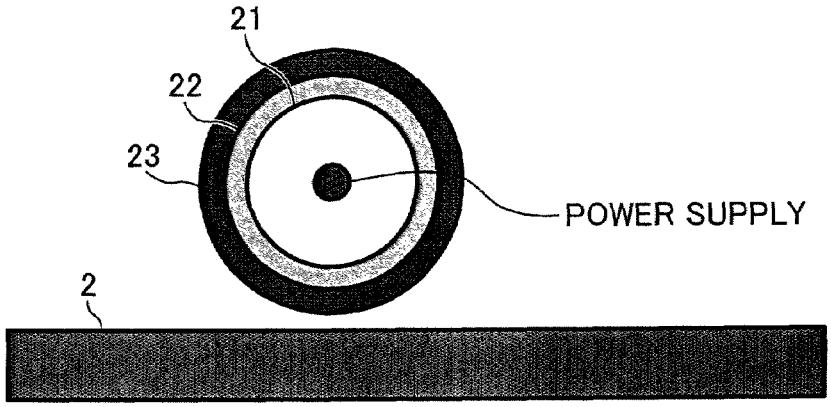
FIG. 3 is a diagram of a structure of a charging roller.

FIG. 3 is a diagram of a structure of the charging roller. The charging roller 3 includes an electroconductive substrate 21 and a resistive layer 22 around the electroconductive substrate 21. The electroconductive substrate 21 is a circular cylindrical member of stainless steel and has a diameter in a range of 8 mm to 20 mm. The electroconductive substrate 21 may be made lighter by using aluminum or an electroconductive resin having a lower efficiency not greater than 10<SUP>2</SUP> Ω·cm. The resistive layer 22 includes a high-polymer material in which an electroconductive material is kneaded with an ABS resin and on a surface of which a thin layer 23 of a fluorine-contained resin is formed. Examples of the electroconductive material are a metal ion complex, carbon black, and ionic molecules. Apart from these materials, a material that enables uniform charging may be used.

A surface of the charging roller 3 moves in a direction same as that of the surface of the image carrier 2. As a matter of course, the charging roller 3 may be let to be stationary instead of rotating together with the image carrier 2. A dimension in a longitudinal direction (axial direction) of the charging roller 3 is set to be little longer than the maximum image width A4 in a landscape orientation (approximately 290 mm). Spacers are provided on both ends in the longitudinal direction of the charging roller 3. By bringing these spacers in contact with a non-image forming area at both ends of the image carrier, a gap H between a surface of the image carrier 2 that is charged and a charging surface of the charging roller 3 is maintained such that the closest distance is in a range of 5 μm to 100 μm. It is desirable that the closest distance is set to be in a range of 30 μm to 65 μm. According to the present embodiment, the closest distance is set to 55 μm.

A power supply for charging is connected to the charging roller 3. Due to this, by a discharge in the gap H between the surface of the image carrier 2 that is charged and the charging surface of the charging roller 3, the surface to be charged is charged uniformly. A voltage waveform that has an AC voltage superimposed on a DC voltage is used as an applied voltage bias and it is desirable that peak-to-peak voltage of the AC voltage is doubled that of a voltage at a start of charging. The DC voltage, and desirably a constant-current voltage may be used according to the requirement.

Figure 4:
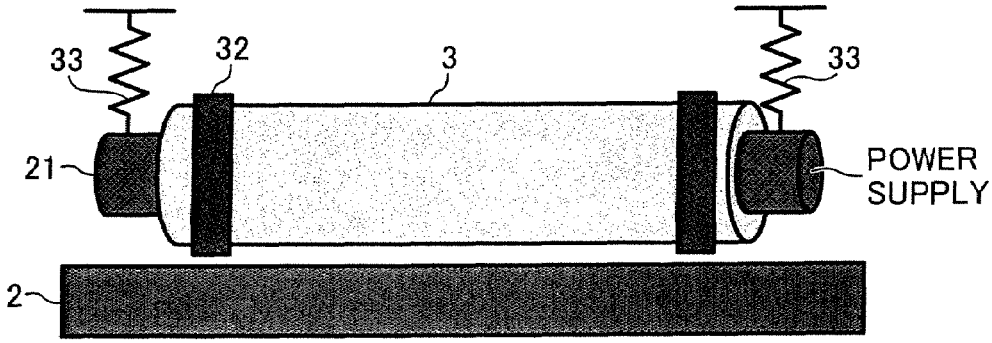
FIG. 4 is a diagram of a method of maintaining a minute gap.

FIG. 4 is a diagram of a method of maintaining a minute gap. A spacer 32 is formed by winding a film 32 on both ends of the charging roller 3. The spacer 32 is brought in contact with a photosensitive surface of the image carrier 2 so that there is a certain fixed minute gap between the charging roller 3 and an image area of the image carrier 2. An AC superimposed voltage is applied as the applied bias and by a discharge in the minute gap between the charging roller 3 and the image carrier 2, the image carrier 2 is charged. Moreover, by pressurizing a shaft by a spring 33 an accuracy of the gap maintained is improved.

A gap member may be integrated with the charging roller 3. In such a case, at least a surface of the gap is to be of an insulating material. By insulating the surface of the gap, the discharge in the gap is eliminated and a product material discharged is accumulated in the gap. Due to stickiness of the product material discharged, the toner is fixed in the gap and the gap cannot become wide.

A thermal contraction tube may be used as a gap member and this method is the most desirable one at present. An example of the thermal contract tube is SUMITUBE for 105° C. (product name: F105° C. manufactured by SUMITOMO CHEMICAL INDUSTRIES). A thickness of the SUMITUBE is 300 μm and the thermal contraction tube has a coefficient of contraction in a range of 50% to 60% which depends as well on a diameter of the charging member that is mounted. Since a thickness increases by about 0 μm to 20 μm due to the coefficient of contraction, the charging member needs to be cut to incorporate the increased portion. For example, in a case of mounting the spacer member on a charging member of ϕ12 mm, a cutting depth is let to be 350 μm and a thermal contraction tube having an inner diameter about 15 mm may be used. After the thermal contraction tube is inserted into a cut portion of the end portions of the charging member, the charging member is rotated and by performing thermal contraction uniformly while heating by a heat source of a temperature in a range of 120° C. to 130° C. from an end surface towards an inner side, the gap between the charging member and the image carrier 2 can be set to approximately 50 μm. The thermal contraction tube that is fixed by thermal fusing does not come off. However, as a preventive measure, a small amount of a liquid adhesive such as a cyanoacrylate resin (for example, ARON ALPHA and CYANO BOND, both registered trademarks) may be poured and fixed.

Figure 5:
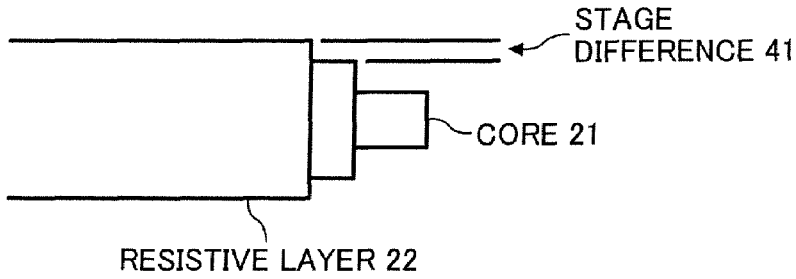
FIG. 5 is a diagram of a structure of a spacer member.
Figure 6:
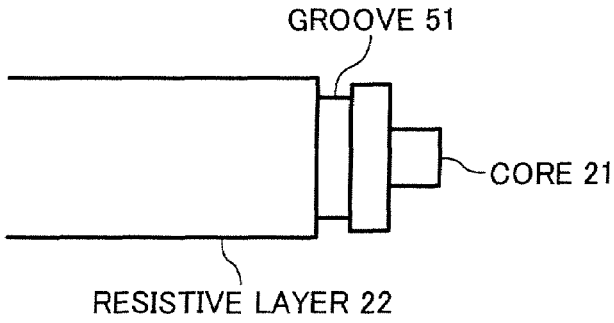
FIG. 6 is a diagram of another structure of the spacer member.
Figure 7:
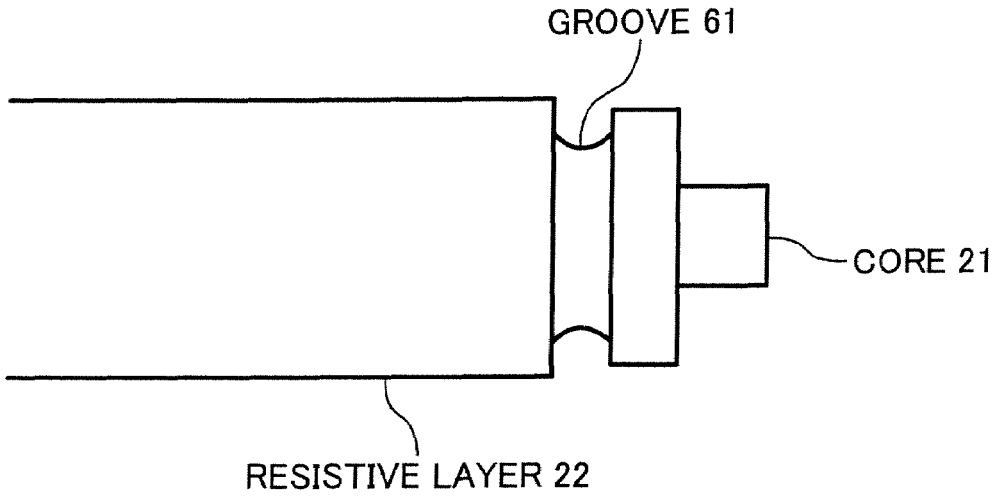
FIG. 7 is a diagram of still another structure of the spacer member.
Figure 8A:
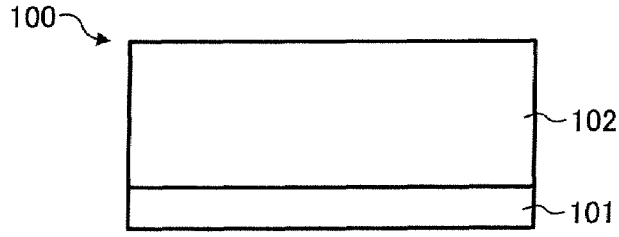
FIG. 8A is a schematic block diagram illustrating a layer structure of an amorphous silicon photosensitive drum.
Figure 8B:
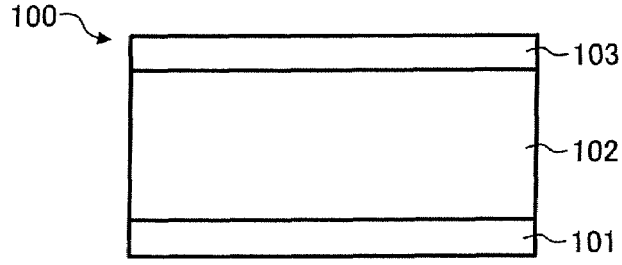
FIG. 8B is a schematic block diagram illustrating a layer structure of an amorphous silicon photosensitive drum.
Figure 8C:
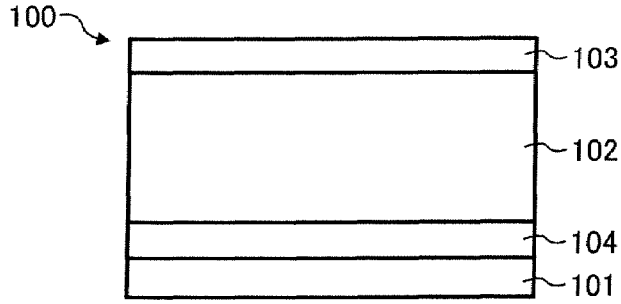
FIG. 8C is a schematic block diagram illustrating a layer structure of an amorphous silicon photosensitive drum.
Figure 8D:
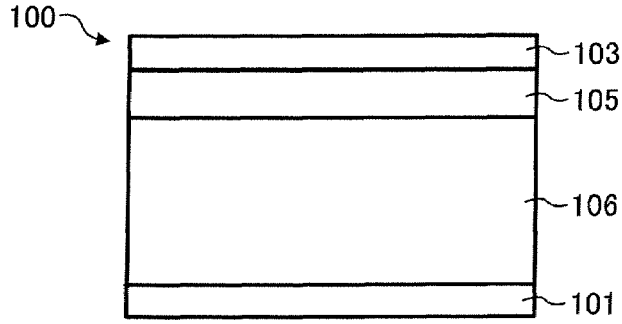
FIG. 8D is a schematic block diagram illustrating a layer structure of an amorphous silicon photosensitive drum.

FIGS. 6, 7, and 8 are diagrams of structures of the spacer member. Since the thermal contraction tube is thick, when it is to be used as the spacer member, a stage difference 41 as shown in FIG. 5 is provided and the spacer member is mounted. Or, a groove 51 is formed by leaving a part of an end portion of the resistive layer as shown in FIG. 6 and an endless spacer member in the form of a square ring that has retractility, is fitted in the groove 51. Or a round shaped groove 61 as shown in FIG. 7 is cut and a spacer member in the form of a round shaped ring (normally called as O ring) is fitted in the groove 61. It is desirable to sharpen an end portion and make it thin so that the spacer member can be inserted easily. It can be cut completely and fixed by using an adhesive. In a case of fixing the spacer member by mounting on a cut portion or on a part where the groove is formed, apart from the liquid adhesive, it is desirable to use an adhesive such as a two-part epoxy resin.

The spacer member may be let to be a roller member by inserting a roller thicker than the charging roller.

FIGS. 8A to 8D are schematic block diagrams illustrating layer-structures of an amorphous silicon photosensitive drum. The image carrier 2 shown in FIG. 8A includes a support 101 and a photoconductive layer 102 formed by a-Si: H, X provided on the support 101. The image carrier 2 shown in FIG. 8B includes the support 101, the photoconductive layer 102 formed by a-Si: H, X provided on the support 101, and an amorphous-silicon based surface layer 103. The image carrier 2 shown in FIG. 8C includes the support 101, the photoconductive layer 102 formed by a-Si: H, X provided on the support 101, an amorphous-silicon based surface layer 103, and an amorphous-silicon based charge-injection blocking layer 104. The image carrier 2 shown in FIG. 8D includes the support 101 and the photoconductive layer 102 provided on the support 101. The photoconductive layer 102 includes a charge generating layer 105 and a charge transporting layer 106 and the amorphous-silicon based surface layer 103 is provided on the photoconductive layer 102.

Resins such as a polyamide, a polyurethane, a polyester, an epoxy resin, a polyketone, a polycarbonate, a silicone resin, an acrylic resin, a polyvinyl butyral, a polyvinyl formal, a polyvinyl ketone, a polystyrene, a poly-N-vinyl carbazole, and a polyacrylamide are used as a binder resin for the image carrier 2. An amount of the binder resin to be used is in a range of 5 parts by weight to 100 parts by weight for 100 parts by weight of a charge generating substance and the desirable amount is in a range of 10 parts by weight to 50 parts by weight. An average film thickness of the charge generating layer is in a range of 0.01 μm to 2 μm and the desirable average film thickness is in a range of 0.1 μm to 1 μm.

The charge transporting layer is formed by dissolving a charge transporting substance, a binder resin, and according to the requirement a plasticizer and a leveling agent in a solvent and then applying this mixture on the charge generating layer and drying. It is desirable to use a cross-linking charge transporting material as a charge transporting substance. Concretely, examples of charge transporting substance are electron-donative substances such as poly-N-vinyl carbazole and its derivatives, poly-γ-carbazole ethylglutamate and its derivatives, pyrene-formaldehyde condensate and its derivatives, polyvinylpyrene, polyvinylphenanthrene, derivatives of oxazole, derivatives of imidazole, derivatives of triphenylamine, 9-(p-diethylaminostyrene)anthracene, 1,1-bis(4-dibenzylaminophenyl)propane, styrylanthracene, styrylpyrazoline, phenylhydrazones, and derivatives of α-stilbene.

Any of an organic filler and an inorganic filler may be used as a filler to be included in the surface layer. However, in particular, inorganic filler is used desirably. Examples of the organic filler material are powders such as powder of a fluorine-contained resin such as polytetrafluoroethylene, powder of a silicone resin, and powder of a-carbon. Examples of the inorganic filler material are metal oxides such as silica, tin oxide, zinc oxide, titanium oxide, alumina, zirconium oxide, indium oxide, antimony oxide, bismuth oxide, calcium oxide, tin oxide having antimony doped in it, and indium oxide having tin doped in it, metal fluorides such as tin fluoride, calcium fluoride, and aluminum fluoride, and potassium titanate, and boron nitride. These fillers may be used independently or upon mixing. Moreover, to improve dispersibility, a surface treatment may be performed by using these fillers as a surface treatment agent.

Figure 9:
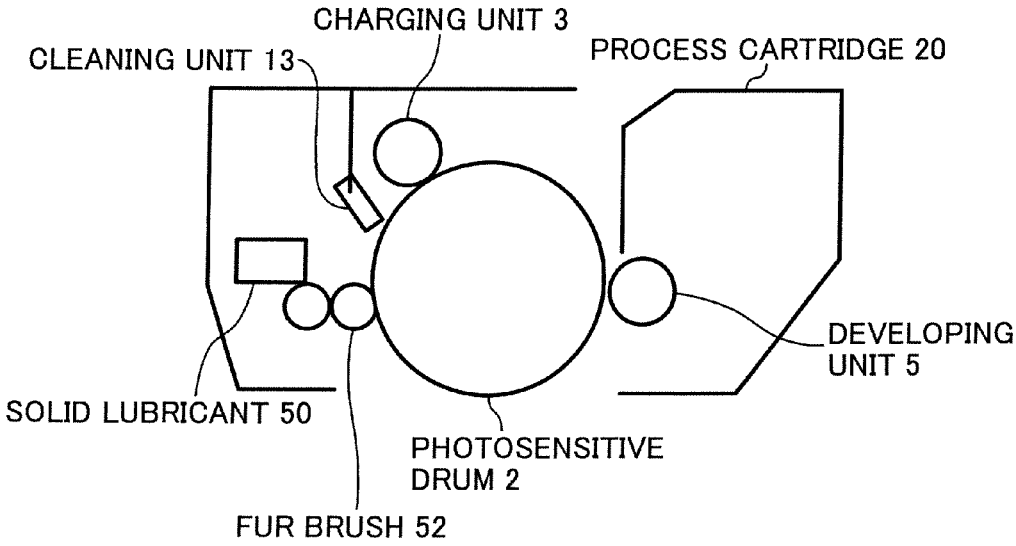
FIG. 9 is schematic diagram of an image forming apparatus that includes a process cartridge according to the present invention.

FIG. 9 is a schematic diagram of an image forming apparatus that includes a process cartridge according to the present invention. As shown in FIG. 9, a reference numeral 20 denotes an overall process cartridge, a reference numeral 2 denotes a photosensitive drum, a reference numeral 3 denotes a charging unit, a reference numeral 5 denotes a developing unit, a reference numeral 13 denotes a cleaning unit, a reference numeral 50 denotes a solid lubricant, and a reference numeral 52 denotes a fur brush. A plurality of components from among the photosensitive drum 2, the charging unit 3, the developing unit 5, the cleaning unit 13, the solid lubricant 50, and the fur brush 52 are combined integrally to form the process cartridge, which is detachable from the image forming apparatus such as a copying machine and a printer.

Figure 10:
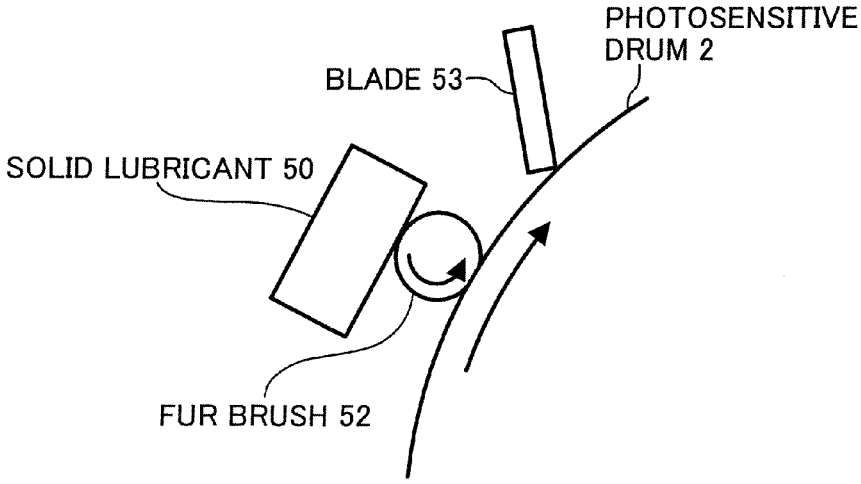
FIG. 10 is a diagram of a structure of a lubricant applying unit according to a first embodiment of the present invention.

FIG. 10 is a diagram of a structure of a lubricant applying unit according to a first embodiment of the present invention. The solid lubricant 50 is applied on the photosensitive drum 2 via the fur brush 52 that rotates. The fur brush 52 is in contact with the solid lubricant 50 and rotates, thereby scraping away a part of the solid lubricant 50. The solid lubricant 50 that is scraped away gets adhered to the fur brush 52, is rotated and applied on the photosensitive drum 2. The lubricant that is applied on the photosensitive drum 2 is spread uniformly by an elastic blade 53. Here, the fur brush 52 can be allowed to function as a fur brush for cleaning and a blade 53 can be allowed to function as a blade for cleaning.

A metal salt of a high fatty acid such as zinc stearate, which is a typical example, can be used as the solid lubricant 50. Zinc stearate is a typical example of a lamella-crystal powder and such a substance is suitable to be used as a lubricant. Lamella crystals have a layered structure in which amphipathic molecules are self-organized and when shearing force is exerted, the crystals break along a boundary between the layers and become slippery. This behavior is effective for lowering the coefficient of friction. Thus, it is a peculiarity of the lamella crystals to cover uniformly the surface of the photosensitive drum when the shearing force is exerted. This peculiarity enables the surface of the photosensitive drum 2 to be covered effectively by a small amount of the lubricant.

For the metal salt of the high fatty acid, a linear hydrocarbon is desirable as a fatty acid. Acids such as myristic acid, palmitic acid, stearic acid, and oleic acid are desirable, and stearic acid is even more desirable. Examples of metals are lithium, magnesium, calcium, strontium, zinc, cadmium, aluminum, cerium, titanium, and iron. From among these, zinc stearate, magnesium stearate, aluminum stearate, iron stearate, and calcium stearate are desirable, and zinc stearate is particularly desirable.

The lubricant on the photosensitive drum 2 tends to break along the boundary of the layers and forms a thin layer by cleavage. However, this thin layer need not cover uniformly the overall photosensitive drum 2. Even by forming a thin layer of zinc stearate partly on the photosensitive drum 2, the load exerted on the cleaning blade in the cleaning unit 13 is reduced and the cleaning efficiency can be improved or maintained. This is because, by forming the thin layer partly, even if there is a portion where the thin layer is not formed, a stick-slip condition of the cleaning blade can be maintained and this enables cleaning even with a toner that has a degree of circular shape not less than 0.96. The portion on the photosensitive drum 2 where the thin film is formed can prevent a large decline in a transfer ratio as there is a decrease in adhesion with the toner. Regarding the degree of circular shape, in a case of toner that is manufactured by dry pulverization, a sphering treatment is performed thermally or mechanically after pulverizing. A thermal sphering treatment can be performed by spraying toner particles together with hot air current on an atomizer. As a mechanical spherical treatment, toner particles are put in a mixer such as a ball mill together with a mixing medium such as glass having a low specific gravity, and stirred. This enables to control the degree of circular shape. However, in the thermal sphering treatment, toner particles of big size are formed due to coagulation and in the mechanical sphering treatment, fine particles are formed. Therefore, it is necessary to perform a classifying process once again. Moreover, in a case of toner that is manufactured in an aqueous solvent, it is stirred strongly at a step of removing the solvent. By stirring strongly, it is possible to control the degree of circular shape during a period from the spherical shape to an elliptical shape.

Furthermore, it is desirable that the thin film of the zinc stearate is formed uniformly all over the photosensitive drum 2. This enables to improve the cleaning efficiency and to ensure a transferability that maintains the transfer rate and an image quality during the transfer.

The thin film of the zinc stearate is sufficient if it is formed before the image formation. This is because, even if the zinc stearate is applied on the photosensitive drum 2 before an operation of the image formation and is spread uniformly by the blade 53 which is a spreading member, a uniform thin film is not formed and sometimes a thin film portion more than 12 nm thick exists on a part of the photosensitive drum 2. Even if this thin film having thickness greater than 12 nm is there, there is no practical effect else where for a short period of time. However, to bring it in a suitable range, the photosensitive drum 2 is rotated for predetermined number of times before the image formation, and by spreading the zinc stearate by the spreading member i.e. the blade 53, it is desirable to perform the operation of the image formation after the thin film of zinc stearate is let to be 8 nm to 12 nm thick.

Figure 11:
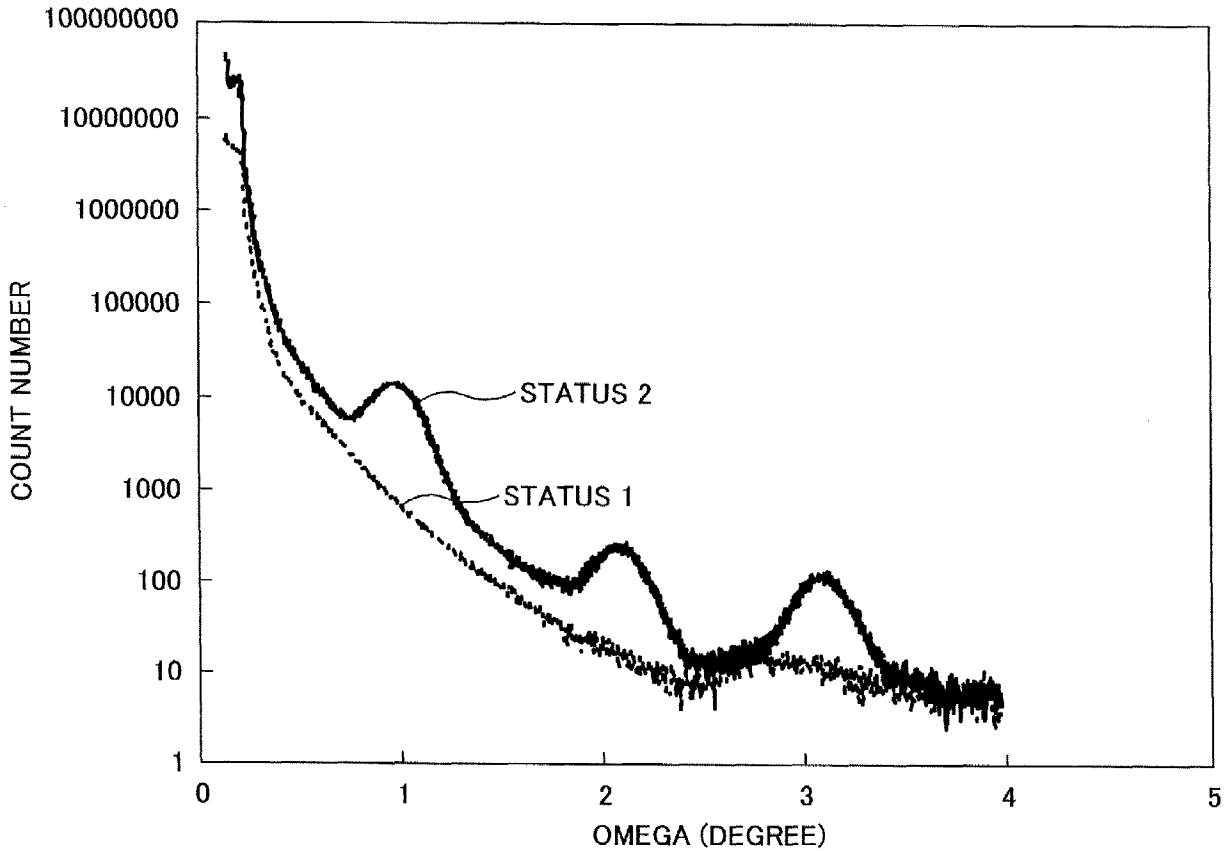
FIG. 11 is a graph of results of measurement of X-ray reflectance.

The application of the lubricant was evaluated by a method of X-ray reflectance analysis in which the thickness of the film is calculated by Parratt simulation from X-ray reflectance for an angle of incidence of X-ray. Parratt simulation is a method of calculating the X-ray reflectance from a thin-film layered body and is described in detail in Phys. Rev. 95. 359 (1954). FIG. 11 is a graph of results of measurement of X-ray reflectance. The film-thickness can be calculated by analyzing the graph in FIG. 11 according to Parratt simulation. Status 1 shown in FIG. 11 is an X-ray reflectance when zinc stearate is applied on the photosensitive drum 2 by the fur brush 52 and status 2 is an X-ray reflectance when the zinc stearate on the photosensitive drum 2 is spread uniformly by the blade 53, which is a spreading member. As it is evident from this, the reflectance is more at a specific angle, and the film-thickness of the zinc stearate can be calculated from this angle.

Changes in the film-thickness of zinc stearate according to applying conditions when the zinc stearate is applied on the photosensitive drum 2, and changes in an amount of scraping of film on the photosensitive drum are shown in table 1. From these experiment results, the film-thickness of zinc stearate varies according to a frequency of passing of the fur brush or the blade, and it is evident from the results that the amount of scraping of the film on the photosensitive drum changes.

Conditions for Applying Zinc Stearate

Applicator: IPSiO color 8000 modified stage movable lubricant applying unit

Fur brush: dent created on surface of the photosensitive drum=1 mm

Blade: made of urethane, hardness=70

Sample: having a 4 μm thick photosensitive layer created on a glass plate according to dipping method Traveling speed of stage (equivalent to a traveling speed of the surface of the photosensitive drum in the real machine) =125 mm/s Conditions for Evaluation of Film-Thickness of Zinc Stearate Evaluation was performed by the method of X-ray reflectance analysis in which the thickness of the film is calculated by Parratt simulation from the X-ray reflectance. Conditions for the evaluation are as follows.

Measuring apparatus: X' pert MRD manufactured by PHILIPS ANALYTICAL

Measuring range: glancing angle=0.15 degree to 4 degrees

X-ray generator: Cu target, voltage and current conditions=45 kV, 40 mA

Method of Analysis: Parratt Simulation

Conditions for evaluating the amount of scraping of the film Measuring apparatus: IPSiO color 8000 modified simple testing machine Conditions for applying zinc stearate: The conditions mentioned above for the fur brush, blade, and the photosensitive drum are to be followed.

Apparatus for measuring thickness of the film on the photosensitive drum: FISCHERSCOPE MMS manufactured by FISCHER INSTRUMENTS INC.

Running time: 10 hours

TABLE 1

| Example & example for comparison | Linear velocity of brush (mm/s) | Linear load of blade (g/cm) | Film thickness of lubricant | Scraping of photo-sensitive drum |
|---|---|---|---|---|
| Example 1 | 50 | 25 | 8.8 | Yes |
| Example 2 | 150 | 25 | 8.3 | Yes |
| Example 3 | 450 | 25 | 9.9 | Yes |
| Example 1 for comparison | 20 | Not used | No film formed | No |
| Example 2 for comparison | 20 | 25 | No film formed | No |
| Example 3 for comparison | 10 | 40 | 4.1 | No |
| Example 4 for comparison | 30 | 25 | 4.0 | OK |

Table 1 is a table of results showing relationship between the conditions for applying the lubricant and the cleaning efficiency (lubricating ability). According to table 1, as in examples 1 to 3, when the film-thickness of the lubricant is in a range of 8 nm to 12 nm, it was confirmed that the scraping of the photosensitive drum is suppressed. Here, if a length of a molecular chain of zinc stearate is considered to be 5 nm, an ideal condition in table 1, i.e. the film-thickness of the lubricant layer is approximately 10 nm, indicates that molecules are located on the photosensitive drum 2 and sufficient effect is achieved when two layers are piled up. In other words, these results indicate that zinc stearate renders sufficient lubricating ability by a shift between two molecular layers. Other metal salts of fatty acids such as magnesium stearate and calcium stearate also show a similar property and the length of the molecular chain being almost the same, a sufficient lubricating effect is shown in a range of the film-thickness from 8 nm to 12 nm.

Moreover, it has been revealed that by applying the solid lubricant, apart from the effect as a lubricant, an effect as a protective substance that tempers deterioration of the photosensitive drum due to charging is achieved. Particularly, while using a method of charging the photosensitive drum by causing a discharge in a proximity space between the photosensitive drum and the charging member that is in proximity with the photosensitive drum as shown in FIG. 3 or in contact with the photosensitive drum, since the surface of the photosensitive drum tends to deteriorate, the solid lubricant is quite effective as a protective substance. In such a method of charging, when a voltage in which an AC component is superimposed on a DC component is applied and when a metal salt of a fatty acid is used as a lubricant, if the lubricant is applied on the photosensitive drum such that a proportion (%) of a metal element included in the metal salt of a fatty acid that is on a surface of the body subjected to charging in a discharge area measured by XPS is not less than 1.5×10<SUP>−4</SUP>×{Vpp−2×Vth}×f/v (%), (where Vpp is an amplitude [V] of the AC component that is applied on the charging member, f is a frequency [Hz] of the AC component that is applied on the charging member, Gp is the shortest distance [μm] between the surface of the charging member and the surface of the body subjected to charging, v is a traveling velocity [mm/sec] of the surface subjected to charging that faces the charging member, and Vth is a starting voltage. Moreover, when the lubricant is applied on the photosensitive drum such that the value of Vth is $312+6.2\times(d/\epsilon opc+Gp/\epsilon air)+\sqrt{(7737.6\times d/\epsilon)}$, where d is a film-thickness [μm] of the body subjected to charging, ϵopc is a specific inductive capacity of the body subjected to charging, ϵair is a specific inductive capacity in a space between the body subjected to charging and the charging member) it has been revealed that the lubricant functions sufficiently as a protective substance. In examples 1 to 3 in table 1, the proportion of element mentioned above has been confirmed to have been satisfied.

Moreover, in cases of examples 1 to 3 in table 1, it was confirmed that there is an improvement in the cleaning efficiency as well and the lubricant is effective for cleaning the spherical toner.

Figure 12:
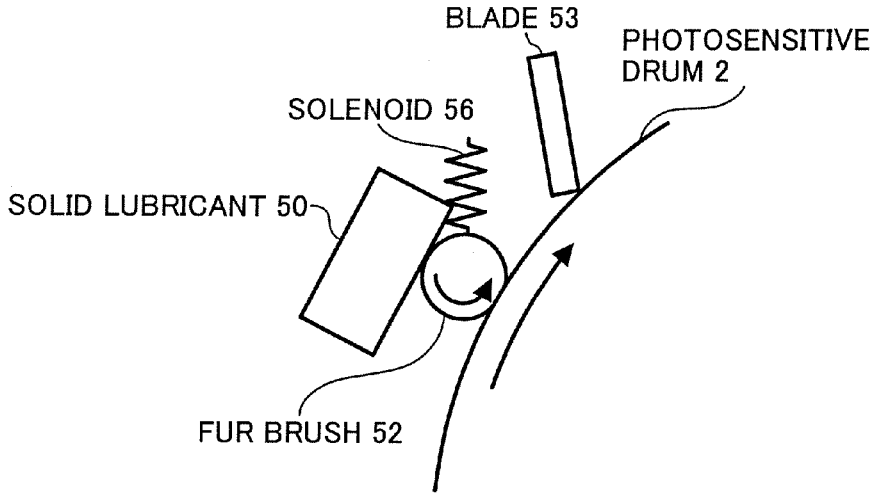
FIG. 12 is a diagram of a structure of a lubricant applying unit according to a second embodiment of the present invention.

FIG. 12 is a diagram of a structure of a lubricant applying unit according to a second embodiment of the present invention. In this lubricant applying unit, the fur brush 52 that is in contact with the photosensitive drum 2 has a mechanism in which a solenoid 56 is used. The solenoid 56 enables the fur brush 52 to make contact with and to be separated from the photosensitive drum 2, or to control the amount of the lubricant to be applied on the photosensitive drum 2 by changing the number of revolutions. By using the lubricant applying unit as shown in FIG. 10, the present invention can be executed by using the method of lubricant application in which once the lubricant is supplied to the photosensitive drum 2 by the fur brush 52, it is spread uniformly for a plurality of times by the blade 53. According to the present invention, the total amount of the lubricant supplied to the photosensitive drum 2 is reduced and a function of a lubricant is fulfilled sufficiently.

Similarly, a structure in which the blade 53 that is a spreading member can make contact and be separated from the photosensitive drum 2 can be used. This is useful for preventing turning over of the blade 53 when the sufficient amount of lubricant is not supplied to the photosensitive drum 2. A structure in which both of the fur brush 52 and the blade 53 are combined can also be used.

Figure 13:
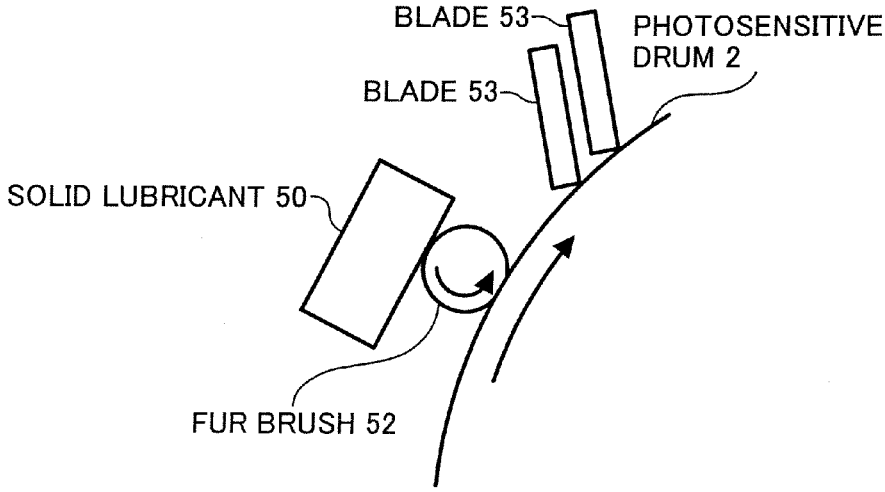
FIG. 13 is a diagram of a structure of a lubricant applying unit, according to a third embodiment of the present invention, which includes a plurality of blades installed.

According to the present invention, the applying member and the spreading member are not restricted to be the same. FIG. 13 is a diagram of a structure of a lubricant applying unit, according to a third embodiment of the present invention, which includes a plurality of blades installed. By installing the plurality of spreading members in such a manner, a speed of forming the film on the photosensitive drum 2 can be accelerated and a predetermined film-thickness can be achieved promptly.

Figure 14:
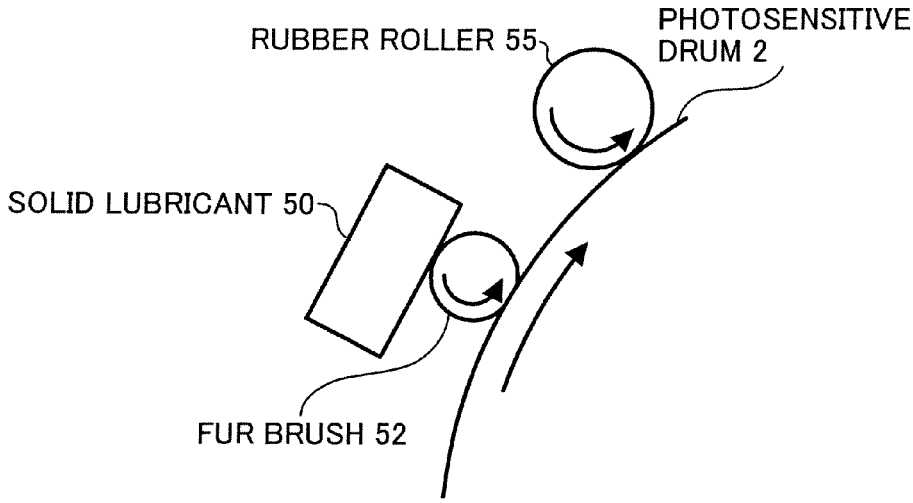
FIG. 14 is a diagram of a structure of a lubricant applying unit, according to a fourth embodiment of the present invention, which includes a rubber roller used as a spreading member.

According to the present invention, the spreading member is not restricted to the blade. FIG. 14 is a diagram of a structure of a lubricant applying unit, according to a fourth embodiment of the present invention, which includes a rubber roller 55 used as a spreading member. The material of the rubber roller 55 may be a resin such as urethane rubber and is not restricted to any particular material.

Figure 15:
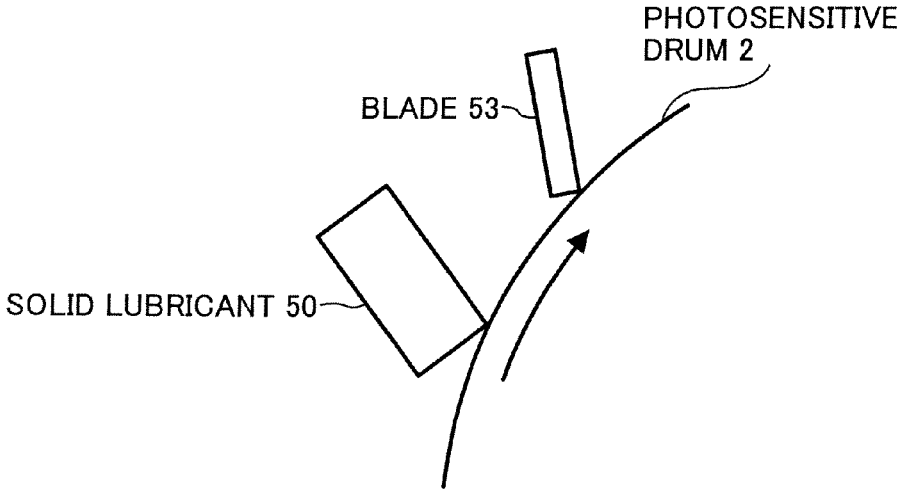
FIG. 15 is a diagram of a structure of a lubricant applying unit, according to a fifth embodiment of the present invention, in which a solid lubricant is allowed to be in a direct contact with a photosensitive drum.

FIG. 15 is a diagram of a structure of a lubricant applying unit, according to a fifth embodiment of the present invention, in which the solid lubricant is allowed to be in a direct contact with the photosensitive drum. In other words, a solid lubricant 50 also serves as the applying member. The present invention can be executed with such a structure as well. There is a reduction in the number of components and the manufacturing cost.

An intermediate transfer belt or an intermediate transfer drum can be used as a spreading member. In FIG. 2, the lubricant that is supplied to the image carrier 2 from the fur brush 52, which is an applying member, is spread by the intermediate transfer belt 6 and a predetermined film-thickness of the lubricant layer can be achieved. The sixth embodiment as well leads to the reduction in the number of components and the manufacturing cost.

Figure 16:
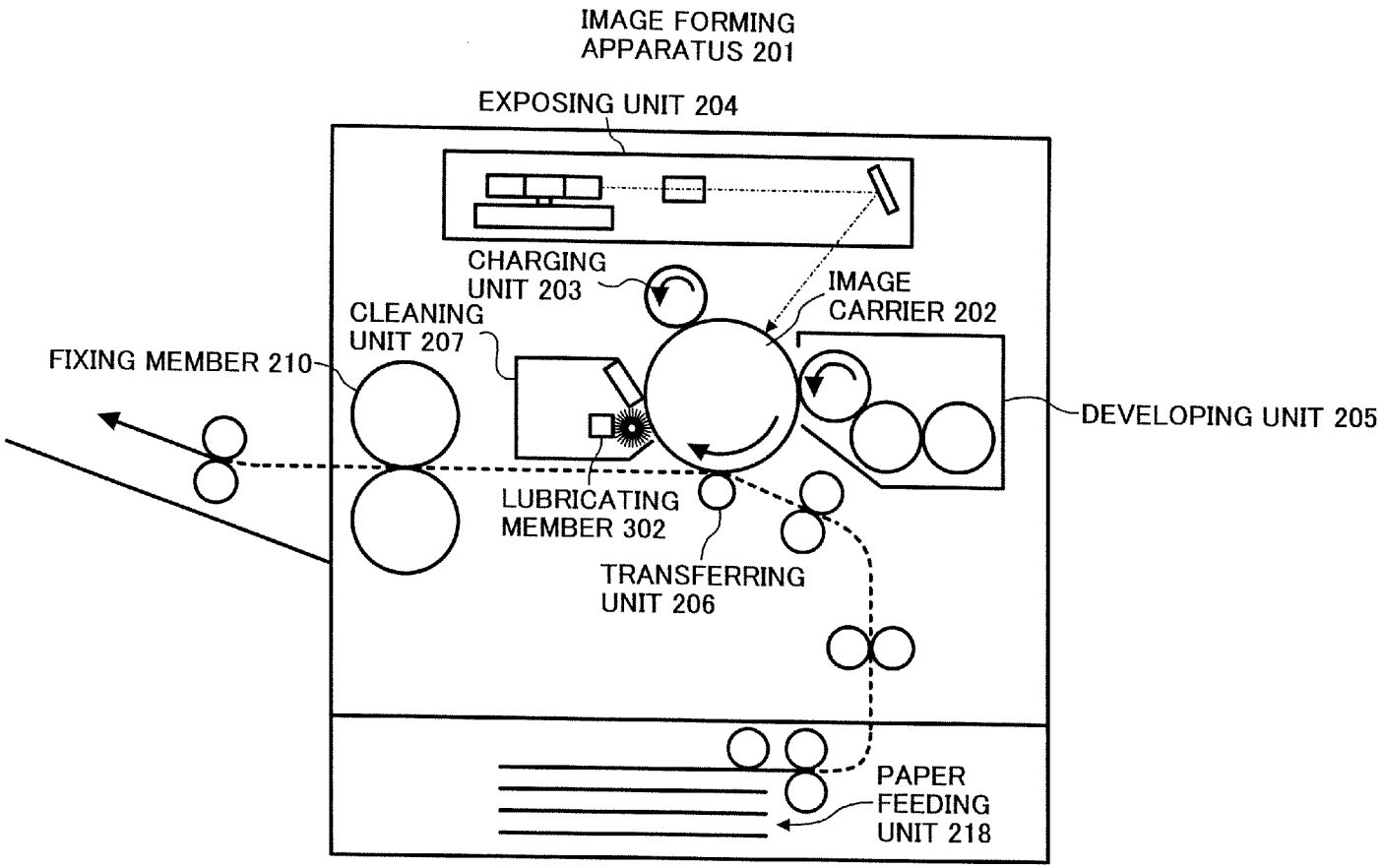
FIG. 16 is a schematic diagram of an image forming apparatus for performing an image forming method according to a sixth embodiment of the present invention.

FIG. 16 is a schematic diagram (cross-sectional view) of an image forming apparatus according to a sixth embodiment of the present invention. An image forming apparatus 201 includes an image carrier 202. The image carrier 202 is in the form of a drum that has a photosensitive layer on an outer peripheral surface of a conductive base in the form of a circular cylinder. An image carrier in the form of an endless belt that is stretched around a plurality of rollers and driven to rotate, can be used as the image carrier 202.

The image carrier 202 shown in FIG. 16 is driven and rotates in a clockwise direction during the operation of the image forming apparatus. As the image carrier 202 rotates, it is charged to a predetermined polarity by a charging unit 203. In FIG. 16, a non-contact charging roller is used. However, the charging unit 203 is not restricted to the non-contact charging roller, and a contact charging roller may be used.

A light-modulated laser beam emerged from an exposing unit 204 is irradiated on the image carrier 202 that is charged by the charging unit and an electrostatic latent image is formed on the image carrier 202. In an example shown in the diagram, an absolute value of electric potential of a surface portion of the image carrier 202 on which the laser beam is irradiated decreases and becomes the electrostatic latent image (image portion) and a portion where the laser beam is not irradiated and the absolute value of electric potential is maintained to be high becomes a base surface. When this electrostatic latent image passes by a developing unit 205, it becomes a visualized image as a toner image by toner that is charged to a predetermined polarity. An exposing unit that includes an LED array or an exposing unit that forms on the image carrier an image on a document by illuminating a surface of the document can be used.

On the other hand, a transfer material such as a transfer paper (recording paper) is fed from a paper feeding unit 218 and the transfer material is fed between the image carrier 202 and a transferring unit 206 that faces the image carrier 202 at a predetermined timing. At this time, a toner image formed on the image carrier 202 is transferred electrostatically to the transfer material. The transfer material with the toner image transferred to it passes through a fixing unit 210 and the toner image is fixed on the transfer material due to effect of heat and pressure while passing through the fixing unit 210. The transfer material that has passed through the fixing unit 210 is discharged to a paper discharging section. Toner remained on the surface of the image carrier 202 without being transferred to the transfer material is removed by a cleaning unit 207.

The fixing unit 210 in the diagram is shown as a structure that includes two rollers. However, other structure, such as that including a belt and a roller may be used as well.

The developing unit 205 shown in FIG. 16 includes a developer case that accommodates a dry developer and a developing roller that holds and carries the developer. A dry developer that includes a toner and a carrier or a one-component developer that does not include a carrier can be used. Moreover, a developing unit that uses a liquid developer can be used as the developing unit 205. The developing roller is driven and rotates in a direction shown by an arrow. When the developing roller rotates, the developer is held and carried on a peripheral surface of the developing roller and toner in the developer that is carried to a developing area between the developing roller and the image carrier 202 is transferred electrostatically to the electrostatic latent image. Thus, the electrostatic latent image is visualized as a toner image. The transferring unit 206 shown in FIG. 16 includes a transfer roller on which a transfer voltage of a polarity opposite to a charging polarity of the toner on the image carrier 202 is applied. However, a transferring unit that includes a corona discharger that includes a corona wire or a transfer brush and a transfer blade can be used.

Instead of transferring the toner image on the image carrier 202 immediately to a transfer material as a final recording medium, the structure can be made such that the toner image on the image carrier 202 is transferred to a transfer material that is an intermediate transfer body and then the toner image is transferred to the final recording medium.

The cleaning unit 207 shown in FIG. 16 includes a cleaning member that is a fur brush 207-1, which is rotatably supported by a cleaning case. The cleaning member is brought in contact with the surface of the image carrier 202 and the toner adhered and remained after transferring the image is cleaned.

Figure 17:
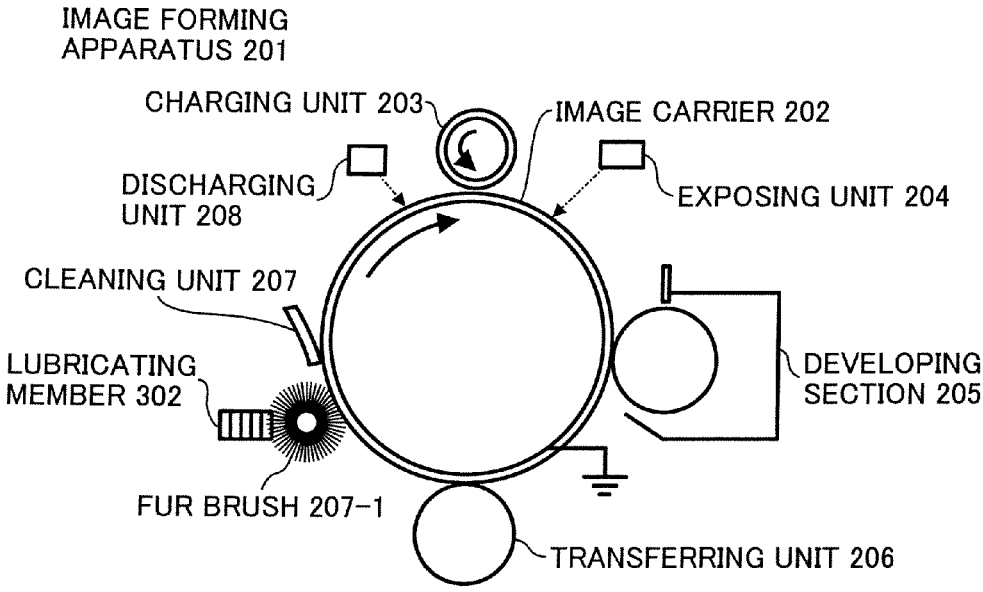
FIG. 17 is a diagram of a structure of an image forming apparatus 201 according to the present invention.

A known material such as polyurethane rubber, silicone rubber, nitrile rubber, and chloroprene rubber can be selected appropriately and used by setting a modulus of elasticity, a thickness, and an angle of contact with the image carrier 202, as a cleaning blade, which is a cleaning unit 207. It is not shown in FIG. 16, but a charge remained on the image carrier 202 can be decharged by using a decharging unit 208 as shown in FIG. 17.

It is desirable that an average degree of circular shape of a toner according to the present invention is in a range of 0.93 to 1.00. If the average degree of circular shape is less than 0.93, the toner takes a shape that is different from the spherical shape and dot reproduction is deteriorated. Moreover, due to an increase in points of contact with a photosensitive drum as an image carrier, release ability is deteriorated and a transfer ratio is declined.

If the average degree of circular shape of the toner is higher than 0.93, the toner has a projection shape close to a circle, and an excellent dot reproduction and high transfer ratio can be achieved.

The average degree of circular shape of a toner is a value obtained by detecting the particles optically and dividing by a peripheral length of an equivalent circle that is equal to a projected area. Concretely, the measurement is carried out by using an automated particle shape and size analyzer (FPIA-2000 manufactured by SYSMAX CORPORATION). Water (100 mL to 150 mL) with solid impurities removed from it in advance is put and 0.1 mL to 0.5 mL of a surface active agent is added to it as a dispersing agent. Further, about 0.1 g to 9.5 g of a test portion is added to this mixture. A suspension in which the test portion is dispersed is subjected to dispersion for approximately 1 min to 3 min in an ultrasonic distributor and concentration of a dispersed liquid is let to be in a range of 3000/μL to 10000/μL. The shape and the distribution of the toner are measured.

A lubricating member 302 is supplied appropriately to the image carrier 202 by the fur brush 207-1. Normally, the lubricating member 302 is supplied continuously. However, the lubricating member 302 may be supplied indirectly by including a cam and an electromagnetic clutch in the structure to bring closer and to separate the lubricating member 302 to and from the fur brush 207-1. Moreover, the control may be such that the lubricating member 302 is supplied only when required by monitoring a torque of the image carrier 202, a current of a drive motor, and a reflectance of the image carrier 202.

Figure 18:
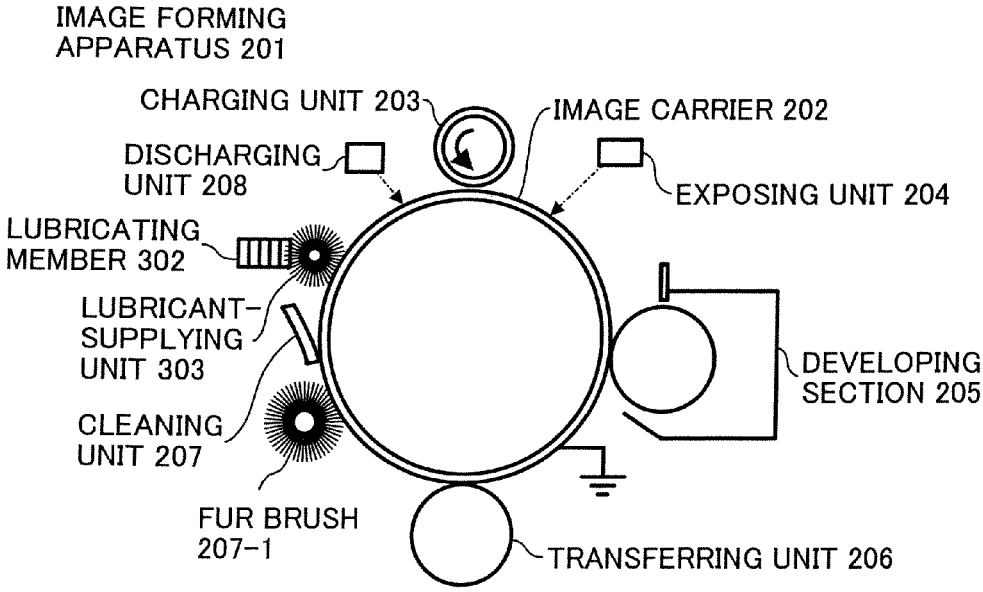
FIG. 18 is a diagram of a structure of an image forming apparatus 201 according to the present invention.
Figure 19:
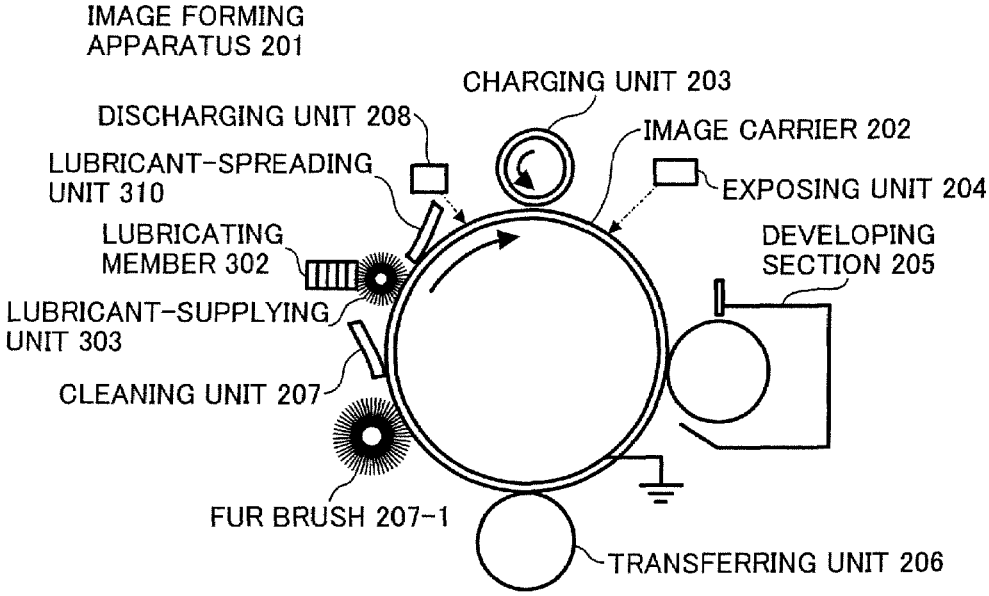
FIG. 19 is a diagram of a structure of an image forming apparatus 201 according to the present invention.

Moreover, the image forming apparatus 201 may be structured such that, as shown in FIG. 18, the lubricating member 302 is supplied to the image carrier 202 by using a lubricant applying unit 303 that is different from the fur brush 207-1. Furthermore, the image forming apparatus may be structured such that, as shown in FIG. 19, after the lubricating member 302 is supplied to the image carrier 202, a thin film of the lubricant is formed on the image carrier 202 by using a lubricant spreading unit 310.

It is desirable to allow the lubricating member 302 to be in contact with a rotating brush or a rotating roller that is in contact with the image carrier 202 and to supply the lubricant to the image carrier 202 via the rotating brush or the rotating roller. However, from the point of view of reduction in size and cost, the lubricant may be supplied by bringing in direct contact with the image carrier 202.

According to the present invention, the rotating brush is used in the lubricant applying unit 303. However, it is not restricted to the rotating brush and a rotating roller or other member may be used.

A metal salt of fatty acid can be used as a lubricant to be supplied and according to the mode of supplying to the image carrier 202 the lubricant can be formed in a powder form or a solid form for use. It is desirable to use the lubricant in solid form to eliminate a problem of dispersal. Metals such as zinc, lithium, sodium, calcium, magnesium, aluminum, lead, and nickel are examples of metal elements in the metal salt of a fatty acid. Examples of a fatty acid in the metal salts of a fatty acid are stearic acid, lauric acid, and palmitic acid. Among the metal salts of fatty acids, zinc stearate is desirable while using as a solid prismatic shape and calcium stearate is desirable while using as a spherical shape.

FIGS. 17 to 23 are diagrams of structures of an image forming apparatus when a lubricant-supply mode is executed. However, the lubricant-supply mode is applicable for cases other than those mentioned in these diagrams.

A structure in FIG. 17 is the most simplified structure and is used in image forming apparatuses that are available in the market at present. In this structure, the lubricant is applied by allowing the lubricating medium 302 to be in contact with the fur brush 207-1 that is for cleaning the toner remained on the image carrier 202 after transfer. In addition, the cleaning unit 207 that is a cleaning blade to remove toner that could not be removed completely by the fur brush 207-1 is provided on a downstream side in a direction of rotation of the image carrier 202. The cleaning blade removes the toner remained and also performs a function of applying the lubricant while forming a thin film.

The structure in FIG. 18 has a separate lubricant applying unit 303 in addition to the structure in FIG. 17. With such a structure, by applying the lubricant after removing the toner, the lubricant can be applied easily.

The structure in FIG. 19 has a lubricant spreading unit 310 added to the structure in FIG. 18. With such a structure, the lubricant can be applied easily.

Figure 20:
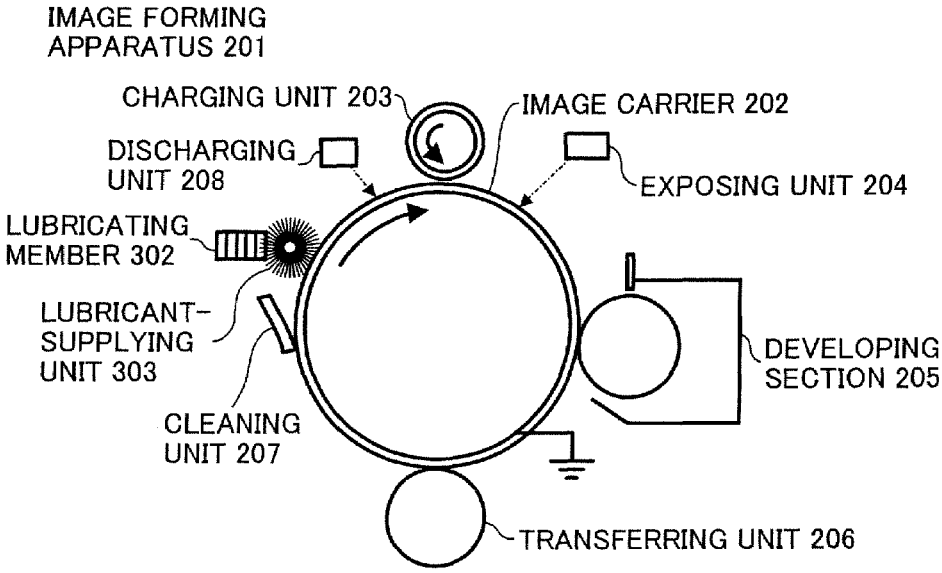
FIG. 20 is a diagram of a structure of an image forming apparatus 201 according to the present invention.

The structure in FIG. 20 is the same as a structure in FIG. 18 without the fur brush 207-1. Although there is a decline in the removing ability of toner remained after the image transfer, the cleaning efficiency is of sufficiently usable level.

Figure 21:
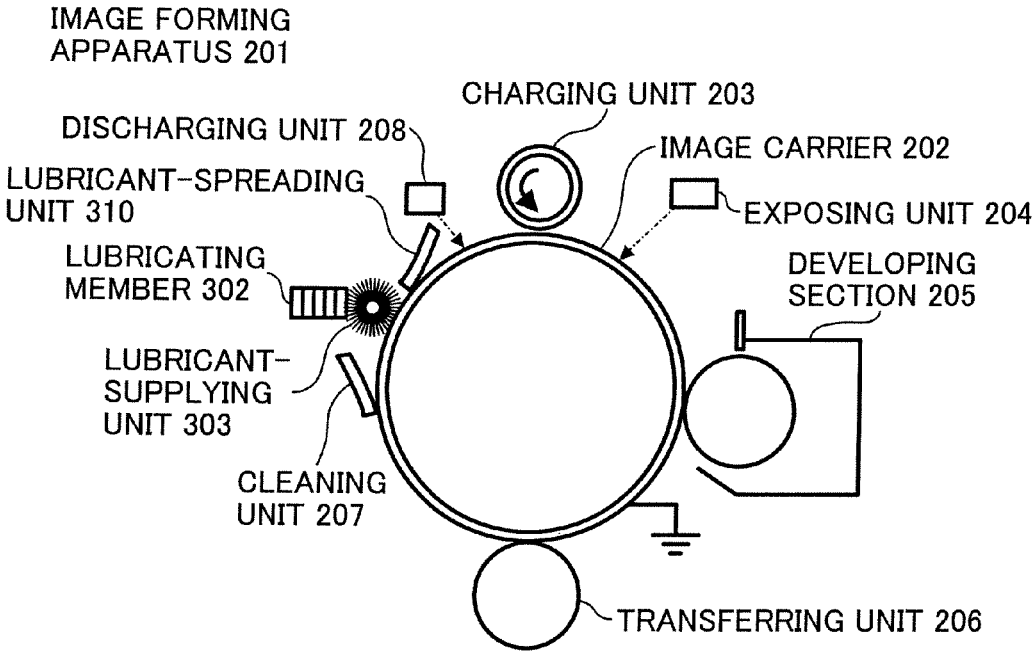
FIG. 21 is a diagram of a structure of an image forming apparatus 201 according to the present invention.

The structure in FIG. 21 is the same as a structure in FIG. 19 without the fur brush 207-1. Although there is a decline in the removing ability of toner remained after the image transfer, the cleaning efficiency is of sufficiently usable level.

Figure 22:
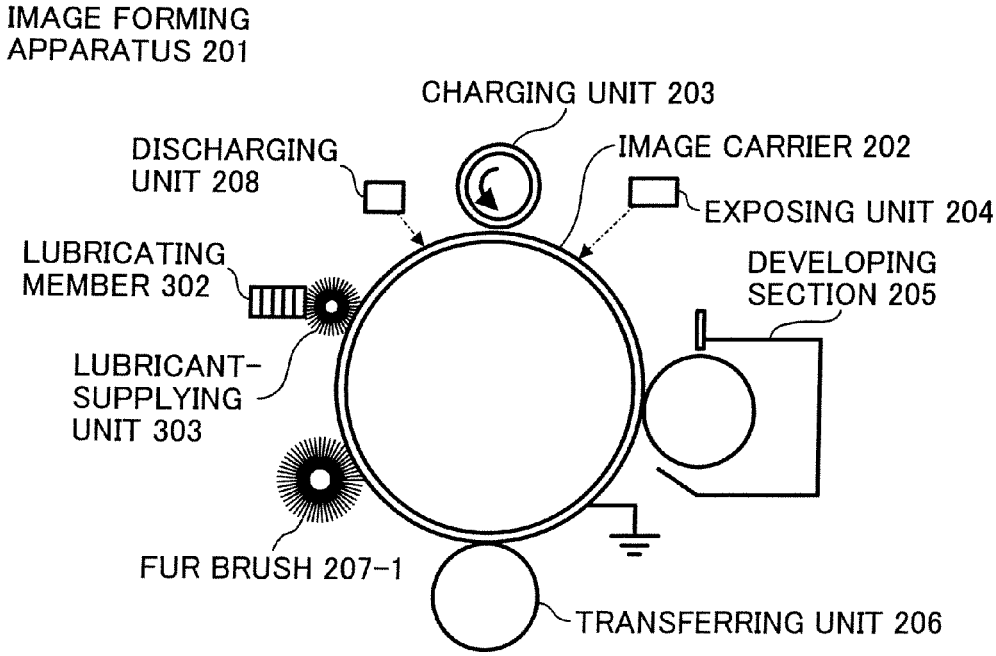
FIG. 22 is a diagram of a structure of an image forming apparatus 201 according to the present invention.

The structure in FIG. 22 is the same as a structure in FIG. 18 without the cleaning unit (207). Although there is a decline in the removing ability of toner remained after the image transfer, if a voltage is applied on the fur brush 207-1 and a brush roller is provided additionally before the fur brush 207-1, the cleaning efficiency equivalent to that of the cleaning blade which is a cleaning unit 207, can be achieved. However, in a low-speed image forming apparatus that outputs a small number of copies, only by the fur brush 207-1, the cleaning efficiency in a range to be used as the image forming apparatus, can be achieved.

Figure 23:
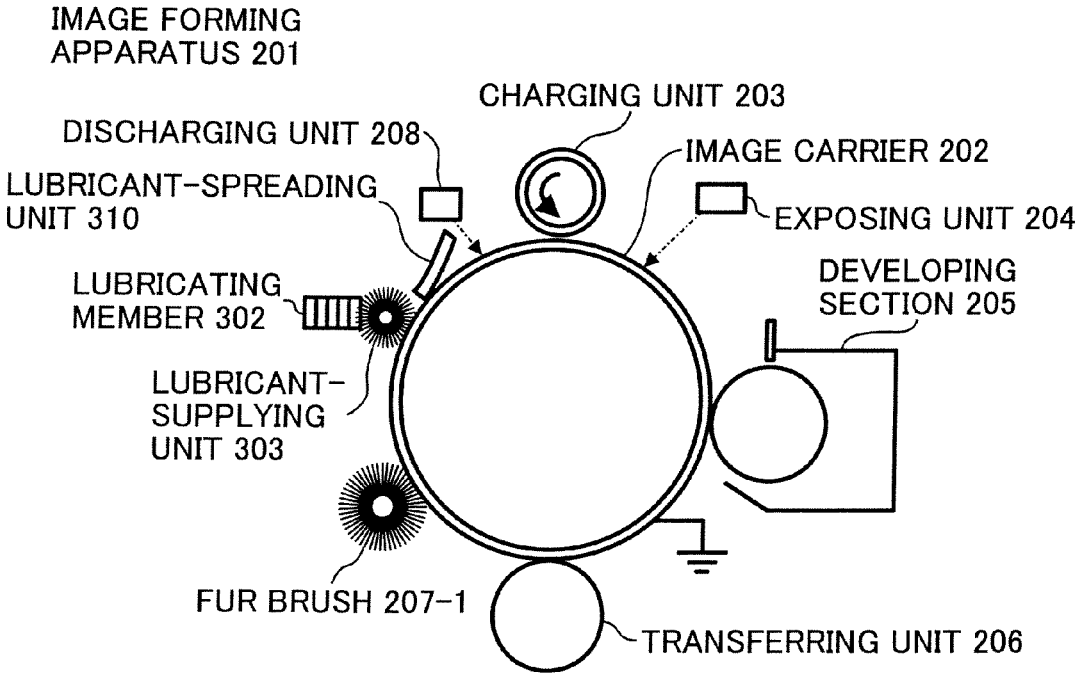
FIG. 23 is a diagram of a structure of an image forming apparatus 201 according to the present invention.

The structure in FIG. 23 is a structure in FIG. 19 without the cleaning blade i.e. the cleaning unit 207. In this case as well, the cleaning efficiency as described in FIG. 22 can be achieved and spreading of the lubricant is superior to that according to FIG. 22.

A material similar to that for the cleaning blade in the cleaning unit 207 may be used for a blade that is used in the lubricant spreading unit 310. In other words, any commonly known material such as polyurethane rubber, silicone rubber, nitrile rubber, and chloroprene rubber may be used as the material. The modulus of elasticity may be in a range of 20% to 80%, the thickness may be in a range of 1 mm to 6 mm, and an angle of contact with the image carrier may be in a range of 15° to 45°.

It is desirable that a direction of rotation of the lubricant applying unit 303 and the lubricating member 302 in FIGS. 17 to 23 is a clockwise direction; however the rotation may be in a counterclockwise direction. In addition, if a velocity of a surface of the image carrier 202 is V1, then it is desirable that a velocity of the brush roller V2 is in a range given by the following equation.

$$0.5V1 \leqq V2 \leqq 5V1 \quad (1)$$

where V1≠V2.

Moreover, if the brush roller is used, a density of the brush in a range of 2000/cm<SUP>2</SUP> to 8000/cm<SUP>2</SUP> is desirable. A lower limit of this range is a value determined based on a result that no defective image on the image carrier was formed in the experiment. An upper limit of the range indicates nothing but limitations in manufacturing, and as there will be an improvement in the technology, a density higher than this will be possible. Therefore, the upper limit is not restricted to any particular value.

Regarding a status of the lubricant on the image carrier 202, it has been revealed that if the proportion (%) of a metal element included in the metal salt of a fatty acid on the surface of the image carrier measured by XPS is not less than $$1.52\times10^{-1}\times\{Vpp-2\times Vth\}\times f/v\ (\%) \quad (2)$$

the deterioration of the surface of the body subjected to charging can be prevented. (In Eq. (2), Vpp is an amplitude [V] of an AC component that is applied on the charging member, f is a frequency [Hz ] of the AC component that is applied on the charging member, Gp is the shortest distance [μm ] between the surface of the charging member and the surface of the body subjected to charging, v is a traveling velocity [mm/sec of the surface subjected to charging that faces the charging member, and Vth is a starting voltage. The value of Vth is $312+6.2\times(d/\epsilon\ opc+Gp/\epsilon\ air)+\sqrt{(7737.6\times d/\epsilon)}$, where d is a film-thickness [μm ] of the body subjected to charging, ϵ opc is a specific inductive capacity of the body subjected to charging, and ϵ air is a specific inductive capacity in a space between the body subjected to charging and the charging member).

From the results of the experiments carried out so far by inventors of the present invention, it has been ascertained that the thin film cannot be formed easily in a structure as shown in FIG. 17 where small particles of the lubricant are applied by the fur brush 207-1 on the image carrier 202 and scraped by the cleaning blade, which is a cleaning unit 207. Moreover, it has also been revealed that the thin film once formed does not come off easily and cannot be removed easily. There, if the thin film of the lubricant is once formed while using the image forming apparatus for the first time in the beginning or when the image carrier 202 is replaced, the thin film can be maintained for a certain period of time by using the structure that includes the fur brush 207-1 and the cleaning blade.

A change in the thin film of the lubricant by components around and in contact with the image carrier 202 is small. However the change in the thin film of the lubricant by direct discharge by the charging unit 203 has been ascertained to be big. Therefore, in a case of charging by using the charging roller, it is desirable to apply the lubricant all the time even after forming the protective layer according to the lubricant-supply mode.

Figure 24:
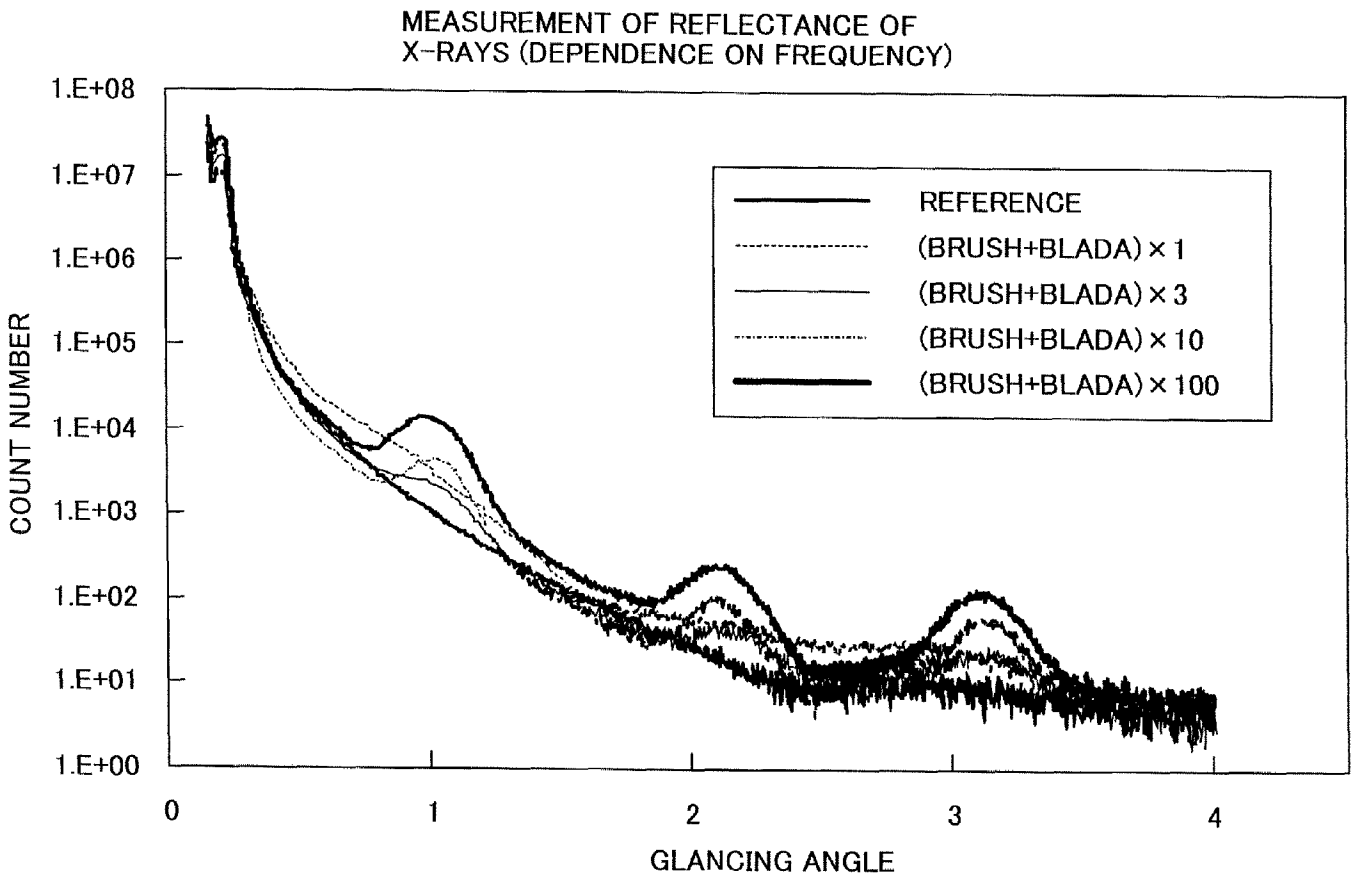
FIG. 24 is a graph of results of measurement of X-ray reflectance for dependence on frequency of a film thickness.
Figure 25:
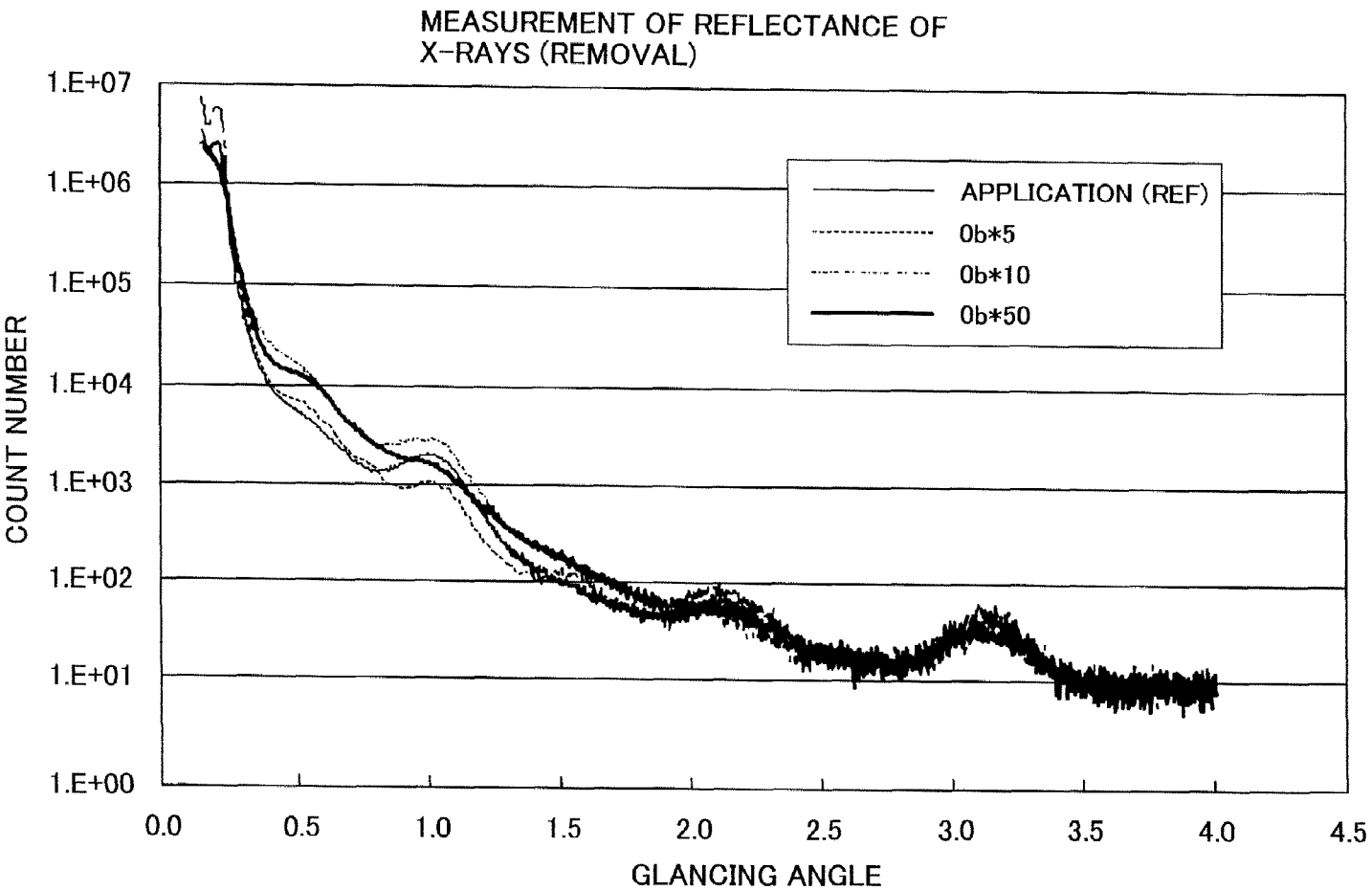
FIG. 25 is a graph of results of measurement of X-ray reflectance for dependence on frequency of a film thickness.

Results of experiments regarding a mechanism for forming the thin film on the image carrier 202 are shown in table 2 and in FIGS. 24 and 25.

TABLE 2

Results of measurement of ZnSt (zinc stearate) film-thickness

| (Brush + blade) Frequency | Film thickness [nm] |
|---|---|
| 1 | 4.9 |
| 10 | 9.1 |
| 20 | 9.2 |
| 30 | 10.7 |

Table 2 indicates a relationship between a frequency of application of the lubricant by the brush and the blade, and the film-thickness. The film thickness in table 2 is a result of measurement by using an ellipsometer and assuming that a refractive index of ZnSt is 1.5 and a coefficient of absorption is zero.

From the results in table 2, it is evident that with a frequency of application 1, an average film-thickness is 4.9 nm and the application is insufficient. Moreover, if the frequency of application is 10, the film-thickness is supposed to be sufficient.

Results of measurement of X-ray reflectance of a zinc stearate film on a substrate.

FIG. 24 is a graph of results of measurement of X-ray reflectance of the film on the substrate. A vertical axis denotes reflection intensity and a horizontal axis denotes an angle of incidence. A peak is observed at a location where a reflection from a surface of the film and that from the substrate coincide. According to FIG. 24 with the frequency of application 1, the peak is very small and the film-thickness is supposed to be insufficient. With the frequency of application 3 and 10, there is a difference in the reflection intensity and the film-thickness is judged to be insufficient even with the frequency of application 3.

Therefore, a sufficient film is supposed to be formed with the frequency of application 10.

From this, an appropriate frequency of application T taking into consideration a shortening of control time taken, is expressed by equation 3.

$$3<T\leqq10 \quad (3)$$

where T is an integer. The frequency of application can be substituted by the number of revolutions of the image carrier 202.

FIG. 25 is a graph of results of measurement of X-ray reflectance of the film on the substrate upon removal after application. With the frequency 10 it is not at all removed and with the frequency 50 it is supposed to be removed a bit.

Here, if a mechanism for bringing closer and separating apart the transferring unit to and from the image carrier is available, it is better to keep the transferring unit and the image carrier separated apart. Similarly, it is better to keep the developing unit separated apart from the image carrier if the mechanism for bringing closer and separating apart is available.

Thus, after the thin film of the lubricant is formed by rotating the image carrier, a preparation before rotation is performed. Then the image forming operation followed by the preparation after rotation is performed and the image forming operation is ended.

From the results of the experiment shown in table 2 and FIGS. 24 and 25, it is ascertained that the thin film is not formed easily and the film once formed cannot be scraped easily. Therefore, it was revealed that if the lubricant spreading unit (that includes an applicator brush and a blade for spreading) is allowed to pass not less than 3 times when the image forming apparatus is used for the first time or when the image carrier is replaced, an appropriate thin film is formed and it was very effective for preventing an effect due to cleaning and charging. Particularly, if the shortening of a time of the control is taken into consideration, the frequency may be in a range of 3 to 10.

The lubricant-supply mode (a control in which the lubricant applying unit 303 and the lubricant spreading unit 310 are allowed to pass with minimum frequency 3) according to the present invention is described below based on flowcharts in FIGS. 26 and 27.

When the image forming apparatus 201 receives a print-command signal, a judgment of whether the image carrier 202 has been replaced or not after the previous print-command signal is made. If the image carrier 202 has not been replaced, the preparation before rotation for the normal image formation, followed by the image forming operation is performed. Further, the image forming operation followed by the preparation after rotation is performed and the image forming operation is ended.

The preparation before rotation in this case includes jobs such as increasing a temperature of the fixing unit, determining a voltage to be applied on the charging unit 203, determining a voltage to be applied on the developing unit, and adjusting concentration of toner. In addition, in a case of a color image forming apparatus, the preparation before rotation sometimes includes an adjustment of color and position of image as well. Moreover, in the preparation after rotation, jobs such as cleaning of the toner remained on the image carrier after the image forming and decharging of the image carrier, are performed.

If the image carrier 202 has been replaced, the apparatus goes into the lubricant-supply mode. The lubricant-supply mode is a mode for forming the thin film of the lubricant on the image carrier 202. Instead of the lubricant-supply mode, a protective layer may be applied while assembling in a factory or while manufacturing the image carrier.

Figure 27:
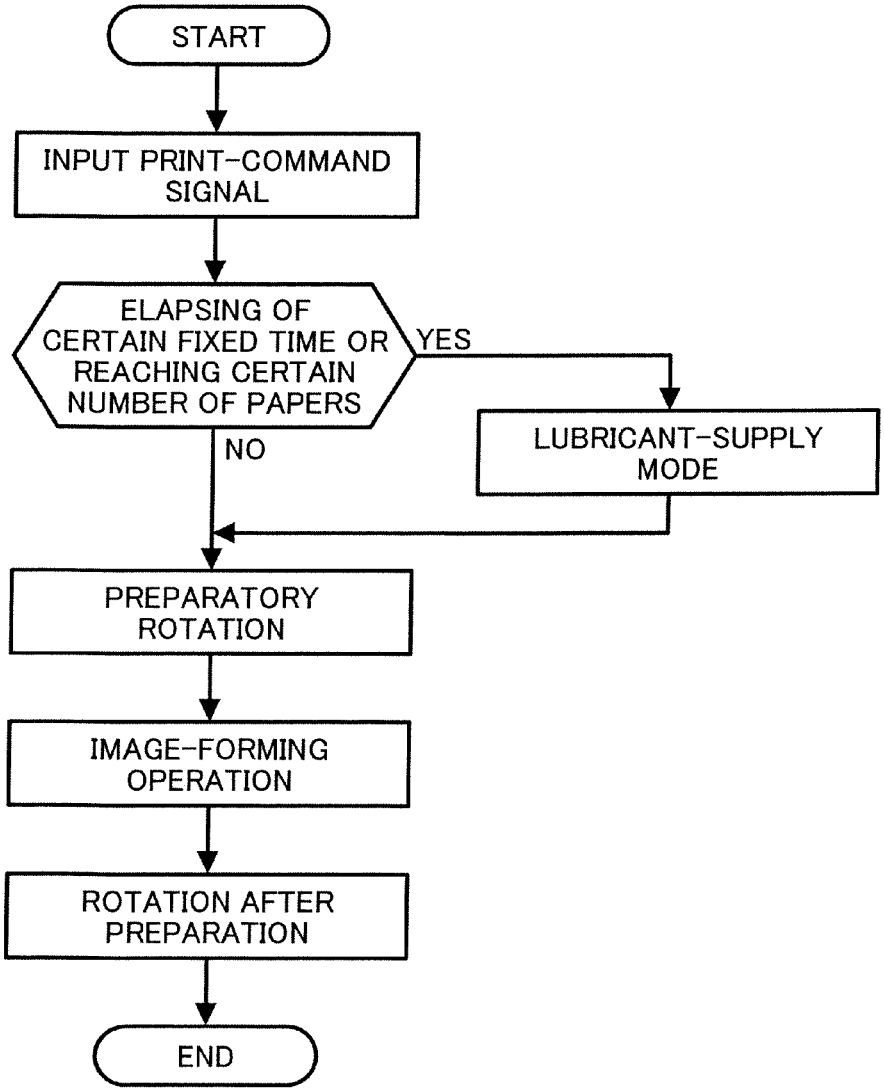
FIG. 27 is a flowchart of another example of the lubricant-supply mode.

According to the flowchart in FIG. 27, such a lubricant-supply mode is executed upon elapsing of a certain time or reaching a certain number of papers from a time of replacement of the image carrier 202. The certain time or the certain number of papers means a period of time in which the thin film of the lubricant has come off partially or the overall film-thickness has decreased. Since this time or the number of papers vary according to a type and an amount of the toner used and on a type of the recording paper in a case of a direct transfer, it is better to set it assuming a case in which the control time is shortened.

As an embodiment of a case in which the transfer is not the direct transfer, when the lubricant-supply mode was executed after about 50 papers, the thin film of the lubricant was maintained. Based on the results, the shortest period may be calculated from the number of prints in a day.

Figure 26:
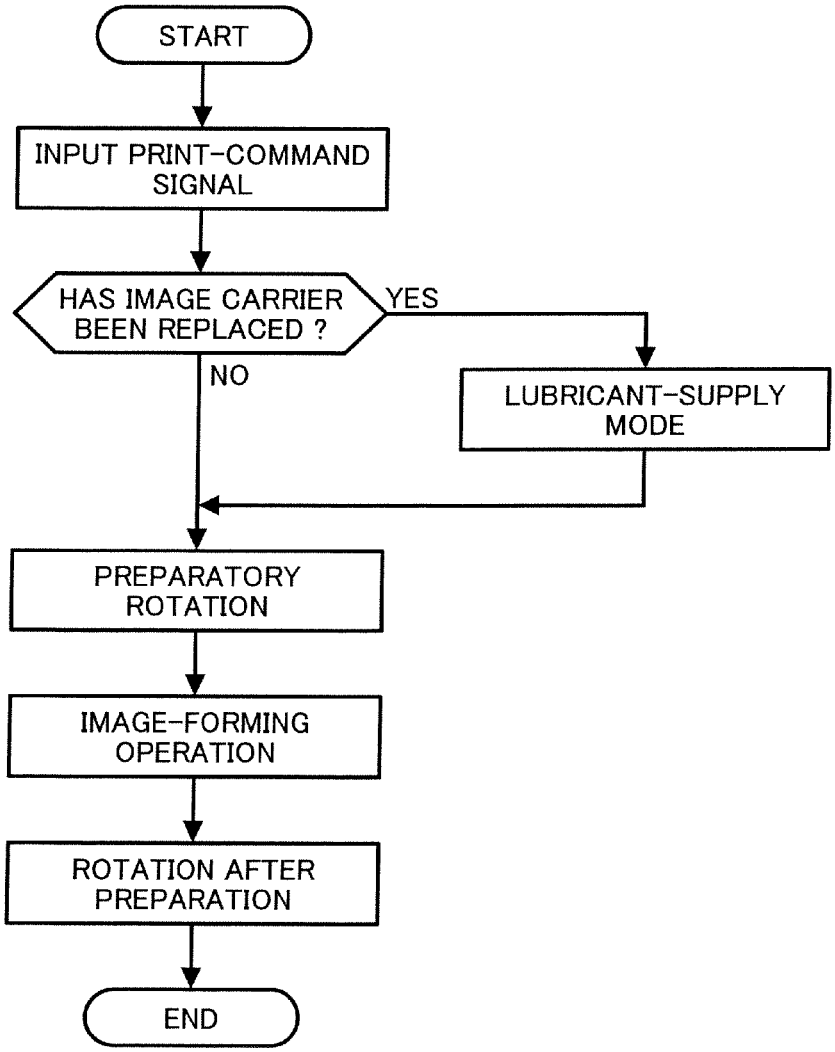
FIG. 26 is a flowchart of an example of a lubricant-supply mode.

The following is a description of the set value of the applied voltage of the charging unit 203 and the developing unit 205 where the developing unit 205 does not have the mechanism for bringing closer and separating apart and the charging unit 203 uses a charging member that comes closer or in contact, referring to FIGS. 26 and 27. If a case in which in a normal image forming apparatus a charging potential Vh of the image carrier is −800 V, a potential of a printing portion that is exposed is −150 V, a voltage applied on the developing unit 205 is −450 V, a charging polarity of the toner is negative, and the voltage to be applied on the developing unit is assumed to be applied even in the lubricant-supply mode, it is advisable that a voltage Vch applied on the charging unit 203 is in a range such that the AC voltage on the charging unit 203 is not superimposed and the charging potential Vh of the image carrier is expressed by equation 4 below. In other words, it is advisable to set the charging voltage Vh of the image carrier such that it is lower than the voltage applied on the developing unit 205. Moreover, it is advisable to set it to a value lesser by about 100 volts (i.e. −550 V) than a value of the voltage applied on the developing unit 205 (in this case, −450 V).

$$-450\text{ V} > Vh > -800\text{ V} \tag{4}$$

where a lower limit of −800 V up to an upper limit is possible if the charging unit 203 has further charging capacity. For example, if the charging capacity is up to −1200 V, the lower limit can be −1200 V.

By selecting such a value, it is possible to prevent adhesion of toner to the image carrier 202 and to form the thin film of the lubricant easily.

The voltage Vch to be applied on the charging unit 203, which satisfies equation 4 changes according to the thickness of a photosensitive film on the image carrier 202. However, in the image carrier 202 used for the experiment, the value was such as that roughly shown by the following equation 5.

$$-1150\text{ V} > Vch > -1500\text{ V} \tag{5}$$

Next, if a case in which a voltage to be applied on the developing unit 205 is assumed to be connected to a ground instead of applying during image formation in the lubricant-supply mode is shown below, it is advisable that the voltage Vch to be applied on the charging unit 203 is in a range such that the AC voltage to the charging unit 203 is not superimposed and the charging potential Vh to be applied on the image carrier 202 is in a range shown by equation 6. Moreover, it is advisable to set it to a value lesser by about 100 volts than a value of the voltage applied on the developing unit 205 (in this case, −100 V).

$$0\text{ V} > Vh > -800\text{ V} \tag{6}$$

where the lower limit of −800 V up to the upper limit is possible if the charging unit 203 has further charging capacity. For example, if the charging capacity is up to −1200 V, the lower limit can be −1200 V.

By selecting such a value, it is possible to prevent the adhesion of toner to the image carrier 202 and to form the thin film of the lubricant easily.

The voltage Vch to be applied on the charging unit 203, which satisfies equation 6 changes according to the thickness of the photosensitive film on the image carrier 202. However, in the image carrier 202 used for the experiment, the value was such as that roughly shown by the following equation 7.

$$0\text{ V} \geqq Vch > -1500\text{ V} \tag{7}$$

However, according to equation 7, there is a discharge generated between the charging unit 203 and the image carrier 202 and the formation of the thin film of the lubricant on the image carrier 202 is inhibited. Therefore, a better condition not to generate the discharge between the charging unit 203 and the image carrier 202 is a range of Vch in equation 8. The starting voltage given below varies according to factors such as the film-thickness of the image carrier 202, but is about 700 V as an absolute value.

$$0\ V \geqq Vch > (\text{starting voltage}) \quad (8)$$

In this case, an example in a case of negative charging is shown and in a case of positive charging, a greater-than sign is reversed.

The image forming apparatus that executes this lubricant-supply mode does not necessarily require the decharging unit but it is desirable to have one.

It is desirable that the toner according to the present invention has an average degree of circular shape in the range of 0.93 to 1.00. If the average degree of circular shape is less than 0.93, the toner takes a shape that is different from the spherical shape and the dot reproduction is deteriorated. Moreover, due to an increase in the points of contact with the image carrier 202, the release ability is deteriorated and the transfer ratio is declined.

If the average degree of circular shape of the toner is higher than 0.93, the toner has a projection shape close to the circle, and an excellent dot reproduction and higher transfer ratio can be achieved.

The average degree of circular shape of a toner is a value obtained by detecting the particles optically and dividing by a peripheral length of an equivalent circle that is equal to the projected area. Concretely, the measurement is carried out by using an automated particle shape and size analyzer (FPIA-2000 manufactured by SYSMAX CORPORATION). Water (100 mL to 150 mL) with solid impurities removed from it in advance is put and 0.1 mL to 0.5 mL of a surface active agent is added to it as a dispersing agent. Further, about 0.1 g to 9.5 g of a test portion is added to this mixture. A suspension in which the test portion is dispersed is subjected to dispersion for approximately 1 min to 3 min in the ultrasonic distributor and the concentration of the dispersed liquid is let to be in the range of 3000/μL to 10000/μL. The shape and the distribution of the toner are measured.

Figure 29:
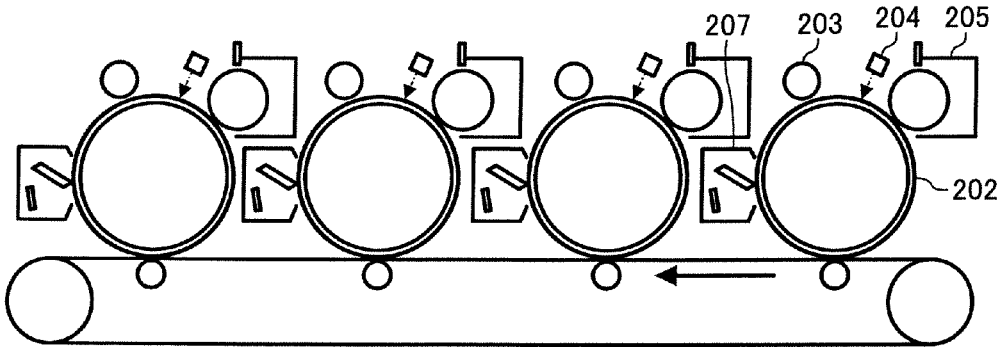
FIG. 29 is a diagram of still another structure of the image forming apparatus 201.
Figure 30:
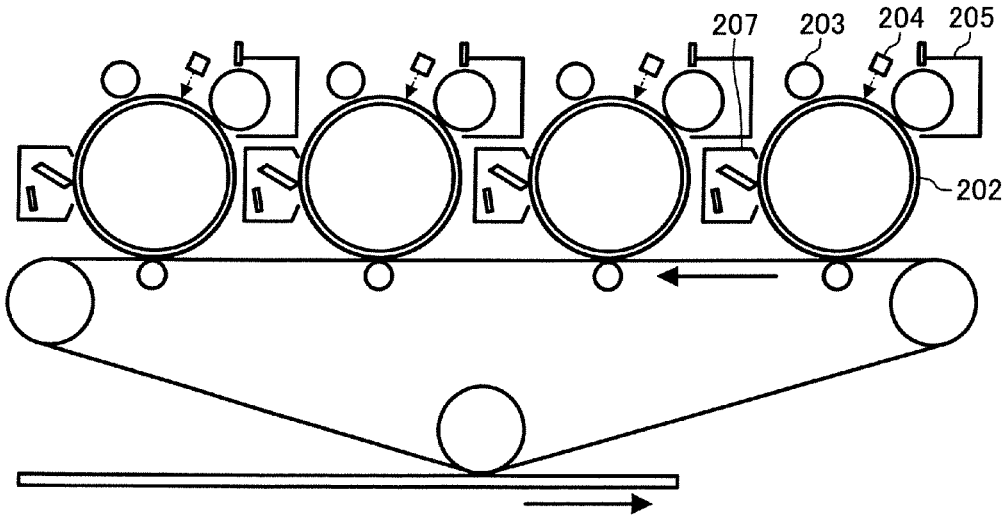
FIG. 30 is a diagram of still another structure of the image forming apparatus 201.

In an image forming apparatus that includes a process cartridge 219, a casing by which the charging unit is rotatably supported and a cleaning case that supports the cleaning unit 207 are structured as an integrated unit case. The image carrier 202 is rotatably assembled in this integrated unit case. Thus, an imaging unit is formed by assembling integrally the charging unit 203 and the image carrier 202. The imaging unit is detachably installed in the image forming apparatus (refer to FIGS. 29 and 30).

The charging unit 203 and the image carrier 202 are installed in the unit case with a certain minute gap G maintained between the two. The imaging unit is detachably installed in the image forming apparatus with the certain minute gap G maintained. Therefore, there is no big change in the minute gap G when the imaging unit is detached or attached. A structure may be formed such that the image carrier 202 and the charging unit 203 are separately detachable from the image forming apparatus 201. However, with such a structure there is a possibility of a change in the minute gap G when the image carrier 202 or the charging unit 203 is detached or attached, and the charging may not be uniform.

Figure 28:
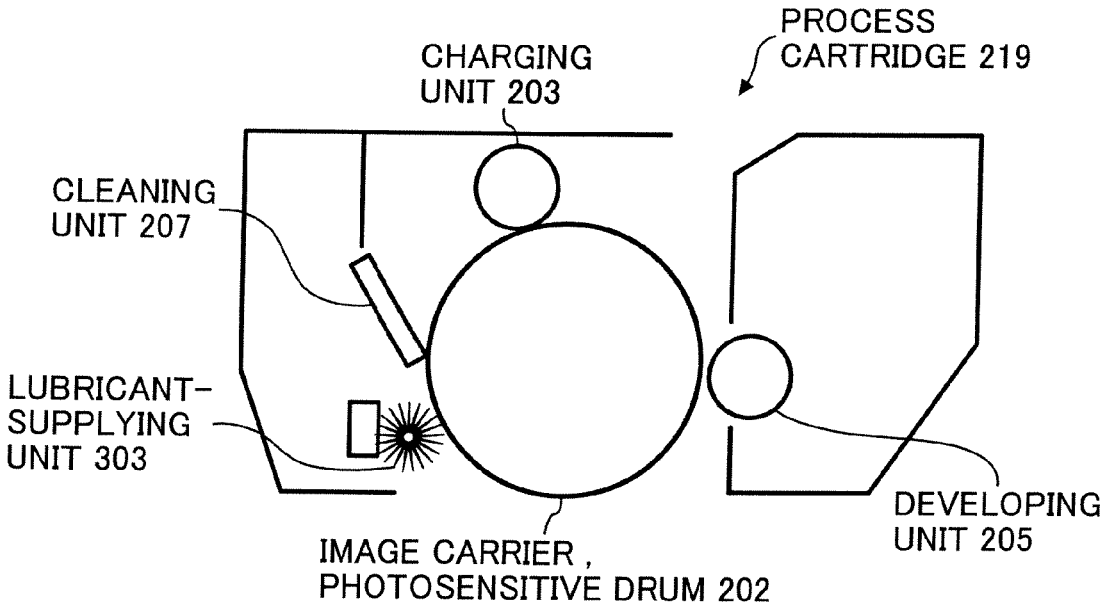
FIG. 28 is a diagram of an image forming apparatus that includes the process cartridge according to the present invention.

The imaging unit according to the present embodiment includes apart from the charging unit, contact members that are in contact with the image carrier 202. In an example shown in FIG. 28, as mentioned earlier, the cleaning case and the casing are formed as the integrated unit case and the lubricant applying unit 303 is assembled in this unit case. Moreover, it is not shown in the diagram, but it is advisable to assemble integrally the charging unit 203 and a lubricant removing unit in the unit case.

The contact members are structured to make a contact with the image carrier 202 and a structure may be such that the contact members are detachably connected to the image forming apparatus 201 separately from the charging member 203. However, in such a structure, while detaching or attaching the contact members, since the contact members move while making contact with the image carrier 202, a large external force is exerted on the image carrier 202 and the minute gap G may change due to this external force. For this reason, if the contact members are let to be components of the imaging unit, when the imaging unit is detached from or attached to the image forming apparatus 201, the contact members that include the cleaning blade, the lubricant applying unit 303, and the lubricant removing unit are also detached or attached together. Therefore, these contact members do not move relatively with respect to the image carrier 202 and there is no big change in the minute gap G due to this. This enables to prevent occurrence of any damage to the image carrier due to the contact.

If the image carrier 202 is an organic photosensitive drum that includes a surface layer, which is reinforced by a filler such as alumina particles of a particle size not greater than 0.1 μm or an organic photosensitive drum in which a cross-linking charge transporting material is used, or an organic photosensitive drum that has both of these characteristics, since there is an increase a surface hardness and an improvement in the wear resistance, it is possible to make the life much longer.

Figure 31:
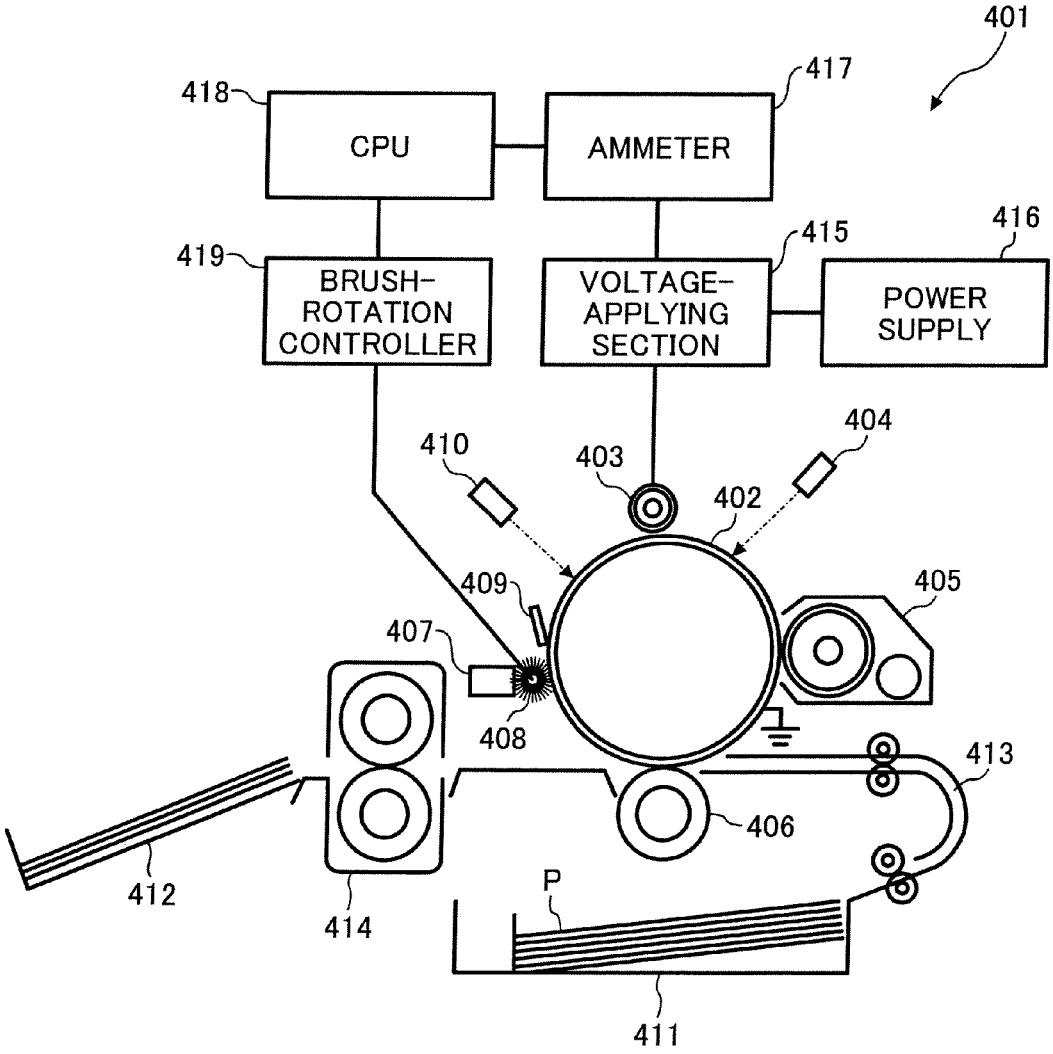
FIG. 31 is a schematic side view of a printer that is an image forming apparatus according to the present invention.

FIG. 31 is a schematic side view of a printer that is an electrophotographic image forming apparatus. A printer 401 includes a photosensitive drum 402 substantially at a center inside a main-body case (not shown in the diagram), as an image carrier. The photosensitive drum 402 is rotatably supported around its central line. The photosensitive drum 402 is driven to rotate around its central line by a drive of a motor that is coupled with an axis of rotation (not shown in the diagram) of the photosensitive drum 402. The photosensitive drum 402 rotates in a clockwise direction as shown by an arrow.

Various members for forming a toner image on a surface of photosensitive drum 402 are disposed around the photosensitive drum 402. These members include a charging roller 403, an optical writing unit 404, a developing unit 405, a transferring unit 406, a lubricant 407, a fur brush 408, an elastic blade 409, and a decharging section 410. The charging roller 403 charges the surface of the photosensitive drum 402 uniformly. The optical writing unit forms an electrostatic latent image by exposing the uniformly charged surface of the photosensitive drum 402 according to image data. The developing unit 405 supplies toner to the electrostatic latent image and allows the electrostatic image to be visualized as a toner image. The transferring unit 406 transfers the toner image visualized to a recording medium P. The lubricant 407 is applied on the surface of the photosensitive drum 402. The decharging section 410 decharges a charge remained on the surface of the photosensitive drum 402.

A recording-medium accommodating section 411 that accommodates a recording medium P is provided on a bottom side inside the main-body case. A recording-medium transporting path 413 that extends from the recording-medium accommodating section 411 up to a recording-medium discharging section 412 where the recording medium P on which the toner image is transferred is discharged. The photosensitive drum 402, the transferring unit 406, and a fixing unit 414 that fixes by melting the toner image are provided on the recording-medium transporting path 413.

A power supply 416 is connected to the charging roller 403 via a voltage applying section 415. By applying a voltage that is supplied from the power supply 416 to the charging roller 403 via the voltage applying section 415, the corona discharge is generated between the charging roller 403 and the photosensitive drum 402 and the surface of the photosensitive drum 402 is charged. It is desirable that the voltage applied on the charging roller is a voltage in which the AC voltage is superimposed on the DC voltage.

The strength of the corona discharge that is generated between the charging roller 403 and the photosensitive drum 402 depends on environmental conditions of temperature and humidity, and changes constantly. The strength of the corona discharge can be detected by measuring a discharge current by an ammeter 417, which is a detecting unit connected to the voltage applying section 415. The ammeter 417 is connected to a CPU (Central Processing Unit) 418. The CPU 418 controls each section of the printer 401 and a ROM (Read Only Memory) (not shown in the diagram) that stores various computer programs that are run by the CPU 418 and a RAM (Random Access Memory) (not shown in the diagram) that functions as a work area of the CPU are connected to the CPU 418.

The lubricant 407 includes a metal salt of a fatty acid that contains at least one fatty acid selected from acids such as stearic acid, palmitic acid, myristic acid, and oleic acid and at least one metal selected from metals such as zinc, aluminum, calcium, magnesium, iron, and lithium. The lubricant 407 is formed by compressing the metal salt of the fatty acid in a powder form. It is desirable to compress a fine powder to form the lubricant 407. Zinc stearate is a typical example of a lamella-crystal powder and such a substance is suitable to be used as a lubricant. Lamella crystals have a layered structure in which amphipathic molecules are self-organized and when the shearing force is exerted, the crystals break along the boundary between the layers and tend to be slippery. This behavior is effective for lowering the coefficient of friction. Thus, it is a peculiarity of the lamella crystals to cover uniformly the surface of the photosensitive drum 402 when the shearing force is exerted. This peculiarity enables the surface of the photosensitive drum 402 to be covered effectively by a small amount of the lubricant 407.

The fur brush 408 is disposed at a position where it makes a contact with the solid lubricant 407 and the surface of the photosensitive drum 402. The fur brush 408 removes toner adhered to and remained on the surface of the photosensitive drum 402 as well as functions as an applying unit that applies the lubricant 407 on the surface of the photosensitive drum 402. A brush-rotation controller 419 that drives and rotates the fur brush 408 is connected to the fur brush 408. The brush-rotation controller 419 is connected to the CPU 418 and functions as an amount adjusting unit that adjusts an amount of the lubricant 407 to be applied on the photosensitive drum 402 by varying the number of revolutions of the fur brush 408 according to the control of the CPU 418 based on measurement results from the ammeter 417. As the number of revolutions of the fur brush 408 increase, the amount of the lubricant scraped by and applied on the surface of the photosensitive drum 402 by the fur brush 408 increases.

A front end of the elastic blade 409 is in contact with the surface of the photosensitive drum 402 and the elastic blade 409 functions as a spreading unit that spreads the lubricant applied on the photosensitive drum 402 by the fur brush 408 to form a thin layer.

Figure 32:
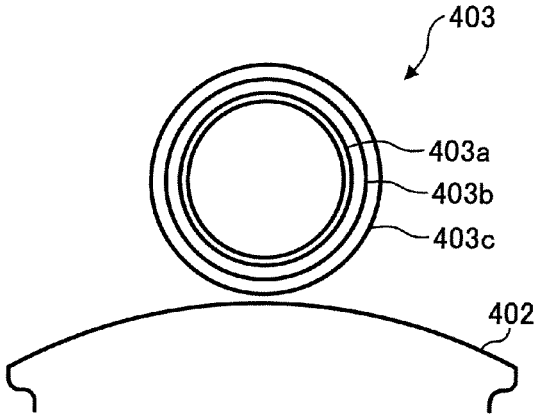
FIG. 32 is a longitudinal side-sectional view of a structure of the charging roller.

FIG. 32 is a longitudinal side-sectional view of a structure of the charging roller 403. The charging roller 403 includes an electroconductive substrate 403*a* and a resistive layer 403*b* around the electroconductive substrate 403*a*. The electroconductive substrate 403*a* is circular cylindrical member of stainless steel and has a diameter in a range of 8 mm to 20 mm. The electroconductive substrate 403*a* may be made lighter by using aluminum or an electroconductive resin having a lower efficiency not greater than 10<SUP>2</SUP> Ω·cm.

The resistive layer 403*b* includes a high-polymer material in which an electroconductive material is kneaded with an ABS resin and on a surface of which a fluorine-contained resin layer 403*c* is formed. Example of the electroconductive materials are a metal ion complex, carbon black, and ionic molecules. Apart from these materials, a material that enables uniform charging may be used.

In the developing unit 405, a spherical shaped toner that has a degree of circular shape not less than 0.96 is used. By using such a toner having a high degree of circular shape, the image quality can be improved.

The charging roller 403 rotates such that a direction of a surface of the charging roller moves in the same direction as that of the surface of the photosensitive drum 402. As a matter of course, the charging roller 403 may be let to be stationary instead of rotating. A dimension in a longitudinal direction (axial direction) of the charging roller 403 is set to be little longer than the maximum image width A4 in a landscape orientation (approximately 290 mm).

Figure 33:
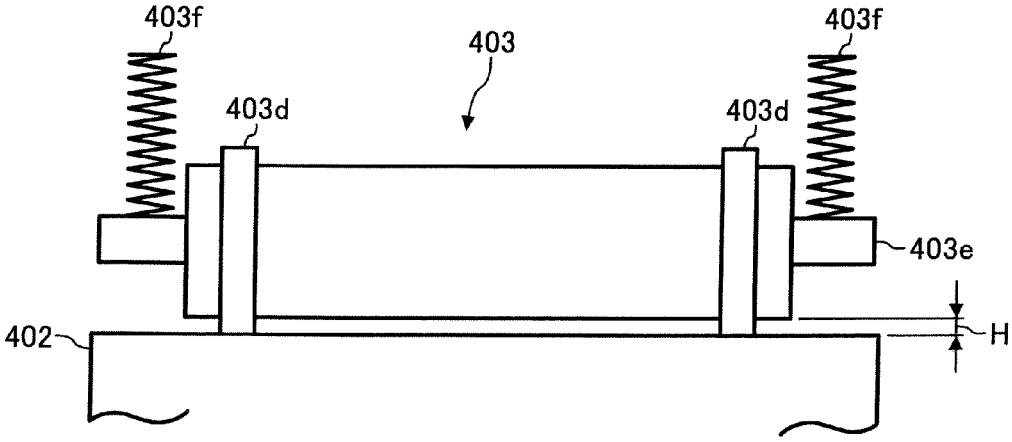
FIG. 33 is a front view illustrating a positional relationship between the charging roller and a photosensitive drum.
Figure 34A:
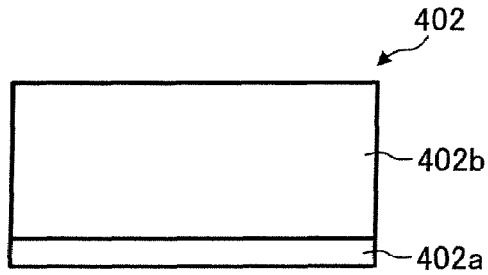
FIG. 34 is a schematic block diagram illustrating a layer-structure of the photosensitive drum.
Figure 34B:
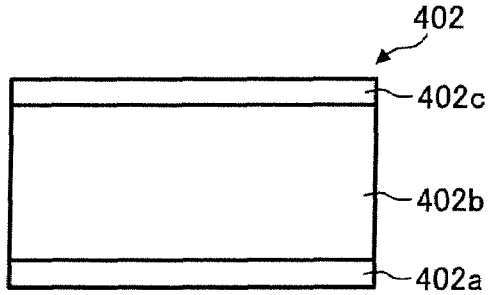
Figure 34C:
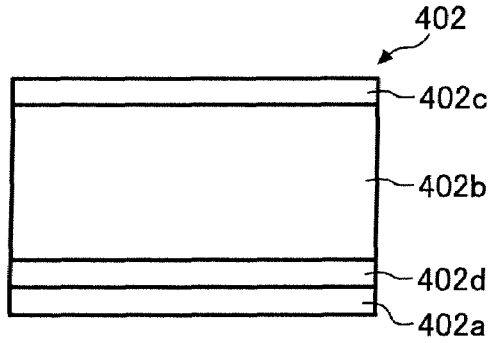
Figure 34D:
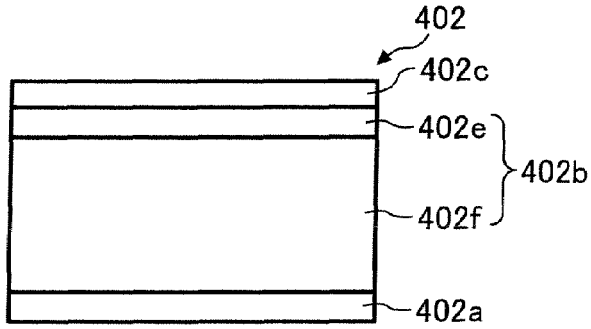

FIG. 33 is a front view illustrating a positional relationship between the charging roller 403 and the photosensitive drum 402. Spacers 403*d* are provided on both ends in the longitudinal direction of the charging roller 403. By bringing these spacers 403*d* in contact with a non-image forming area at both ends of the photosensitive drum 402, a gap H between the surface of the photosensitive drum 402 that is charged and a charging surface of the charging roller 403 is maintained such that the closest distance is in a range of 5 μm to 100 μm. It is desirable that the closest distance is set to be in a range of 30 μm to 65 μm. According to the present embodiment, the closest distance is set to 55 μm. By pressurizing a shaft 403*e* of the charging roller 403 by a spring 403*f*, an accuracy of maintaining the gap H between the surface of the photosensitive drum 402 that is charged and the charging surface of the charging roller 403, is improved. It is desirable to use a thermal contraction tube as spacers 403*d*.

FIGS. 34A to 34D are schematic block diagrams illustrating layer-structures of the photosensitive drum 402. The photosensitive drum 402 shown in FIG. 34A includes a support 402*a* and a photoconductive layer 402*b* formed by amorphous silicon (a-Si: H, X) provided on the support 402*a*. The photosensitive drum 402 shown in FIG. 34B includes the support 402*a*, the photoconductive layer 402*b* formed by amorphous silicon (a-Si: H, X), provided on the support 402*a*, and an amorphous-silicon based surface layer 402*c*. The photosensitive drum 402 shown in FIG. 34C includes the support 402*a*, an amorphous-silicon based charge-injection blocking layer 402*d*, the photoconductive layer 402*b* formed by amorphous silicon (a-Si: H, X), and an amorphous-silicon based surface layer 402*c*. The photosensitive drum 402 shown in FIG. 34D includes the support 402*a*, the photoconductive layer 402*b* formed by amorphous silicon (a-Si: H, X) as in the photosensitive drum 402 shown in FIG. 34B, and the amorphous-silicon based surface layer 402*c*. The photoconductive layer 402*b* includes a charge generating layer 402*e* and a charge transporting layer 402*f*.

In the photosensitive drums 402 illustrated in FIGS. 34A to 34D, by using amorphous silicon on a surface side, a smoothness of the surface of the photosensitive drum 402 is improved significantly and the lubricant can be applied uniformly on the surface of the photosensitive drum 402.

In the photosensitive drums 402 illustrated in FIGS. 34A to 34D, a filler may by added to the amorphous-silicon based surface layer 402*c* and the photoconductive layer 402*b* on a side of an outer surface of the photosensitive drum 402. By adding the filler, the surface of the photosensitive drum 402 becomes hard and cannot be worn out easily. Therefore, unevenness due to wearing out is not developed easily on the surface of the photosensitive drum 402 and the lubricant can be applied uniformly on the surface of the photosensitive drum 402.

In such as structure, during the image formation, the photosensitive drum 402 and the fur brush 408 rotate, and by rotating of the fur brush 408, the lubricant 407 is scraped by and adhered to the fur brush 408. The lubricant adhered to the fur brush 408 is applied on the surface of the photosensitive drum 402. The lubricant applied on the surface of the photosensitive drum 402 is spread by the elastic blade 409 to form a thin layer of roughly uniform thickness on the surface of the photosensitive drum 402. If the number of revolutions of the fur brush 408 increase, the amount of the lubricant applied on the surface of the photosensitive drum 402 increases.

Regarding the application of the lubricant (zinc stearate) 7 on the surface of the photosensitive drum 402, the inventor have proved that when the film-thickness is approximately 10 nm, a sufficient lubricating ability can be rendered. Here, if a length of a molecular chain of zinc stearate is considered to be 5 nm, an ideal condition for application i.e. the film-thickness of the lubricant is approximately 10 nm indicates that when two molecules are located on the surface of the photosensitive drum 402, a sufficient lubricating effect is achieved. In other words, these results indicate that zinc stearate renders sufficient lubricating ability by a shift between two molecular layers. Other metal salts of fatty acids such as magnesium stearate and calcium stearate also show a similar property and the length of the molecular chain being almost the same, by forming the film of zinc stearate of film-thickness in a range of 8 nm to 12 nm all the time, the sufficient lubricating effect is considered to be achieved.

The lubricant 407 includes a metal salt of a fatty acid that contains at least one fatty acid selected from acids such as stearic acid, palmitic acid, myristic acid, and oleic acid and at least one metal selected from metals such as zinc, aluminum, calcium, magnesium, iron, and lithium. Since a metal salt of a fatty acid has a structure of a linear hydrocarbon, a slippage between the layers occurs easily and renders an excellent lubricating ability. Moreover, in a case of such a metal salt of a fatty acid, by selecting a metal, an excellent durability can be imparted.

Since the lubricant 407 is formed by compressing a metallic salt of a fatty acid in the powder form, a space required to mount the lubricant 407 can be made smaller. For this, it is desirable that the lubricant is formed by compressing a fine powder. This is because, the spreading by the elastic blade 409 after the lubricant 407 is applied on the photosensitive drum 402 can be expedited without exerting a large shearing force.

Zinc stearate can be used as the lubricant 407 and it can be compressed easily.

To apply the lubricant 407 on the surface of the photosensitive drum 402, since the elastic blade 409 that is a spreading unit, is used, the lubricant 407 can be applied on the surface of the photosensitive drum uniformly without unevenness and with uniform thickness of the film. By using the fur brush 408 as an applying unit, in addition to an ability to apply the lubricant 407 uniformly without unevenness, an applying unit with a low-cost structure can be achieved. By using the elastic blade 409 as a spreading unit, the shearing force can be exerted efficiently on the lubricant that is applied on the surface of the photosensitive drum 402 and a thin layer of the lubricant can be formed smoothly.

FIG. 35 is a table of results obtained upon investigating by using X-ray photoelectron spectroscopy (XPS) changes in an amount of zinc stearate on the surface of the photosensitive drum 402 due to charging after applying zinc stearate (lubricant 407). Zinc stearate is applied before applying the charging voltage and after applying the charging voltage zinc stearate is not applied. The film-thickness of zinc stearate applied initially is approximately 10 nm. In FIG. 35, it is evident that a strength of $\pi \rightarrow \pi$ goes on increasing with a charging time. $\pi \rightarrow \pi$ is a signal caused by a benzene ring of polycarbonate that is a main substance in the photosensitive drum 402. Therefore, FIG. 35 illustrates that by charging, there is a decrease in the lubricant applied and the surface of the photosensitive drum 402 is exposed gradually as against the overall surface of the photosensitive drum 402 covered by the lubricant after applying the lubricant initially on the surface of the photosensitive drum 402.

FIG. 36 is a table of results upon calculating the amount of zinc stearate on the surface of the photosensitive drum 402 based on the results shown in FIG. 35. The results indicate that in the charging time of 30 seconds a zinc-stearate film having thickness 10 nm vanishes partially in certain area of the surface of the photosensitive drum 402. Therefore, to deal with the deterioration of discharge, an amount of zinc stearate has to be applied at not less than 10 [nm]/30 [sec]=0.3 [nm/sec]. On the other hand, in the charging time of 10 seconds, since zinc stearate covers the overall surface of the photosensitive drum 402, it is desirable that zinc stearate is applied at not more than 10 [nm]/10 [sec]=1 [nm/sec].

Figure 37:
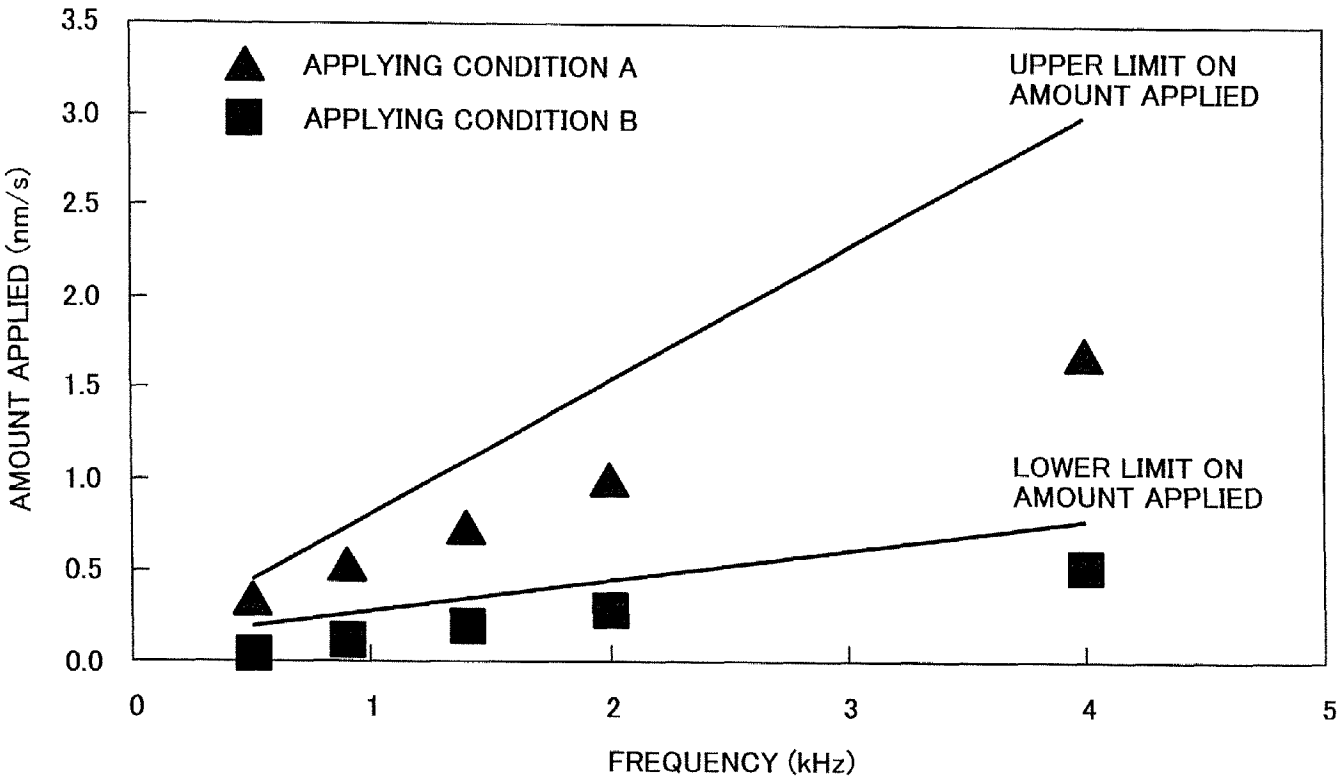
FIG. 37 is a graph upon calculating an appropriate amount of zinc stearate when a frequency of AC voltage applied on the charging member is changed.

FIG. 37 is a graph upon calculating an appropriate amount of zinc stearate when frequency of AC voltage applied on the charging member 3 is changed. When zinc stearate is applied under applying conditions A and B, in a case of applying condition A, there was no scraping of the film on the surface of the photosensitive drum 402, whereas in a case of applying condition B, the film on the surface of the photosensitive drum 402 was scraped.

Moreover, it has been revealed that by applying zinc stearate in such a manner, apart from the effect as a lubricant, an effect as a protective substance that tempers deterioration of the photosensitive drum 402 due to charging is achieved. Particularly, while using a method of charging the photosensitive drum 402 by causing the corona discharge in a proximity space between the photosensitive drum 402 and the charging member 3 that is in proximity with the photosensitive drum 402 or the charging member 3 in contact with the photosensitive drum 402, since the surface of the photosensitive drum 402 tends to be deteriorated, the lubricant is quite effective as a protective substance. In such a method of charging, when the voltage in which the AC component is superimposed on the DC component is applied and when a metal salt of a fatty acid is used as a lubricant, if the lubricant 407 is applied on the photosensitive drum 407 such that a proportion (%) of a metal element included in the metal salt of a fatty acid that is on a surface of the body subjected to charging in the discharge area measured by XPS is not less than $1.52\times10^{-4}\times\{Vpp-2\times Vth\}\times f/v$ [%], it has been revealed that the lubricant functions sufficiently as a protective substance. Even in the applying condition A, the element proportion mentioned above has been confirmed to have been satisfied. (Here, Vpp is an amplitude [V] of the AC component that is applied on the charging member 3, f is a frequency [Hz] of the AC component that is applied on the charging member 3, Gp is the shortest distance [μm] between the surface of the charging member 3 and the surface of the body subjected to charging, v is a traveling velocity [mm/sec] of the surface subjected to charging that faces the charging member 3, and Vth is a starting voltage. Moreover, the value of Vth is $312+6.2\times(d/\epsilon opc+Gp/\epsilon air)+\sqrt{(7737.6\times d/\epsilon)}$, where d is a film-thickness [μm] of the body subjected to charging, $\epsilon opc$ is a specific inductive capacity of the body subjected to charging, $\epsilon air$ is a specific inductive capacity in a space between the body subjected to charging and the charging member 3).

Under the applying condition A in FIG. 37, it was confirmed that there is an improvement in the cleaning efficiency as well and an effect on the cleaning of a toner having a degree of circular shape not less than 0.96.

According to the present embodiment, detection of the strength of the corona discharge by measuring the discharge current by using the ammeter 417, which is a detecting unit connected to the voltage applying section 415, has been described by giving an example. However, instead of the ammeter 417, a unit that detects an intensity of discharge light may be provided as a detecting unit.

In this case, the strength of the corona discharge that is generated between the charging roller 403 and the photosensitive drum 402 depends on the environmental conditions of temperature and humidity, and changes constantly. The strength of the corona discharge is detected by detecting the intensity of the discharge light (corona discharge light). The amount of the lubricant to be applied on the photosensitive drum 402 can be adjusted by changing the number of revolutions of the fur brush 408 by the control of the CPU 418 based on the results of detection of the intensity of the discharge light. With an increase in the number of revolutions of the fur brush 408, increased amount of the lubricant is scraped by the fur brush 408 and is applied on the surface of the photosensitive drum 402.

An experiment to study the change in the amount of zinc stearate applied on the photosensitive drum 402 was carried out as follows.

Zinc stearate was applied with the following conditions before applying the charging voltage and then charging was started. Zinc stearate that was applied initially has become a 10 nm thick film. Conditions for applying zinc stearate and conditions for evaluation of the film-thickness are as follow.

Method of applying: Zinc stearate was applied with the following conditions before applying the charging voltage.

Applying time: 5 minutes

Fur brush: dent created on the surface of the photosensitive drum=1 mm

Blade: made of urethane, hardness=70

Photosensitive drum: linear velocity=125 mm/s

Conditions for Evaluation of Film-Thickness of Zinc Stearate

Evaluation method: Zinc stearate was applied on a test-piece sample according to the conditions for applying zinc stearate and the film-thickness of the sample was evaluated. The film-thickness was calculated from the X-ray reflectance by a method for X-ray reflectance analysis by Parratt simulation.

Applicator: IPSiO color 8000 modified stage movable lubricant applying unit

Test-piece sample: having a 4 μm thick photosensitive layer created on a glass plate according to dipping method Traveling velocity of stage (equivalent to the traveling velocity of the surface of the photosensitive drum)=125 mm/s Thus, after applying zinc stearate on the photosensitive drum, the change in the amount of zinc stearate with respect to the discharge was evaluated as follows.

Conditions for Charging Photosensitive Drum

Machine: IPSiO color 8000 (manufactured by RICOH) modified machine (a direct transfer full-color printer)

Charging unit: non-contact charging roller of hard type shown in FIGS. 32 and 33.

Gap maintained: a non-conductive thermal contraction tube was used to maintain the gap according to the dimensions shown in FIG. 33.

Bias applied for charging: AC component: Vpp 3.0 kV, f 1.35 kHz, DC component: −600 V Time for which voltage was applied: 0 sec, 10 sec, 30 sec, 60 sec, and 120 sec.

Method of Evaluating Quantity of Zinc Stearate on the Photosensitive Drum

Evaluation method: The surface of the photosensitive drum after charging is evaluated by the X-ray photoelectron spectroscopy (XPS).

FIG. 35 indicates a change in C1s spectrum of the surface of the photosensitive drum on which zinc stearate is applied and then charged, evaluated by the XPS. In FIG. 35, it is evident that the strength of $\pi\rightarrow\pi$ goes on increasing with the charging time. $\pi\rightarrow\pi$ is a signal caused by a benzene ring of polycarbonate that is a main substance in the photosensitive drum and not caused by zinc stearate. In other words, FIG. 35 illustrates that by charging, there is a decrease in the lubricant applied and the surface of the photosensitive drum is exposed gradually, as against the overall surface of the photosensitive drum covered by the lubricant after applying the lubricant initially on the surface of the photosensitive drum. Therefore, the results in FIG. 35 indicate that zinc stearate vanishes gradually from an area of strong discharge. Results of an area ratio of zinc stearate on the surface of the photosensitive drum in FIG. 35 calculated are tabulated in FIG. 36. As it is evident from FIG. 36, approximately 10 nm thick zinc stearate applied initially, has vanished partially in charging time of 30 seconds.

In this case following points are to be noted. Since the discharge strength is not uniform due to roughness of the surface of the photosensitive drum and the gap to be maintained, the amount of zinc stearate on the photosensitive drum varies from place to place. Therefore, the change in the amount of zinc stearate can be considered to be occurring locally. For this reason, even if zinc stearate of uniform thickness could be applied on the overall surface of the photosensitive drum initially, the change due to the charging on the photosensitive drum is not necessarily uniform. Therefore, there is a possibility that zinc stearate vanishes partially as indicated in FIG. 36.

As it is evident from FIG. 36, zinc stearate having the film-thickness of 10 nm applied initially, has vanished partially in 30 seconds. Therefore, under this charging condition, a speed of vanishing of zinc stearate is 10 [nm]/30 [sec]=0.3 [nm/sec]. The amount of zinc stearate applied per unit time has to be not less than the amount vanished. In other words, the amount of zinc stearate applied has to be not less than 0.3 [nm/sec]. Moreover, in the charging time of 10 seconds, since zinc stearate is there all over the surface of the photosensitive drum, to prevent problems caused by an excessive application on the photosensitive drum, it is desirable that the amount applied is not more than 10 [nm]/10 [sec]=1 [nm/sec].

By using a similar method, the results in FIG. 37 can be achieved by changing the frequency of the charging voltage and calculating the speed at which zinc stearate is applied. In a case where conditions of the charging voltage are changed, based on these results, it is possible to regulate ideal speed of applying zinc stearate all the time. Moreover, by a similar method, an ideal amount of applying when an amplitude voltage of the charging voltage is changed can be regulated.

An experiment about a change in the film-thickness of the photosensitive drum according conditions of zinc stearate was carried out as described below.

Regarding conditions for amount of zinc stearate to be applied, the change in the thickness of the film on the photosensitive drum when the conditions were set to applying conditions A and B, which are different, was studied. As shown in FIG. 37, the applying condition A is in line with conditions for applying that are regulated based on the condition of charging voltage whereas the applying condition B does not conform to it.

Conditions for Evaluation of Amount of Film Scraped

Measuring apparatus: IPSiO color 8000 (manufactured by RICOH) modified simple testing machine Apparatus for measuring thickness of the film on the photosensitive drum: FISCHERSCOPE MMS manufactured by FISCHER INSTRUMENTS INC.

Running time: 10 hours

As a result, there was no scraping of the film with the applying condition A and the film was scraped with the applying condition B. Thus, regulating the speed of applying zinc stearate by the discharge strength was ascertained to be effective in increasing life of the photosensitive drum. In other words, with the condition B, no sufficient amount that can show lubricating ability on the photosensitive drum was there whereas with the condition A, sufficient amount that can render the maximum lubricating ability is there. Therefore, the scraping of the photosensitive drum can be suppressed.

Figure 38:
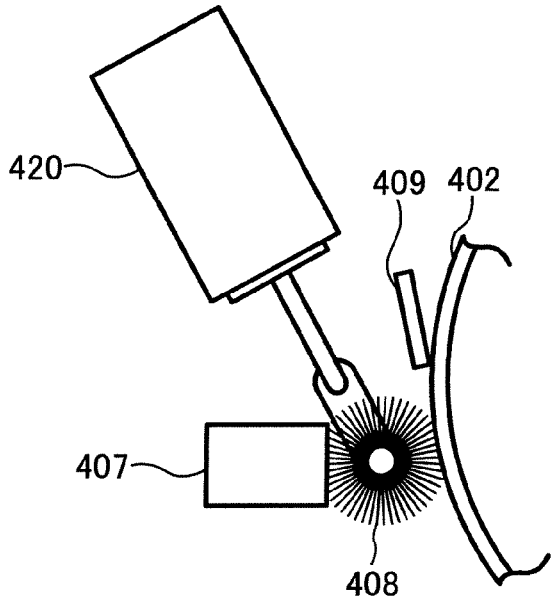
FIG. 38 is a side view of a portion of mechanism that applies the lubricant on the photosensitive drum, which is a part of a printer according to the present invention.

FIG. 38 is a side view of a portion of a mechanism that applies the lubricant 407 on the photosensitive drum 402, which is a part of a printer. A basic structure according to the present embodiment is the same as that shown in FIG. 31 and includes the lubricant 407 that is compressed, the photosensitive drum 402, the fur brush 408, and the elastic blade 409. The fur brush 408 that is driven and rotates is disposed at a position such that it is in contact with the lubricant 407 and the photosensitive drum 402. The front end of the elastic blade 409 is in contact with the surface of the photosensitive drum 402.

A solenoid 420 is connected to the fur brush 408. The solenoid 420 enables the fur brush 408 to make contact with and to be separated from the surface of the photosensitive drum 402.

Therefore, by separating the fur brush 408 away from the photosensitive drum 402, the application of the lubricant on the surface of the photosensitive drum 402 is stopped and consumption of the lubricant can be reduced. For example, after the lubricant is applied on the photosensitive drum 402 by bringing the fur brush 408 in contact with the photosensitive drum 402, the fur brush 408 can be separated away from the photosensitive drum 402 till a charging time during which a certain amount of the lubricant applied on the photosensitive drum 402 vanishes due to corona discharge, is elapsed. Moreover, while separating the fur brush 408 away from the photosensitive drum 402, it is desirable to stop rotation of the fur brush 408.

Figure 39:
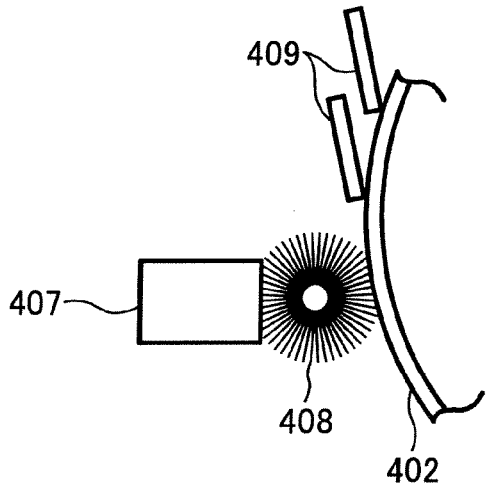
FIG. 39 is a side view of a portion of mechanism that applies the lubricant on the photosensitive drum, which is a part of a printer according to the present invention.

FIG. 39 is a side view of a portion of a mechanism that applies the lubricant 407 on the photosensitive drum 402, which is a part of the printer. A basic structure according to the present embodiment is the same as that shown in FIG. 31 and includes the lubricant that is compressed, the photosensitive drum 402, the fur brush 408, and the elastic blade 409. The fur brush 408 that is driven and rotates is disposed at a position such that it is in contact with the lubricant 407 and the photosensitive drum 402. The front end of the elastic blade 409 is in contact with the surface of the photosensitive drum 402. However, instead of one elastic blade 409 there is a plurality of elastic blades 409 which are disposed in parallel.

In such as structure, the elastic blade 409 performs a function of spreading the lubricant applied by the fur brush on the surface of the photosensitive drum 402 to form a thin layer. By arranging the plurality of elastic blades in parallel, a speed of forming the thin layer of the lubricant on the photosensitive drum 402 is accelerated and a predetermined film-thickness can be achieved promptly.

Figure 40:
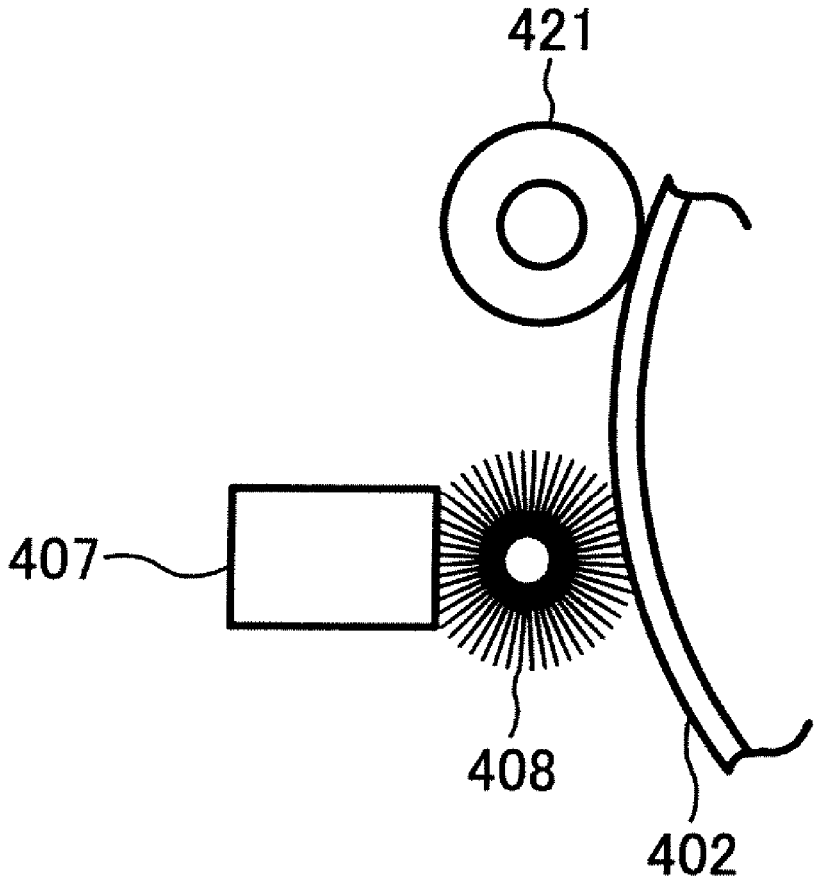
FIG. 40 is a side view of a portion of mechanism that applies the lubricant on the photosensitive drum, which is a part of a printer according to the present invention.

FIG. 40 is a side view of a portion of a mechanism that applies the lubricant 407 on the photosensitive drum 402, which is a part of the printer. The printer according to the present embodiment includes the lubricant 407 that is compressed, the photosensitive drum 402, the fur brush 408 as an applying unit, and a circular cylinder shaped roller 421 as a spreading unit. The fur brush 408 that is driven and rotates is disposed at a position such that it is in contact with the lubricant 407 and the photosensitive drum 402. The circular cylinder shaped roller 421 is disposed at a position such that it is in contact with the surface of the photosensitive drum 402.

The circular cylinder shaped roller 421 is disposed such that a center line of the photosensitive drum 402 and that of the circular cylinder shaped roller 421 are in parallel. The circular cylinder shaped roller 421 is in a pressed contact with the surface of the photosensitive drum 402 and is rotated by friction with the photosensitive drum 402.

A resin such as urethane rubber can be used as a material for the circular cylinder shaped roller 421.

In such a structure, by using the circular cylinder shaped roller 421 as a spreading member, an area of contact at a portion of contact between the circular cylinder shaped roller 421 and the photosensitive drum 402 becomes large and the shearing force on the lubricant that is applied on the photosensitive drum 402 is exerted easily, thereby enabling to form easily the thin layer of the lubricant applied on the photosensitive drum 402.

Figure 41:
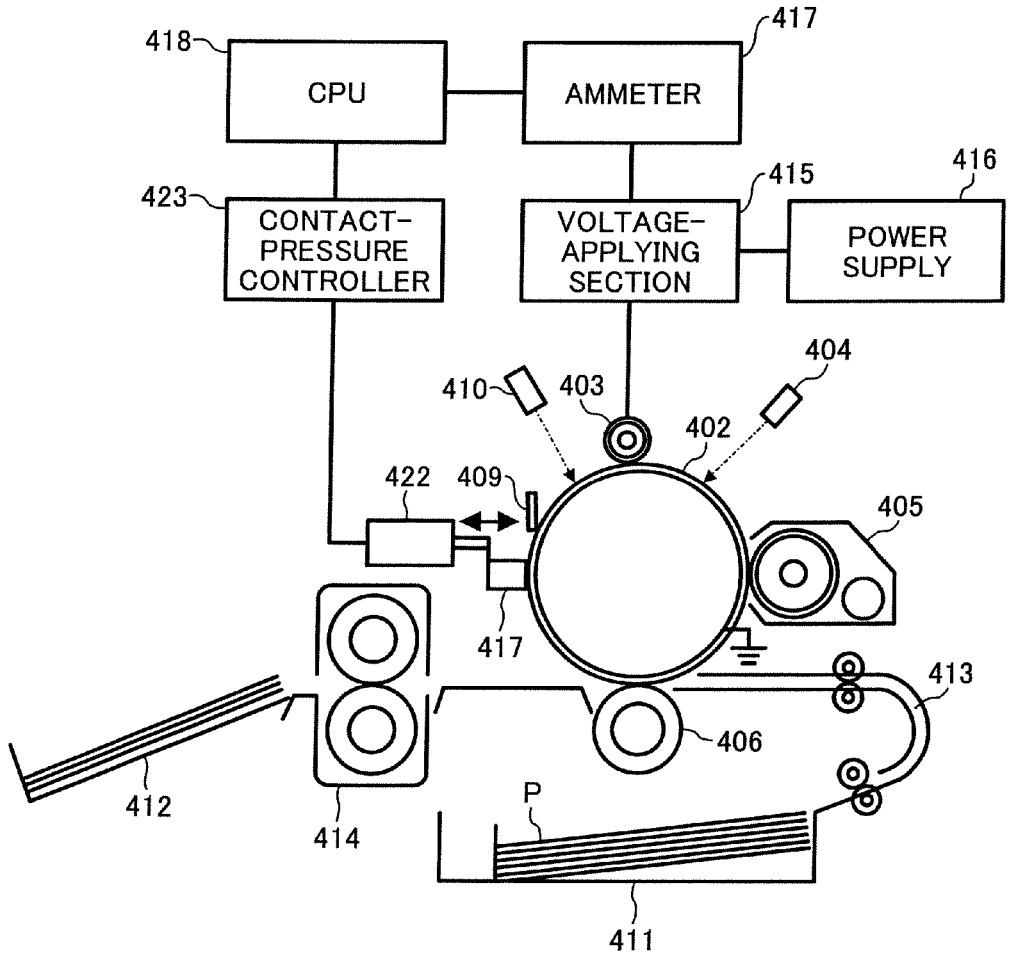
FIG. 41 is a side view of a portion of mechanism that applies the lubricant on the photosensitive drum, which is a part of a printer according to the present invention.

FIG. 41 is a side view of a portion of a mechanism that applies the lubricant 407 on the photosensitive drum 402, which is a part of the printer. In the printer according to the present embodiment, the lubricant 407 that is compressed is applied directly on the surface of the photosensitive drum 402. The lubricant 407 functions as an applying unit that applies the lubricant 407 on the surface of the photosensitive drum 402.

An actuator 422 such as a motor that varies a contact pressure between the lubricant 407 and the photosensitive drum 402 is installed near the lubricant 407 and a contact-pressure controller 423 is connected to the actuator 422. The contact-pressure controller 423 is connected to the CPU 418 and functions as an amount adjusting unit that adjusts the amount of the lubricant to be applied on the photosensitive drum 402 by varying the contact-pressure exerted by the lubricant 407 on the photosensitive drum 402 by the control of the CPU 418 based on the results of measurement by the ammeter 417.

In such a structure, in the printer according to the present invention, by varying the contact pressure exerted by the lubricant 407 on the photosensitive drum 402 due to driving of the actuator 422, the amount of the lubricant to be applied on the photosensitive drum 402 can be adjusted. According to the present embodiment, since the lubricant 407 also serves as the applying unit, an applying unit for exclusive use is not necessary and it is possible to reduce cost by decreasing the number of components.

Figure 42:
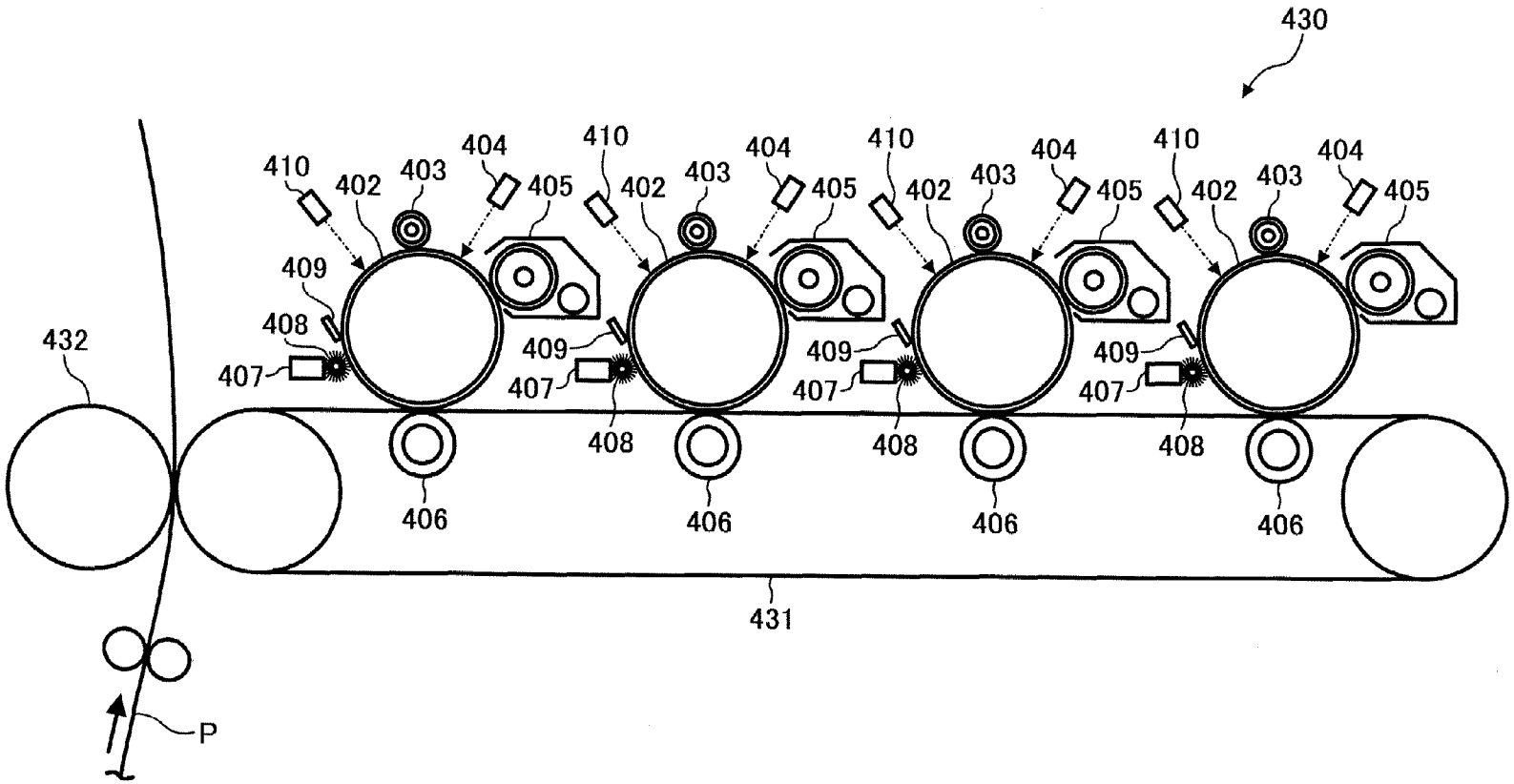
FIG. 42 is a schematic side view of a full-color printer that is an image forming apparatus according to the present invention.

FIG. 42 is a schematic side view of a full-color printer 430 of tandem type which is an image forming apparatus. The full-color printer 430 is an electrophotographic image forming apparatus and includes in a main-body case (not shown in the diagram) four photosensitive drums 402 that are image carriers. The photosensitive drums 402 are rotatably supported by a center line. The photosensitive drums 402 are driven to rotate around the center line by a motor (not shown in the diagram) that is coupled with an axis of rotation (not shown in the direction) of the photosensitive drum 402. The photosensitive drums 402 are rotated in the clockwise direction as shown by an arrow.

Various members for forming a toner image on the surface of the photosensitive drum 402 are disposed around each photosensitive drum 402. These members include the charging roller 403, the optical writing unit 404, the developing unit 405, an intermediate transfer belt 431, a lubricant 407, and a decharging unit 410. The intermediate transfer belt 431 is a transferring body that transfers and superimposes toner images one after another on the photosensitive drum 402. The lubricant 407 is in compressed form and is applied on the surface of the photosensitive drum 402. Toner of each different color (yellow, magenta, cyan, and black) is accumulated in each of the developing units 405 and a toner image of different color is formed on each of the photosensitive drums 402.

A transferring unit 432 for transferring on the recording medium the toner image that is transferred to the intermediate transfer belt 431 is provided at a side of the intermediate transfer belt 431.

In the full color printer 430, as in the color printer 401 described earlier, the lubricant 407 is applied on the surface of the photosensitive drum 402 by rotating of the fur brush 408.

The intermediate transfer belt 431 functions as a spreading unit that spreads the lubricant applied on the photosensitive drum 402. The fur brush 408 spreads the lubricant applied on the surface of the photosensitive drum 402 at locations where the photosensitive drum 402 and the intermediate transfer belt 431 are pressed, and forms a thin layer.

In such a structure, since the intermediate transfer belt 431 in the full-color printer 430, also serves as a spreading unit that spreads the lubricant applied on the photosensitive drum 402, a spreading unit for exclusive use is not necessary and it is possible to reduce cost by decreasing the number of components.

According to the present embodiment, an example in which the intermediate transfer belt 431 is used as a member that also serves as the spreading unit is described. However, an intermediate transfer drum that is in contact with the surface of the photosensitive drum and the toner image of each color is transferred to it or a transfer and carrier belt that carries while pressing on the surface of the photosensitive drum the recording medium on which the toner image is transferred can be used as well.

Figure 43:
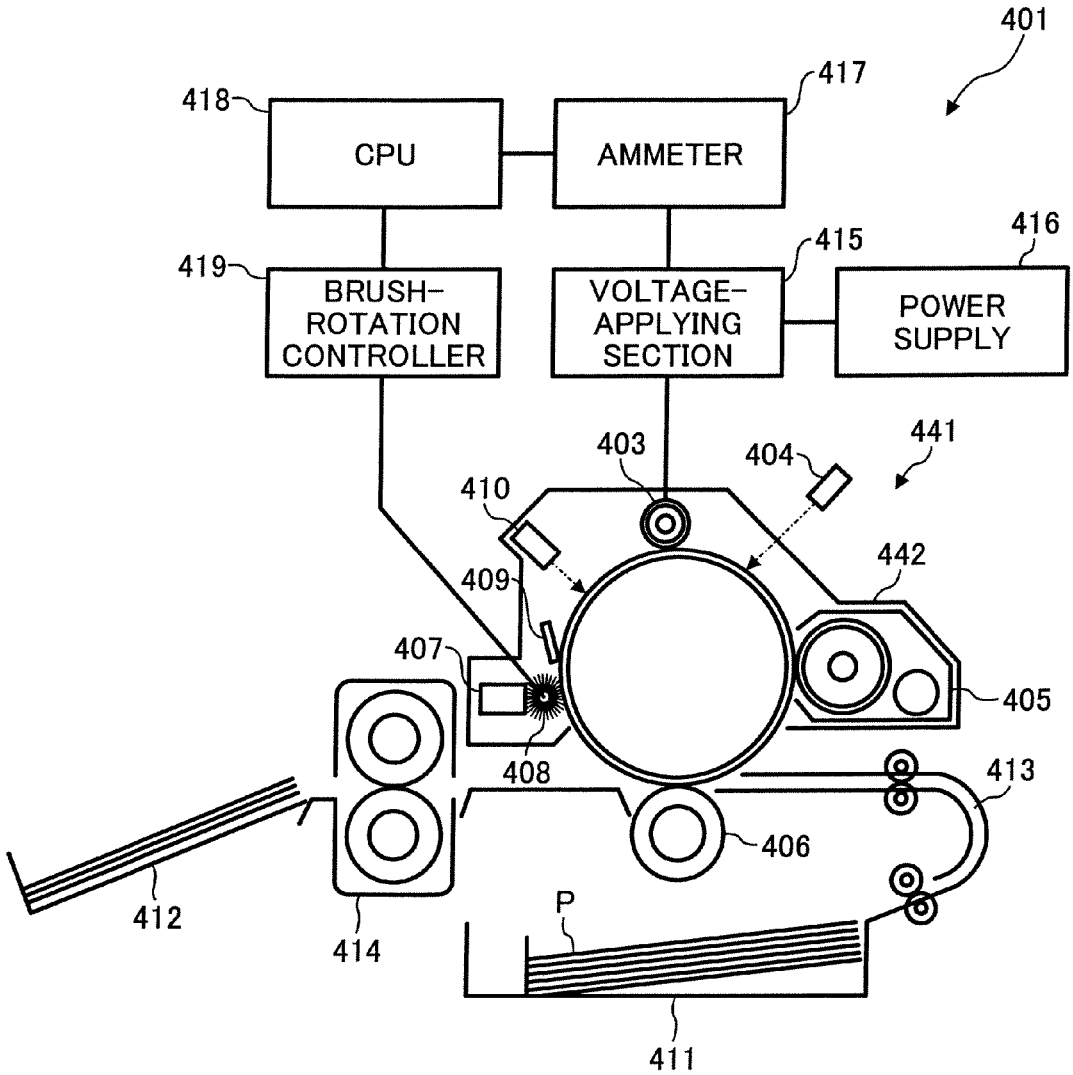
FIG. 43 is a schematic side view of a printer equipped with a process cartridge, which is an image forming apparatus according to the present invention.

FIG. 43 is a schematic side view of a printer that is an electrophotographic image forming apparatus. Printer 440 is provided with a process cartridge 442 that is detachable. The process cartridge 441 includes a cartridge case 442 and the photosensitive drum 402, the charging roller 403, the developing unit 405, the lubricant 407, the fur brush 408, the elastic blade 409, and the decharging section 410, which are inside the cartridge case 442.

The recording-medium accommodating section 411 that accommodates the recording medium P is provided on the bottom side inside the main body case (not shown in the diagram) of a printer 440. The recording-medium transporting path 413 that extends from the recording-medium accommodating section 411 up to the recording-medium discharging section 412 where the recording medium P on which the toner image is transferred is discharged. Units such as the process cartridge 441, the transferring unit 406, and the fixing unit 414 are provided near the recording-medium transporting path 413.

The printer 440 further includes the power supply 416, the voltage applying section 415, the ammeter 417, the CPU 418, and the brush-rotation controller 419. By installing the process cartridge 441 inside the main-body case of the printer 440, the charging roller 403 is connected to the voltage applying section 415 and the fur brush 408 is connected to the brush-rotation controller 419.

In such a structure, during the image formation, the photosensitive drum 402 and the fur brush 408 rotate. Due to rotating of the fur brush 408, the lubricant 407 is scraped by and adhered to the fur brush 408. The lubricant adhered to the fur brush 408 is applied on the photosensitive drum 402. The lubricant applied on the surface of the photosensitive drum 402 is spread by the elastic blade 409 to form a thin layer of uniform thickness is on the surface of the photosensitive drum 402. As the number of revolutions of the fur brush 408 increase, there is an increase in the amount of the lubricant applied on the surface of the photosensitive drum 402.

Since the photosensitive drum 402, the lubricant 407, the fur brush 408, and the elastic blade 409 are held inside the cartridge case 442, the position of the photosensitive drum 402, the lubricant 407, the fur brush 408, and the elastic blade 409 cannot get shifted easily and the lubricant 407 can be applied stably on the photosensitive drum 402 by using the fur brush 408 and the elastic blade 409.

Figure 44:
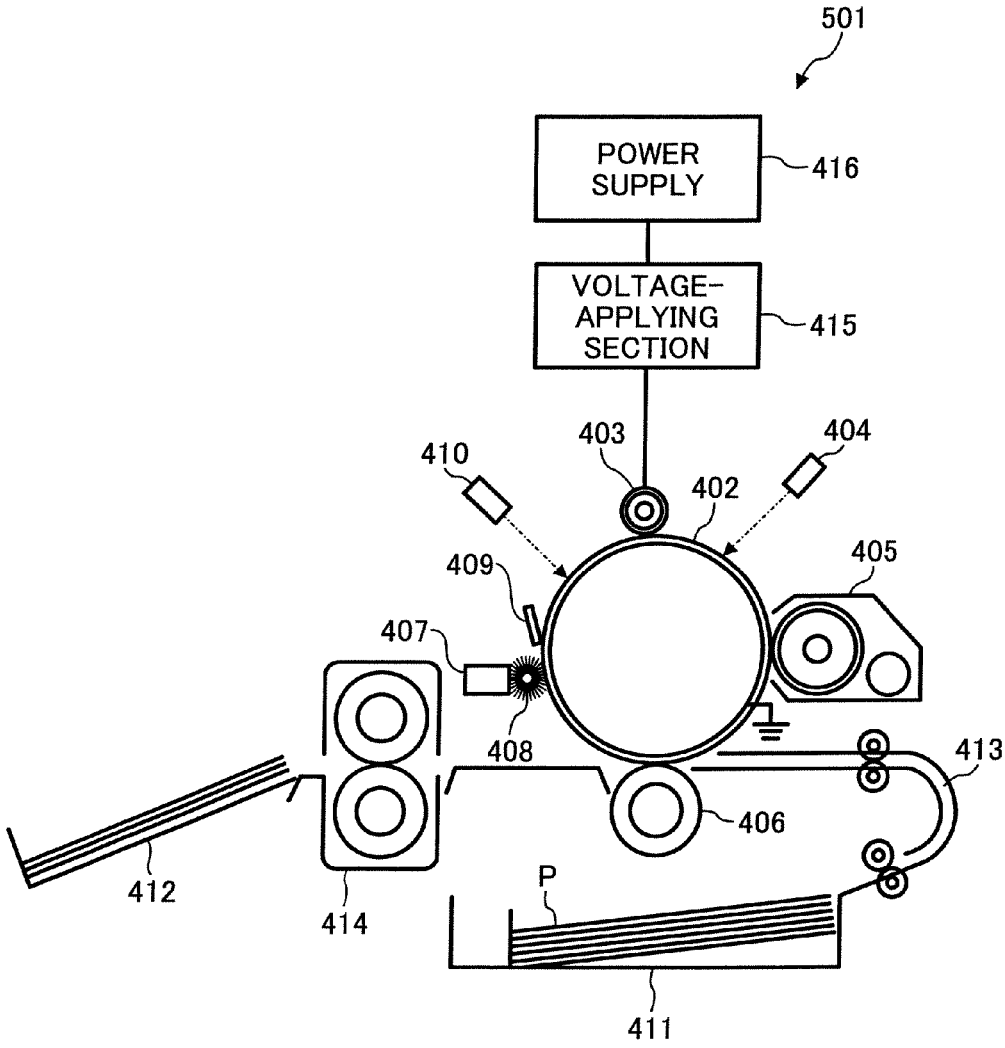
FIG. 44 is a schematic side view of a printer that is an image forming apparatus according to the present invention.

FIG. 44 is a schematic side view of a printer that is an electrophotographic image forming apparatus. The basic structure of the printer is similar to that of the printer 401 shown in FIG. 31. Components described in FIGS. 31 to 37 are denoted by the same reference numerals and the description of these components is omitted (same for embodiments that follow). A printer 501 includes substantially at a center in the main-body case (not shown in the diagram) the photosensitive drum 402 that is an image carrier. The photosensitive drum 402 is rotatably supported by the center line. The photosensitive drum 402 is driven to rotate around the center line by a motor (not shown in the diagram) that is coupled with an axis of rotation (not shown in the diagram) of the photosensitive drum 402. The photosensitive drum 402 is rotated in the clockwise direction shown by an arrow.

As it has been mentioned earlier, FIG. 37 is a graph upon calculating the appropriate amount of zinc stearate when the frequency of the AC voltage applied on the charging member 403 is changed. When zinc stearate is applied under the applying conditions A and B respectively, in the case of applying condition A, there was no scraping of the film on the surface of the photosensitive drum 402, whereas in the case of applying condition B, the film on the surface of the photosensitive drum 402 was scraped. An upper limit on amount applied is a minimum amount applied with which there is no scraping of the film on the surface of the photosensitive drum 402. A lower limit on amount applied is an amount with which there is no problem caused due to the lubricant that is applied. A problem caused due to the lubricant that is applied is that the lubricant applied enters into the developing unit and is adhered to the toner, thereby lowering the frictional charging of the toner. This leads to a decrease in an image density due to a decline in charging of the toner.

Figure 45:
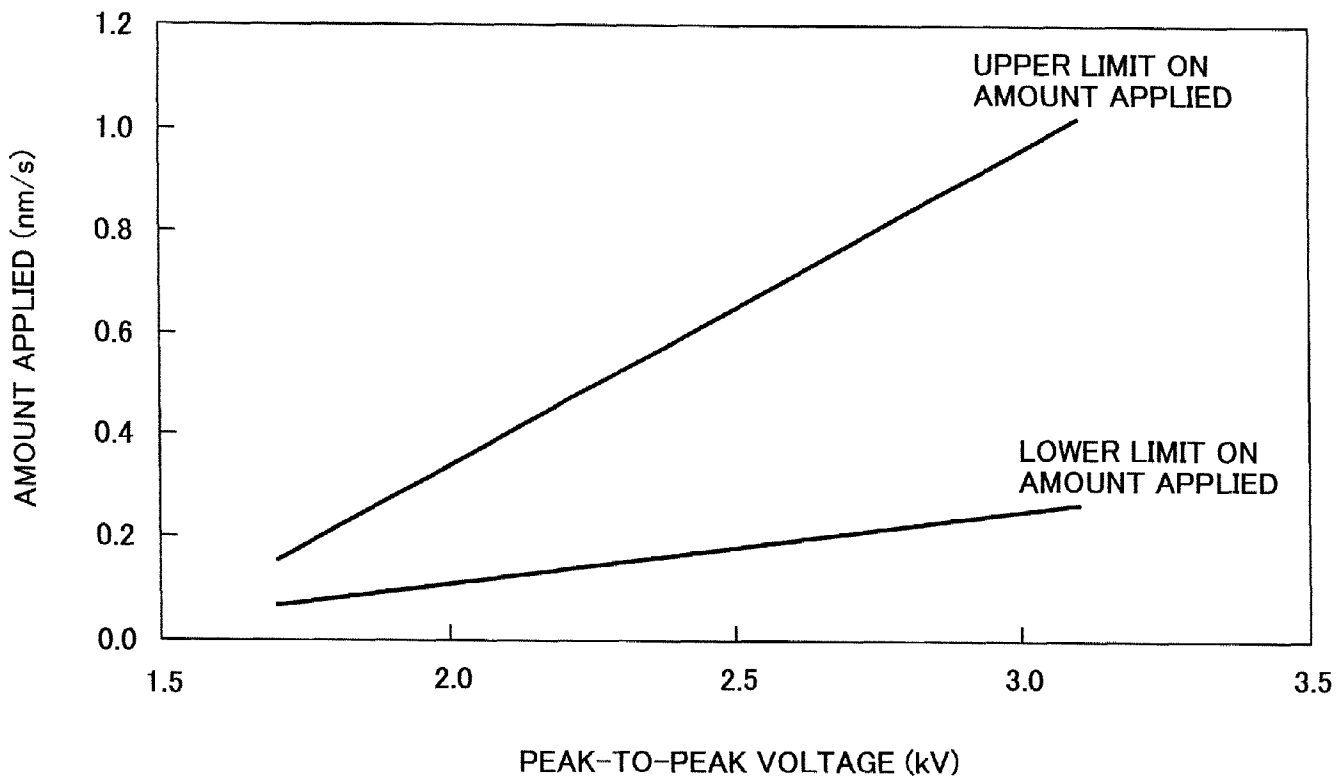
FIG. 45 is a graph by which the appropriate amount of zinc stearate when a peak-to-peak voltage of the AC voltage that is applied on the charging member is changed, is calculated.

FIG. 45 is a graph by which the appropriate amount of zinc stearate when a peak-to-peak voltage of the AC voltage that is applied on the charging member is changed, is calculated. The lower limit on amount applied and the upper limit on amount applied in FIG. 45 are the same as the lower limit on amount applied and the upper limit on amount applied in FIG. 37.

Further, from the results in FIGS. 37 and 45, normally the lower limit on the amount applied of the zinc stearate is 25×f×(Vpp/2−Vth)/L [nm/s], and the upper limit on the amount applied of the zinc stearate is 105×f×(Vpp/2−Vth)/L [nm/s], where f is a frequency [kHz] of an AC component that is applied on the charging member, Vpp [kV] is a peak-to-peak AC voltage, Vth [kV] is a starting voltage, L [mm] is a circumference of the image carrier in a direction of movement and Vth is calculated as follows $$Vth=312+6.2\times(d/\epsilon opc+Gp/\epsilon air)+\sqrt{(7737.6\times d/\epsilon opc)}$$

where d is a film-thickness [μm] of a portion subjected to charging of the image carrier, ϵopc is a specific inductive capacity of the portion subjected to charging of the image carrier, ϵair is a specific inductive capacity in space between the image carrier and the charging member, and Gp is the shortest distance [μm] between the charging member and the surface of the image carrier.

By converting this range to weight, amount to be applied can be controlled easily. While converting the range to weight, a value of density of zinc stearate is necessary and there is a possibility that the density of zinc stearate in powder form and the density of zinc stearate in crystalline form are different. The density of zinc stearate in powder form can be estimated to be 0.15 and the density of zinc stearate in crystalline form can be estimated to be 1.5. However, according to the present invention, the density of zinc stearate applied is considered to be between the two values. Based on this value of density, the lower limit on amount applied of zinc stearate can be stipulated to $$3.75\times10^{-4}\times A\times f\times(Vpp/2-Vth)/L \text{ [mg/s]},$$

and the lower limit on amount applied of zinc stearate can be stipulated to $$1.58\times10^{-2}\times A\times f\times(Vpp/2-Vth)/L \text{ [mg/s]}$$

where f is a frequency [kHz] of the AC component that is applied on the charging member, Vpp [kV] is a peak-to-peak AC voltage Vth [kV] is a starting voltage, L [mm] is a circumference of the image carrier in the direction of movement, and A [cm<SUP>2</SUP>] is a total area of a portion of image formation on the image carrier.

In a case of stipulating by the thickness, it is necessary to procure a measuring instrument that enables to measure thickness in nanometers. However, if it is stipulated by weight in such a manner, the measurement with a simple instrument is possible.

Moreover, it has been revealed that by applying zinc stearate in such a manner, apart from the effect as a lubricant, an effect as a protective substance that tempers deterioration of the photosensitive drum 402 due to charging is achieved. Particularly, while using the method of charging the photosensitive drum 402 by causing the corona discharge in the proximity space between the charging member 403 that is in proximity with the photosensitive drum 402 or in contact with the photosensitive drum 402, since the surface of the photosensitive drum 402 tends to be deteriorated, the lubricant is quite effective as a protective substance. In such a method of charging, when the voltage in which the AC component is superimposed on the DC component is applied and when a metal salt of a fatty acid is used as a lubricant, if the lubricant 407 is applied on the photosensitive drum 407 such that the proportion [%] of a metal element included in the metal salt of a fatty acid that is on the surface of the body subjected to charging in the discharge area measured by XPS is not less than $$1.52\times10^{-4}\times\{Vpp-2\times Vth\}\times f/v \text{ [\%]},$$

it has been confirmed that the lubricant functions sufficiently as a protective substance. Even in the applying condition A in FIG. 37, the element ratio mentioned above has been confirmed to have been satisfied. (where, Vpp is an amplitude [V] of the AC component that is applied on the charging member 403, f is a frequency [Hz] of the AC component that is applied on the charging member 403, Gp is the shortest distance [μm] between the surface of the charging member 403 and the surface of the photosensitive drum 402, v is a traveling velocity [mm/sec] of the surface of the photosensitive drum 402 that faces the charging member 403, and Vth is a starting voltage. Moreover, the value of Vth is $$312+6.2\times(d/\epsilon opc+Gp/\epsilon air)+\sqrt{(7737.6\times d/\epsilon)}$$

where d is a film-thickness [μm] of a portion subjected to charging of the photosensitive drum 402, ϵ opc is a specific inductive capacity of the portion subjected to charging of the photosensitive drum 403, and ϵ air is a specific inductive capacity in a space between the photosensitive drum 402 and the charging member 403).

With the applying condition A in FIG. 37, it was confirmed that there is an improvement in the cleaning efficiency as well and an effect on cleaning of a toner having a degree of circular shape not less than 0.96.

The experiment to study the change in the amount of zinc stearate applied on the photosensitive drum 402 was carried out as follows.

Zinc stearate was applied with the following conditions before applying the charging voltage and then charging was started. Zinc stearate that was applied initially has become a 10 nm thick film. Conditions for applying zinc stearate and conditions for evaluation of the film-thickness are as follows.

Conditions for Applying Zinc Stearate

Method of applying: Zinc stearate was applied with the following conditions before applying the charging voltage.

Applying time: 5 minutes

Fur brush: dent created on the surface of the photosensitive drum=1 mm

Blade: made of urethane, hardness=70

Photosensitive drum: linear velocity=125 mm/s

Conditions for Evaluation of Film-Thickness of Zinc Stearate

Evaluation method: Zinc stearate was applied on the test-piece sample according to the conditions for applying the zinc stearate and the film-thickness of the sample was evaluated. The film-thickness was calculated from the X-ray reflectance by the method for X-ray reflectance analysis by Parratt simulation.

Applicator: IPSiO color 8000 (manufactured by RICOH) modified stage movable lubricant applying unit Test-piece sample: having a 4 μm thick photosensitive layer created on the glass plate according to the dipping method Traveling velocity of stage (equivalent to the traveling velocity of the surface of the photosensitive drum)=125 mm/s Thus, after applying zinc stearate on the photosensitive drum, the change in the amount of zinc stearate with respect to the discharge was evaluated as follows.

Conditions for Charging Photosensitive Drum

Machine: IPSiO color 8000 (manufactured by RICOH) modified machine (a direct transfer full-color printer)

Charging unit: non-contact charging roller of hard type shown in FIGS. 32 and 33

Gap maintained: a non-conductive thermal contraction tube was used to maintain the gap according to the dimensions shown in FIG. 33.

Bias applied for charging: AC component: Vpp 3.0 kV, f 1.35 kHz, DC component −600 V Time for which voltage was applied: 0 sec, 10 sec, 30 sec, 60 sec, 120 sec.

Method of Evaluating Quantity of Zinc Stearate on the Photosensitive Drum

Evaluation method: The surface of the photosensitive drum after charging is evaluated by the X-ray photoelectron spectroscopy (XPS).

FIG. 35 indicates the change in C1s spectrum of the surface of the photosensitive drum, on which zinc stearate is applied and then charged, evaluated by the XPS. In FIG. 35, it is evident that the strength $\pi \rightarrow \pi$ goes on increasing with the charging time. $\pi \rightarrow \pi$ is a signal caused by the benzene ring of polycarbonate that is a main substance in the photosensitive drum and not caused by zinc stearate. In other words, FIG. 35 illustrates that by charging there is a decrease in the lubricant applied and the surface of the photosensitive drum is exposed gradually, as against the overall surface of the photosensitive drum covered by the lubricant after applying the lubricant initially on the surface of the photosensitive drum. Therefore, the results in FIG. 35 indicate that zinc stearate vanishes gradually from the area of strong discharge. The results of the area ratio of zinc stearate on the surface of the photosensitive drum in FIG. 35 calculated are tabulated in FIG. 36. As it is evident from FIG. 36, approximately 10 nm thick zinc stearate applied initially, has vanished partially in the charging time of 30 seconds.

In this case, the following points are to be noted. Since the discharge strength is not uniform due to the roughness of the surface of the photosensitive drum and the gap to be maintained, the amount of zinc stearate on the photosensitive drum varies from place to place. Therefore, the change in the amount of zinc stearate can be considered to be varying locally. For this reason, even if zinc stearate of uniform thickness could be applied on the overall surface of the photosensitive drum initially, the change due to the charging on the photosensitive drum in not necessarily uniform. Therefore, there is a possibility that zinc stearate vanishes partially as indicated in FIG. 36.

As it is evident from FIG. 36, zinc stearate having the film-thickness of 10 nm applied initially vanished partially in 30 seconds. Therefore, under this charging condition, the speed of vanishing of zinc stearate is 10 [nm]/30 [sec]=0.3 [nm/sec]. The amount of zinc stearate applied per unit time has to be not less than 0.3 [nm/sec]. Moreover, in the charging time of 10 seconds, since zinc stearate is there all over the surface of the photosensitive drum, to prevent problems caused by the excessive application on the photosensitive drum, it is desirable that the amount applied is not more than 10 [nm]/10 [sec].

By using the similar method, the results in FIG. 37 can be achieved by changing the frequency of the charging voltage and calculating the speed at which zinc stearate is applied. In a case where the conditions of the charging voltage are changed, based on these results, it is possible to regulate the ideal speed of applying zinc stearate all the time. Moreover, by the similar method, the ideal amount of applying when the amplitude voltage of the charging voltage is changed can be regulated.

The experiment about the change in the film-thickness of the photosensitive drum according to the conditions of zinc stearate was carried out as described below.

Regarding the conditions for applying the amount of zinc stearate, the change in the thickness of the film on the photosensitive drum when the conditions were set to applying conditions A and B respectively, which are different, was studied. As shown in FIG. 37, the applying condition A is in line with the conditions for applying that is regulated based on the condition of the charging voltage whereas the applying condition B does not conform to it.

Conditions for Evaluation of Amount of Film Scraped

Measuring apparatus: IPSiO color 8000 (manufactured by RICOH) modified simple testing machine Apparatus for measuring thickness of the film on the photosensitive drum: FISCHERSCOPE MMS manufactured by FISCHER INSTRUMENT INC.

Running time: 10 hours

As a result, there was no scraping of the film with the applying condition A and the film was scraped with the applying condition B. Thus, regulating the speed of applying zinc stearate by the discharge strength was ascertained to be effective in increasing the life of the photosensitive drum. In other words, with the condition B, no sufficient amount that can show lubricating ability on the photosensitive drum was there whereas with the condition A, sufficient amount that can render the maximum lubricating ability is there. Therefore, the scraping of the photosensitive drum can be suppressed.

Figure 46:
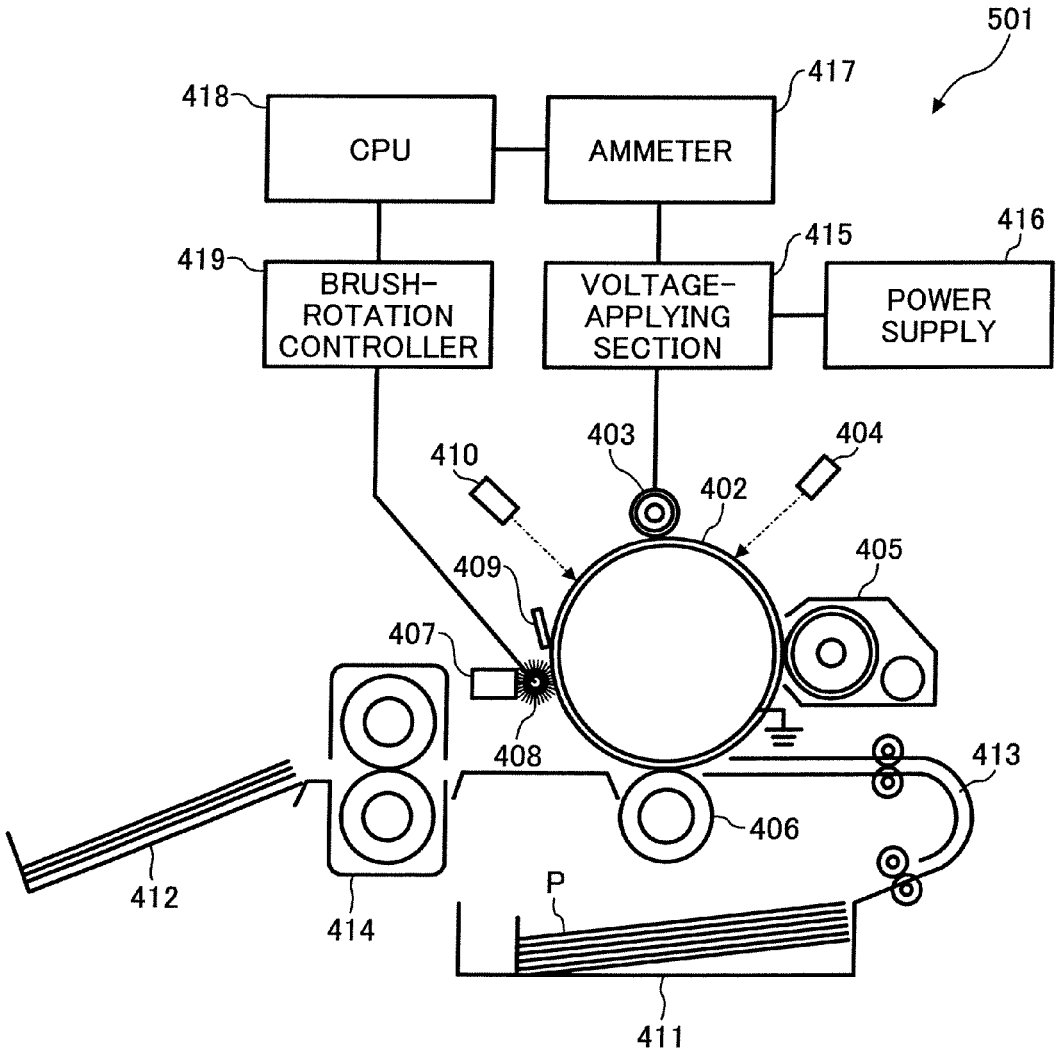
FIG. 46 is side view of a portion of a mechanism that applies the lubricant on the photosensitive drum, which is a part of a printer according to the present invention.

FIG. 46 is a side view of a portion of a mechanism that applies the lubricant 407 on the photosensitive drum 402, which is a part of a printer. A basic structure according to the present embodiment is the same as that shown in FIG. 31 and includes the lubricant 407 that is compressed, the photosensitive drum 402, the fur brush 408, and the elastic blade 409. The fur brush 408 that is driven and rotates is disposed at a position such that it is in contact with the lubricant 407 and the photosensitive drum 402. The front end of the elastic blade 409 is in contact with the surface of the photosensitive drum 402.

The present embodiment differs from the embodiment shown in FIG. 44 at a point that the ammeter 417 for measuring the strength of the corona discharge generated between the charging roller 403 and the photosensitive drum 402, and the brush-rotation controller 419 that controls the rotations of the fur brush 408, are provided.

In this case, the strength of the corona discharge that is generated between the charging roller 403 and the photosensitive drum 402 depends on the environmental conditions of temperature and humidity, and changes constantly. The strength of the corona discharge can be detected by measuring the discharge current by the ammeter 417, which is a detecting unit connected to the voltage applying section 415. The ammeter 417 is connected to the CPU 418. The CPU 418 controls each section of the printer 501, and the ROM (not shown in the diagram) that stores various computer programs that are run by the CPU 418 and the RAM (not shown) that functions as a work area of the CPU 418, are connected to the CPU 418.

The fur brush 408 is disposed at a position where it makes a contact with the lubricant 407 that is compressed and the surface of the photosensitive drum 402. The fur brush 408 removes the toner adhered to and remained on the surface of the photosensitive drum 402 as well as functions as an applying unit that applies the lubricant 407 on the surface of the photosensitive drum 402. The brush-rotation controller 419 that drives and rotates the fur brush 408, is connected to the CPU 418 and functions as an amount adjusting unit that adjusts the amount of the lubricant to be applied on the photosensitive drum 402 by varying the number of revolutions of the fur brush 408 according to the control of the CPU 418 based on the measurement results from the ammeter 417. As the number of revolutions of the fur brush 408 increase, the amount of the lubricant scraped by and applied on the surface of the photosensitive drum 402 by the fur brush 408 increases.

In such a structure, according to the present embodiment, when the strength of the corona discharge has changed according to a change in temperature and humidity, the number of revolutions of the fur brush 408 can be controlled according to the change in the corona discharge and the amount of the lubricant 407 on the surface of the photosensitive drum 402 can be maintained to appropriate amount. If the strength of the corona discharge increases due to the change in temperature and humidity, the number of revolutions of the fur brush 408 is increased to increase the amount of the lubricant 407 that is scraped, thereby increasing the amount of the lubricant 407 to be applied on the surface of the photosensitive drum 402. On the other hand, if the strength of the corona discharge decreases due to the change in temperature and humidity, the number of revolutions of the fur brush 408 is reduced to decrease the amount of the lubricant 407 that is scraped, thereby decreasing the amount of the lubricant 407 to be applied on the surface of the photosensitive drum 402.

According to the present embodiment, detection of the strength of the corona discharge by measuring the discharge current by using the ammeter 417, which is a detecting unit connected to the voltage applying section 415, has been described by giving an example. However, instead of the ammeter 417, a unit that detects the intensity of the discharge light may be provided as a detecting unit.

In this case, the strength of the corona discharge that is generated between the charging roller 403 and the photosensitive drum 402 depends on the environmental conditions of temperature and humidity, and changes constantly. The strength of the corona discharge is detected by detecting the intensity of the discharge light (corona discharge light). The amount of the lubricant to be applied on the photosensitive drum 402 can be adjusted by changing the number of revolutions of the fur brush 408 by the control of the CPU 418 based on the results of detection of the intensity of the discharge light.

Therefore, according to the means to solve the problem mentioned above, the lubricant applying unit according to the present invention can form a thin film of a lubricant on a surface of a member on which the lubricant is applied. Moreover, a film of thickness in a range of 8 nm to 12 nm can be applied.

In the process cartridge and the image forming apparatus according to the present invention, by forming a thin layer of thickness in the range of 8 nm to 12 nm on the image carrier, the coefficient of friction between the surface of the photosensitive drum and the cleaning blade can be lowered and an amount of scraping of the photosensitive drum can be suppressed.

By forming a uniform film of the lubricant on the surface of the image carrier, deterioration of the image quality and a defective image can be prevented and the life of the image carrier can be increased.

Further, by integrating the image carrier and the lubricant applying unit, a contact between the two can be maintained easily, thereby contributing to an improvement in the service.

There is a decrease in the lubricant that is applied on the surface of the image carrier due to a discharge between the image carrier and the charging member. However, by applying an amount of the lubricant on the image carrier upon having taken into consideration the decrease due to the discharge, the functioning of the lubricant can be maintained over a longer period of time and the deterioration such as scraping of the image carrier can be prevented.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A lubricant applying unit comprising:

a lubricant applying member; and a lubricant that is disposed at a position to be applied to a surface of an image carrier by the lubricant applying member, the image carrier being charged by a charging unit, and the charging unit being applied with a voltage including an AC voltage, wherein the lubricant applying member applies an amount of the lubricant no less than an amount calculated by $$3.75\times10^{-4}\times A\times f\times(Vpp/2-Vth)/L \text{ [mg/s]}$$

to the surface of the image carrier, where f is a frequency [kHz] of an AC component of the AC voltage, Vpp [kV] is a peak-to-peak voltage of the AC voltage, L [mm] is a circumference of the image carrier in a direction of movement, A [cm$^2$] is a total area of a portion of image formation on the image carrier, and Vth [kV] is a starting voltage calculated by $$312+6.2\times(d/\epsilon opc+Gp/\epsilon air)+\sqrt{(7737.6\times d/\epsilon opc)}, \text{ where}$$

d is a film-thickness [μm] of a portion subjected to charging of the image carrier, $\epsilon$opc is a specific inductive capacity of the portion subjected to charging of the image carrier, $\epsilon$air is a specific inductive capacity in space between the image carrier and the charging unit, and Gp is a shortest distance [μm} between the charging unit and the surface of the image carrier.

2. The lubricant applying unit according to claim 1, wherein the lubricant applying member applies an amount of the lubricant no more than an amount calculated by $$1.58\times10^{-2}\times A\times f\times(Vpp/2-Vth)/L \text{ [mg/s]}.$$

3. The lubricant applying unit according to claim 1, wherein the lubricant applying member applies an amount of the lubricant calculated by 10/t [nm/sec], where t is a minimum elapsed time since an electric discharge occurs between the charging unit and the image carrier till a signal, which occurs due to specific combination of molecules constituting an outer circumference surface of the image carrier, is detected by an X-ray photoelectron spectroscopy (XPS).

4. The lubricant applying unit according to claim 1, further comprising a spreading member that uniformly spreads the lubricant applied to the surface of the image carrier so as to form a thin layer of the lubricant on the surface.

5. The lubricant applying unit according to claim 1, wherein the lubricant includes a metal salt of a fatty acid that contains at least one fatty acid selected from acids including stearic acid, palmitic acid, myristic acid, and oleic acid and at least one metal selected from metals including zinc, aluminum, calcium, magnesium, iron, and lithium.

6. The lubricant applying unit according to claim 5, wherein the lubricant is formed by compressing the metallic salt of the fatty acid in powder form.

7. The lubricant applying unit according to claim 6, wherein the lubricant is made of zinc stearate.

8. An image forming apparatus comprising:

an image carrier on which an electrostatic latent image is formed;

a charging unit that charges the image carrier;

a latent-image forming unit that forms a latent image on the image carrier by exposing the image carrier;

a developing unit that supplies toner to the latent image on the image carrier to form a toner image that is visible;

a transferring unit that transfers the toner image to a recording medium directly or via an intermediate transfer body that moves on a surface of the image carrier while being in contact with the image carrier;

a cleaning unit that includes a cleaning blade that gathers the toner remained on the surface of the image carrier after transferring the toner image to the recording medium; and a lubricant applying unit that includes a lubricant applying member; and a lubricant that is disposed at a position to be applied to the surface of the image carrier by the lubricant applying member, the image carrier being charged by the charging unit, and the charging unit being applied with a voltage including an AC voltage, wherein the lubricant applying member applies an amount of the lubricant no less than an amount calculated by $$3.75\times10^{-4}\times A\times f\times(Vpp/2-Vth)/L \text{ [mg/s]}$$

to the surface of the image carrier, where f is a frequency [kHz] of an AC component of the AC voltage, Vpp [kV] is a peak-to-peak voltage of the AC voltage, L [mm] is a circumference of the image carrier in a direction of movement, A [cm<SUP>2</SUP>] is a total area of a portion of image formation on the image carrier, and Vth [kV] is a starting voltage calculated by $$312+6.2\times(d/\epsilon opc+Gp/\epsilon air)+\sqrt{(7737.6\times d/\epsilon opc)}, \text{ where}$$

d is a film-thickness [μm] of a portion subjected to charging of the image carrier, εopc is a specific inductive capacity of the portion subjected to charging of the image carrier, εair is a specific inductive capacity in space between the image carrier and the charging unit, and Gp is a shortest distance [μm] between the charging unit and the surface of the image carrier.

9. The image forming apparatus according to claim 8, wherein the lubricant applying member applies an amount of the lubricant no more than an amount calculated by $$1.58\times10^{-2}\times A\times f\times(Vpp/2-Vth)/L \text{ [mg/s]}.$$

10. The image forming apparatus according to claim 8, wherein the lubricant applying member applies an amount of the lubricant calculated by 10/t [nm/sec], where t is a minimum elapsed time since an electric discharge occurs between the charging unit and the image carrier till a signal, which occurs due to specific combination of molecules constituting an outer circumference surface of the image carrier, is detected by an X-ray photoelectron spectroscopy (XPS).

11. The image forming apparatus according to claim 8, further comprising a spreading member that uniformly spreads the lubricant applied to the surface of the image carrier so as to form a thin layer of the lubricant on the surface.

12. The image forming apparatus according to claim 8, wherein the lubricant includes a metal salt of a fatty acid that contains at least one fatty acid selected from acids including stearic acid, palmitic acid, myristic acid, and oleic acid and at least one metal selected from metals including zinc, aluminum, calcium, magnesium, iron, and lithium.

13. The image forming apparatus according to claim 12, wherein the lubricant is formed by compressing the metallic salt of the fatty acid in powder form.

14. The image forming apparatus according to claim 13, wherein the lubricant is made of zinc stearate.

15. A lubricant applying unit comprising:

a lubricant applying member; and a lubricant that is disposed at a position to be applied to a surface of an image carrier by the lubricant applying member, the image carrier being charged by a charging unit, and the charging unit being applied with a voltage including an AC voltage, wherein the lubricant applying member applies an amount of the lubricant no less than an amount calculated by $$25\times f\times(Vpp/2-Vth)/L \text{ [nm/s]}$$

to the surface of the image carrier, where f is a frequency [kHz] of an AC component of the AC voltage, Vpp [kV] is a peak-to-peak voltage of the AC voltage, L [mm] is a circumference of the image carrier in a direction of movement, and Vth [kV] is a starting voltage calculated by $$312+6.2\times(d/\epsilon opc+Gp/\epsilon air)+\sqrt{(7737.6\times d/\epsilon opc)}, \text{ where}$$

d is a film-thickness [μm] of a portion subjected to charging of the image carrier, εopc is a specific inductive capacity of the portion subjected to charging of the image carrier, εair is a specific inductive capacity in space between the image carrier and the charging unit, and Gp is a shortest distance [μm] between the charging unit and the surface of the image carrier.

16. The lubricant applying unit according to claim 15, wherein the lubricant applying member applies an amount of the lubricant no more than an amount calculated by $$105\times f\times(Vpp/2-Vth)/L \text{ [nm/s]}.$$

* * * * *